US010323457B2

(12) United States Patent
Boswell

(10) Patent No.: US 10,323,457 B2
(45) Date of Patent: Jun. 18, 2019

(54) DOWN THE HOLE HAMMER AND SYSTEMS AND COMPONENTS THEREOF

(71) Applicant: IGNIS TECHNOLOGIES PTY LTD, Bellevue (AU)

(72) Inventor: Peter Warwick Boswell, Bellevue (AU)

(73) Assignee: IGNIS TECHNOLOGIES PTY LTD, Bellevue (AU)

( * ) Notice: Subject to any disclaimer, the term of this patent is extended or adjusted under 35 U.S.C. 154(b) by 152 days.

(21) Appl. No.: 15/327,148

(22) PCT Filed: Jul. 31, 2015

(86) PCT No.: PCT/AU2015/000456
§ 371 (c)(1),
(2) Date: Jan. 18, 2017

(87) PCT Pub. No.: WO2016/015093
PCT Pub. Date: Feb. 4, 2016

(65) Prior Publication Data

US 2017/0152711 A1 Jun. 1, 2017

(30) Foreign Application Priority Data

Jul. 31, 2014 (AU) ..... 2014902951
Jul. 31, 2014 (AU) ..... 2014902952
(Continued)

(51) Int. Cl.
*E21B 4/14* (2006.01)
*E21B 21/10* (2006.01)
(Continued)

(52) U.S. Cl.
CPC ..... *E21B 4/14* (2013.01); *E21B 17/04* (2013.01); *E21B 17/076* (2013.01); *E21B 21/10* (2013.01)

(58) Field of Classification Search
CPC ..... E21B 4/14; E21B 21/10
See application file for complete search history.

(56) References Cited

U.S. PATENT DOCUMENTS 2,764,130 A * 9/1956 Bassinger ..... E21B 4/14 173/1
3,285,353 A * 11/1966 Young ..... E21B 31/113 166/178
(Continued)

FOREIGN PATENT DOCUMENTS

EP 0322170 A2 6/1989
WO WO-2005/049960 A1 6/2005
WO WO-2008/007066 A1 1/2008

OTHER PUBLICATIONS

International Search Report and Written Opinion, International Application No. PCT/AU2015/000456, dated Oct. 29, 2015.

*Primary Examiner* — Shane Bomar
(74) *Attorney, Agent, or Firm* — Marshall, Gerstein & Borun LLP

(57) ABSTRACT

A down the hole hammer (10) incorporates: an inner tube assembly (100); a fluid flow control system (200); a bit retaining system (400); a porting sleeve (600); and a piston (700). Each of the: inner tube assembly (100); fluid flow control system (200); bit retaining system (400); porting sleeve (600); and piston (700) in their own right provide benefit to the overall operation and/or reliability of the hammer (10).

37 Claims, 37 Drawing Sheets

(30) Foreign Application Priority Data

Jul. 31, 2014 (AU) ..... 2014902955
Aug. 21, 2014 (AU) ..... 2014903285

(51) Int. Cl.
*E21B 17/07* (2006.01)
*E21B 17/04* (2006.01)

(56) References Cited

U.S. PATENT DOCUMENTS

| | | | | | |
|---|---|---|---|---|---|
| 3,616,868 | A | | 11/1971 | Bassinger | |
| 4,111,271 | A | * | 9/1978 | Perkins | E21B 31/113<br>137/614.14 |
| 4,819,746 | A | * | 4/1989 | Brown | E21B 4/14<br>175/215 |
| 5,056,609 | A | | 10/1991 | Rear | |
| 5,277,264 | A | * | 1/1994 | Song | B25D 9/12<br>175/296 |
| 8,893,827 | B2 | * | 11/2014 | Kosovich | E21B 4/14<br>166/242.6 |
| 2010/0012380 | A1 | | 1/2010 | Swadi | |

* cited by examiner

DOWN THE HOLE HAMMER AND SYSTEMS AND COMPONENTS THEREOF

This application is a national application of international application no. PCT/AU2015/000456, filed Jul. 31, 2015, which claims the benefit under 35 U.S.C. § 119 of Australian patent application Nos. 2014902955, filed Jul. 31, 2014; 2014902952, filed Jul. 31, 2014; 2014902951, filed Jul. 31, 2014;and 2014903285, filed Aug. 21, 2014.

TECHNICAL FIELD

A down the hole (DTH) hammer is disclosed. Also disclosed are systems and components of the DHT hammer. Such systems and components may also be used for or in fluid operated equipment other than a DTH hammer.

BACKGROUND ART

Many down the hole (DTH) devices such as but not limited to motors, pumps and DTH hammers operate by channelling a working fluid such as air, nitrogen, water, oil or mud through a drill pipe to operate the device.

The working fluid is pressurised and delivered at a pressure and rate dependent on many factors including the capacity of the driving compressor/pumping system; pressure losses through the drill pipe and DTH device itself; the mechanical limitations of the DTH device and environmental fluid pressure.

Consider for example a common DTH reverse circulation (RC) hammer (herein after "RC hammer"). The RC hammer comprises: an outer case which is coupled to a down hole end of the drill string; an inner tube; a porting sleeve; a hammer or piston which is able to slide along the inner tube and within the outer casing; and a drill bit. Fluid pumped down the drill string enters a porting arrangement between the outer case and the inner tube and reciprocates the piston to cyclically impact the drill bit. This transfers kinetic energy into the material at the toe (bottom) of the hole to fracture and displace the material. This material is delivered by residual fluid energy through the inner tube to the surface. This material can be analysed to provide information on the mineralogy and geology of the substrata.

Current RC hammers are deliberately designed to be inefficient with reduced mechanical energy output. This is to enhance mechanically reliable of the RC hammer when driven by compressors which provide excessive fluid pressure and flow rate to the work chamber when drilling short holes. It is known that inline pressure loses increase with hole depth (i.e. drill string length). So for short holes there is minimal inline pressure lose through the drill string. But the fluid pressure and flow rate provided by the compressors/boosters is designed for a deeper target depth. Consequently to protect the hammer as it progresses to the target depth current design practise is to reduce internal port efficiency and thus mechanical output of the hammer to protect bearing and striking surfaces of a piston and the bit from material and lubrication failures when used with excessive airpower. As a result of these in-built inefficiencies, when it is desired to drill deeper, then larger compressors are required especially to produce sufficient pressure differential at the piston (work chamber), to enable driving of the hammer drill bit and to compensate for additional in line losses as the length of the drill pipe increases. This leads to increased operational costs due to the power requirements of the compressors to do useful work at the bottom of deep holes, needing to overcome increasing additional line losses, and the designed and built-in flow restrictions.

The above described background art is not an admission that the art forms part of the common general knowledge of a person of ordinary skill in the art. Further, the above references are not intended to limit the application of the disclosed down the hole hammer and the systems and components thereof. Specifically, the above references are not intended to limit application of the systems and components to use only with or in a DTH hammer or DTH RC hammer.

SUMMARY OF THE DISCLOSURE

The disclosure is of a down the hole hammer and: an inner tube assembly; a fluid flow control system; a bit retaining system; a porting sleeve; and piston. Each of the an inner tube assembly; a fluid flow control system; a bit retaining system; a porting sleeve; and piston, can be incorporated individually or in any combination in the disclosed hammer. For example one embodiment of the disclosed hammer may have an embodiment of the disclosed fluid flow control system but otherwise a prior art bit retaining system; porting sleeve; inner tube and piston. In another example one embodiment of the disclosed hammer may have an embodiment of the disclosed piston but otherwise a prior art bit retaining system; porting sleeve; inner tube and fluid flow control system. Each of the inner tube assembly; fluid flow control system; bit retaining system; porting sleeve; and piston may provide operational or reliability or both benefits to an benefits to provide benefits to a hammer or other fluid operated device in which they are installed by themselves or in various combinations.

In one aspect there is disclosed a fluid flow control system capable of controlling the fluid flow form an upstream fluid supply to a work chamber or a fluid driven piston of a DTH device. The control system is connectable between a compressor or other fluid supply and the work chamber of the DHT device. The control system operates on the mass flow of fluid through a flow annulus which it forms immediately above or otherwise in close proximity to, and at a substantially fixed spacing from, the work-chamber and/or piston of the DHT device. Controlling the size of the flow annulus changes the pressure drop across the control system and the remaining pressure drop available across the work chamber. This has an effect on pressure available to other downstream restrictors, devices and flow paths.

As the disclosed control system is able to facilitate a variation in fluid pressure applied to the work chamber of the DTH device; it enables the DTH device to be originally designed for increased fluid flow efficiency while allowing fluid pressure across the work chamber to be regulated to enable matching of the supply of the fluid with the mechanical limits of operation of the DTH device and the environment in which the DTH device is deployed. In the case of the DTH device being an RC hammer the pressure control device can enable for example; tuning of the impact force and/or cycle rate of the hammer to best match: the flow rate and pressure of the driving compressor within the operational and reliability limits of the RC hammer itself; and, the nature of the ground in which it is deployed.

In a first aspect there is disclosed a fluid flow control system for a DTH device which can be coupled to a downstream end of a conduit and driven by a fluid supplied through the conduit from an upstream end of the conduit wherein the control system is capable of controlling fluid pressure to the DHT device; the control system being connectable between the conduit and the DHT device wherein the control system is maintained in a constant juxtaposition with the DHT device irrespective of length of the conduit.

In one embodiment the fluid flow control system comprises a flow path annulus through which a fluid for driving the DHT device flows, the flow path annulus having an annulus radial width Aw which is capable of being is changed.

In one embodiment the flow path annulus has an outer radius Ro and an inner radius Ri wherein Aw=Ro−Ri; and wherein at least one of the radii Ro and Ri is capable of being is changed to affect the change in the annulus radial width.

In one embodiment the at least one radii is automatically changeable in response to pressure differential of the fluid across the control system.

In one embodiment the fluid flow control system comprises an outer article having an inner surface that forms the outer radius Ro of the annulus and wherein the outer article is interchangeable with one of a plurality of user selectable other outer articles configured to produce a different annulus radius Ro.

In one embodiment the fluid flow control system comprises an inner article having an outer surface that forms the inner radius Ri of the annulus and wherein the inner article is interchangeable with one of a plurality of other user selectable inner articles configured to produce a different annulus radius Ri.

In one embodiment the fluid flow control system comprises an inner article having an outer surface that forms the inner radius Ri of the annulus and wherein the inner article is moveable in response to the pressure differential of the fluid across the control system between at least a first choke position and a second choke position to vary the inner radius Ri of the flow path annulus.

In one embodiment the fluid flow control system comprises an outer article having an inner surface that forms the outer radius Ro of the annulus and wherein the outer article is moveable in response to the pressure differential of the fluid across the control system between at least a first choke position and a second choke position.

In one embodiment the fluid flow control system comprises an inner article having an outer surface that forms the inner radius Ri of the annulus and wherein the inner article is interchangeable with one of a plurality of other user selectable inner articles configured to produce a different annulus radius Ri.

In one embodiment the fluid flow control system comprises an inner article having an outer surface that forms the inner radius Ri of the annulus and wherein the inner article is moveable in response to the pressure differential of the fluid across the control system between at least a first choke position and a second choke position to vary the inner radius Ri of the flow path annulus.

In one embodiment the outer article is a ring.

In one embodiment the article is a sub connectable between the DHT device and the conduit.

In one embodiment the fluid flow control system comprises a sub connectable between the DHT device and the conduit and wherein the sub arranged to retain the ring at a substantially fixed location relative to the DHT device.

In one embodiment the outer surface of the inner article has a different diameter at each of the choke positions.

In one embodiment the inner article is biased to move in an upstream direction with reference to a direction of flow of the fluid supplied through the conduit.

In one embodiment the fluid flow control system comprises a spring which biases the flow control body to move in the upstream direction and wherein the spring is retained within the flow control body.

In one embodiment the inner surface of the outer article has a different diameter at each of the choke positions.

In one embodiment the fluid flow control system h comprises a bypass path configured to enable a portion of the fluid downstream of the flow path annulus to be diverted from being able to drive the DHT device.

In one embodiment the inner article enables the bypass path to be open when the inner article is in the first choke position to facilitate bypassing of a portion of the fluid from driving the DTH device.

In one embodiment the the inner article closes the bypass path when the inner article is in the second choke position wherein all fluid passing through the flow path annulus can drive the DTH device.

In one embodiment the fluid flow control system comprises a bypass spacer which can be selectively coupled with the inner article to hold the inner article in the first choke position.

In one embodiment the bypass spacer is arranged to couple with the inner article in at least a first orientation in which the bypass spacer closes the bypass path and a second orientation in which the bypass spacer holds to the bypass path open.

In one embodiment the DHT device is a DTH hammer comprising an outer case, a piston and a hammer bit retained in the outer case, wherein the fluid flow control system is operable to control fluid pressure to the piston to enable tuning of the DTH hammer in terms of one or both of impact force and impact frequency of the piston.

In a second aspect there is disclosed a DTH hammer comprising:

- a fluid driven piston arranged to be capable of cyclically impacting a hammer bit; and
- a fluid flow control system arranged to facilitate control of flow of fluid for driving the piston;
- the fluid flow control system being in accordance with the first aspect.

In a third aspect there is disclosed a DTH hammer comprising:

- a hammer bit and a fluid drivable piston capable of cyclically impacting the hammer bit; and
- a fluid flow control system arranged to facilitate control of fluid available drive the piston; the fluid flow control system comprising:
  - a ring having an inner diameter which forms an outer radius Ro of a flow path annulus through which a fluid from an upstream fluid supply flows to drive the piston; and an inner article locatable with respect to the ring to form an inner radius Ri of the flow path annulus wherein the ring and the inner article together define the flow path annulus through which fluid from the upstream supply flows to drive the DHT hammer.

In one embodiment the ring is one of a plurality of user selectable rings of different inner diameter.

In one embodiment the inner body is movable between at least a first choke position and a second choke position to vary the inner radius Ri of the flow path annulus.

In one embodiment an outer surface of the inner article has a different diameter at each of the choke positions and the inner article is movable in an axial direction.

In one embodiment the inner article is biased to move in an upstream direction with reference to a direction of flow of the fluid to the piston form the supply.

In one embodiment the DTH comprises an inner tube which passes through the inner article and wherein the piston has an axial passage into the inner tube extends and along which the piston can reciprocate when impacting the hammer bit.

In one embodiment the inner tube comprises a first tube having an outer circumferential surface; and a second tube locatable coaxial with and around a portion of the outer circumferential surface of the first tube, wherein the portion of the outer circumferential surface of the first tube and an inner circumferential surface of the second tube are relatively configured to create a bypass path there between enabling a portion of the fluid to flow in an axial direction between the first and second tubes and through the axial passage.

In one embodiment the inner article is configured so that: when in the first choke position the inner article allows the bypass path to be open which enables diversion of a portion of the fluid downstream of the flow path annulus from being able to drive the piston; and when in the second choke position the inner article closes the bypass path so that substantially all of the fluid downstream of the flow path annulus is available to drive the piston.

In one embodiment the DTH hammer comprises a spacer which can be selectively coupled with the inner article to hold the inner article in the first choke position.

In one embodiment the DTH comprises a spacer which can be selectively coupled in either (a) a first orientation with the inner article to hold the inner article in the first choke position and close the bypass path and (b) a second orientation with the inner article to hold the inner article in the first choke position and open the bypass path.

In a fourth aspect there is disclosed a fluid flow control system for a DTH device which can be coupled to downstream end of a conduit and driven by a fluid supplied through the conduit from an upstream end of the conduit and the DTH device having a non-return valve to prevent a flow of fluid in an upstream direction past the non-return valve, the control system comprising:

an orifice connectable between the DTH device and an upstream end of the conduit; and a flow control body locatable downstream of the non-return valve and within a diameter of the orifice wherein the orifice and the flow control body together define a flow path annulus through which fluid supplied from an upstream end of the conduit passes to drive the DHT device.

In a fifth aspect there is disclosed a control system for a DTH device having an outer case and an inner tube and capable of being coupled to a drill pipe, the control system comprising:

a sub configured to couple to one end of the outer case and at an opposite end to the drill string; and a ring locatable within the outer case and retained by the sub, the ring having an inner diameter forming an outer diameter of flow path annulus through which a fluid supplied from an upstream end of the drill pipe flows to drive the DHT device, wherein the ring is one of a plurality of user selectable rings of different inner diameter.

In a sixth aspect there is disclosed a fluid flow control system for a DTH device which can be coupled to downstream end of a conduit and driven by a fluid supplied through the conduit from an upstream end of the conduit, the control system comprising:

a ring locatable between the DTH device and an upstream end of the conduit, wherein the ring is one of a plurality of user selectable rings of different inner diameter.

n a second aspect there is disclosed a DTH drill comprising:

a DTH hammer having an outer case, a piston and a hammer bit retained in the outer case; and a control system arranged to facilitate control of fluid pressure to the DTH hammer;

the control system comprising:

a ring having an inner diameter which forms an outer radius Ro of a flow path annulus through which a fluid supplied from an upstream end of the conduit flows to drive the DHT hammer; and an inner article locatable with respect to the ring to form an inner radius Ri of the flow path annulus wherein the ring and the inner article together define the flow path annulus through which fluid supplied from an upstream end of the conduit passes to drive the DHT hammer.

Embodiments of the disclosed a bit retaining system for a DTH hammer facilitates easy bit replacement. Embodiments of the disclosed bit retaining system may also facilitate uniform fluid flow distribution in a down hole direction on an outside of the drill bit. This fluid is subsequently used in the DTH hammer to convey drill cuttings through a central passage in a drill bit and up an associated drill string. The embodiments of the disclosed drill bit retaining system also enable retention of the drill bit in a region of increased diameter in comparison to the shank. This region is inherently stronger than the shank. Further, embodiments of the disclosed drill bit retaining system reverse the nature of the deceleration forces on the shank in comparison with the prior at. In the prior art at the end of a piston stroke any impact with a bit retention ring generates tensile forces to the shank. This is a leading cause of fracture of DTH hammer bits. In embodiments of the disclosed retention system, any comparable impact with the bit retention system occurs at a location on the bit adjacent a down hole end of the shank, and more significantly, in a larger cross-sectional area of the drill bit. Resultant deceleration forces now act as compressive forces on the shank from its up-hole end toward the end of the splines.

In a seventh aspect there is disclosed a drill bit retaining system for a hammer drill having an outer tube and a drill bit, the drill bit having a shank and a cutting face that extends from a first end of the outer tube and a plurality of splines that extend axially along the shank; the retaining system comprising: a shroud capable of coupling to the first end of the outer tube, the shroud being locatable over an intermediate portion of the drill bit, the shroud having an internal circumferential surface configured to provide an abutment surface for the drill bit to prevent the drill bit from falling from the outer tube, and facilitate substantially uniform fluid flow distribution in a down hole direction between the internal circumferential surface and an outer surface of the drill bit.

In one embodiment the internal circumferential surface of the shroud comprises a plurality of circumferentially spaced apart and radial inwardly extending protrusions, the protrusions forming the abutment surface.

In one embodiment the drill bit retaining system comprises a detent system capable of holding the shroud in a first fixed rotational position relative to the bit in which the abutment surface is capable of abutting a stop on the bit to prevent the bit form passing out of the shroud.

In one embodiment the detent system comprises a plurality of circumferentially spaced apart recesses formed in the internal circumferential surface of the shroud, the recesses axially spaced from the protrusions.

In one embodiment the recesses are evenly spaced about the internal circumferential surface.

In one embodiment each recess is axially aligned with a respective protrusion.

In one embodiment the protrusions are configured to enable axial alignment with respective splines on the bit when the shroud is in the first rotational position.

In one embodiment the drill bit retaining system comprises at least four protrusions and wherein the protrusions are evenly spaced about the internal circumferential surface.

In one embodiment the drill bit retaining system comprises one protrusion for each spline.

In one embodiment wherein there are more protrusions than recesses.

In one embodiment the internal circumferential surface comprises a circumferential band of reduced radius in comparison to an adjacent portion of the internal circumferential surface, and wherein the recesses are formed in the band.

In one embodiment the drill bit retaining system comprises a drive sub arranged to couple to the first end of the outer tube, the shroud being locatable over the drive sub and wherein the drive sub and the shroud are configured to enable clamping of the shroud between the first end of the outer tube and the drive sub.

In one embodiment the shroud comprises an outer circumferential surface provided with plurality of gaps arranged to enable the protrusions to pass there through in an axial direction.

In one embodiment the detent system comprises one or more members coupled to or provided on the drive sub and wherein the members are receivable in respective recesses.

In one embodiment the outer circumferential surface of the drive sub includes an outer band in which the gaps are formed and wherein the circumferential band of the sleeve has radius smaller the outer band thereby preventing the sleeve from falling from the drive sub.

In an eighth aspect there is disclosed a hammer drill comprising:

an outer tube having a first end and a second end;

a drill bit provided with a central passage open at opposite ends of the bit, a shank, a cutting face that extends from the first end of the outer tube, and plurality of axially extending splines on the shank; and a drill bit retaining system according to the seventh aspect, wherein the shroud is capable of coupling to the first end of the outer tube and arrange to prevent the drill bit form falling out of the outer tube.

In one embodiment the bit comprises an exterior surface portion between a down hole end of the splines and the cutting face the exterior surface portion of progressively increasing radius from a location adjacent a down hole end of the splines toward the cutting face.

In one embodiment an outer surface of the bit comprises a substantially smooth continuous fluid flow surface extending from an up stream end of the shank to the cutting face, the substantially smooth continuous fluid flow surface comprising a plurality of channels that lie between respective adjacent splines and a contiguous exterior surface portion between a down hole end of the splines and the cutting face the exterior surface portion of progressively increasing radius from a location adjacent a down hole end of the splines toward the cutting face.

One aspect of an embodiment of the disclosed inner tube assembly is the provision of a seat on the outer circumferential surface that acts to self-centre a component, such as a check valve, of the associated DTH hammer. The self-centring effect is achieved by forming the seat to have a radial face that is inclined to form at an obtuse exterior angle with the outer circumferential surface.

A further idea behind the disclosed inner tube assembly is to provide a mechanism by which some of the fluid used for driving the DTH hammer can bypass the piston of the DTH hammer via the inner tube assembly. This assists in reducing the impact force on the drill bit. This is particularly useful when drilling in soft ground such as clay. The reason for this is that high impact forces have a tendency to compact soft ground and force it into inlet holes in the bit. This results in clogging of the bit. When this occurs drilling must temporarily cease and the DTH hammer flushed to remove blockages.

In a ninth aspect there is disclosed an inner tube assembly for a DTH hammer comprising:

a first tube having an outer circumferential surface; and a seat extending in a radial direction from the outer circumferential surface, the seat having a radial face at one end that is inclined to form an obtuse exterior angle with a longitudinal axis of the first tube.

In one embodiment the seat is capable of bending to increase the obtuse exterior angle in response to the application of a force in an axial direction on the face.

In one embodiment the seat comprises an abutment that disposed circumferentially about the outer circumferential surface, wherein the face is a radial face of the abutment.

In one embodiment the abutment extends continuously about the outer circumferential surface.

In one embodiment the seat comprises a band axially spaced from the abutment.

In one embodiment the band comprises a circumferential groove.

In one embodiment a face of the band at an end distant the radial face extends perpendicular the longitudinal axis of the first tube.

In one embodiment the first tube has a first portion on one side of the seat and a second portion on an opposite side of the seat wherein an outer diameter of the first portion is different to outer diameter of the second portion.

In one embodiment the inner tube assembly comprises a second tube and wherein a portion of the outer circumferential surface of the first tube and an inner circumferential surface of the second tube are relatively configured to create one or more fluid flow paths enabling a fluid to flow in an axial direction between the first and second tubes when second tube is disposed on the first tube and covers the portion the outer circumferential surface.

In one embodiment the fluid flow paths are at least in part formed by profiling or configuring the portion of the outer circumferential surface of the first tube so that the radius of the portion of the outer circumferential surface is not constant.

In one embodiment the fluid flow paths are at least in part formed by recesses or flats on the portion of the outer circumferential surface.

In one embodiment the fluid flow paths are at least in part formed by profiling or configuring the inner circumferential surface of the second tube so that the radius of the inner circumferential surface is not constant.

In one embodiment the fluid flow paths are at least in part formed by recesses or flats on the portion of the outer circumferential surface.

In one embodiment the fluid flow paths are created by providing the portion of the outer circumferential surface of the first tube and an inner circumferential surface of the second tube with different profiles.

In one embodiment the inner tube assembly comprises one or more access paths formed in the second tube enabling fluid from outside of the second tube to flow into the fluid flow paths.

In one embodiment the one or more access paths comprise holes formed near and inboard of one end of the second tube.

In one embodiment the one or more access paths comprise comprises a circumferential recess or groove formed on the inner circumferential surface of the second tube onto which an inner radial end of each of the holes open.

In one embodiment the one end of the second tube is locatable against the seat on a side distant the radial face.

In a tenth aspect there is disclosed an inner tube assembly for a DTH hammer comprising:

a first tube having an outer circumferential surface; and second tube locatable coaxial with and around a portion of the outer circumferential surface of the first tube, wherein the portion of the outer circumferential surface of the first tube and an inner circumferential surface of the second tube are relatively configured to create one or more fluid flow paths enabling a fluid to flow in an axial direction between the first and second tubes when second tube is disposed on the first tube and around the portion the outer circumferential surface.

In one embodiment the fluid flow paths are at least in part formed by profiling or configuring the portion of the outer circumferential surface of the first tube so that the radius of the portion of the outer circumferential surface is not constant.

In one embodiment the fluid flow paths are at least in part formed by recesses or flats on the portion of the outer circumferential surface.

In one embodiment the fluid flow paths are at least in part formed by profiling or configuring the inner circumferential surface of the second tube so that the radius of the inner circumferential surface is not constant.

In one embodiment the fluid flow paths are at least in part formed by recesses or flats on the portion of the outer circumferential surface.

In one embodiment the fluid flow paths are created by providing the portion of the outer circumferential surface of the first tube and an inner circumferential surface of the second tube with different profiles.

In one embodiment the inner tube assembly comprises one or more access paths formed in the second tube enabling fluid from outside of the second tube to flow into the fluid flow paths.

In one embodiment the one or more access paths comprise holes formed near and inboard of one end of the second tube.

In one embodiment the one or more access paths comprises a circumferential recess or groove formed on the inner circumferential surface of the second tube onto which an inner radial end of each of the holes open.

In an eleventh aspect there is disclosed a piston for a DTH hammer drill, the piston arranged to impact a drill bit of the hammer drill, the piston comprising:

a body having an axial passage and an outer circumferential surface provided with a maximum of three axially spaced apart circumferential porting bands.

In one embodiment the piston comprises a stop, wherein the porting bands comprise an upstream porting band, an intermediate porting band and a downstream porting band, and stop is located between the intermediate porting band and the downstream porting band, and wherein the downstream porting band has a constant outer circumferential surface for an entire axial length from the stop to a downstream end of the piston.

In an eleventh aspect there is disclosed A piston for a DTH hammer drill having an outer case and a drill bit supported by the outer case wherein the piston is capable of impacting the drill bit, the piston comprising: an outer circumferential surface configured to form a substantial fluid seal at maximum of three spaced axially spaced regions within an outer case of the hammer drill.

In one embodiment the piston comprises: a body having an axial passage and an outer circumferential surface provided with a maximum of three axially spaced apart circumferential porting bands respective bands at axially spaced locations, wherein respective bands are capable of forming a substantial seal at respective different sealing regions.

In one embodiment the porting bands comprise an upstream porting band, an intermediate porting band and a downstream porting band wherein the upstream band has an upstream edge adjacent an upstream end of the body and the downstream band has a downstream edge adjacent a downstream end of the body.

In one embodiment the piston comprises a stop located between the intermediate band and the downstream band and wherein the downstream band has a plain outer circumferential surface with a substantially constant outer diameter for an entire axial length from the stop to the downstream end of the piston.

In a twelfth aspect there is disclosed a porting system for a hammer drill having an outer case, a drill bit supported by the outer case and a fluid driven piston capable of reciprocating axially within the outer case and impacting the drill bit, the porting system comprising:

an outer surface of the piston; and an arrangement of surfaces configured to interact with the outer surface to provide a substantially uniform fluid pressure distribution on the outer surface such that the fluid pressure is able to hold the piston in a fixed axial position relative to the outer case when the hammer drill is in a blow down mode.

In one embodiment the fixed axial position coincides with a downhole most position of the piston in the hammer drill.

In one embodiment the outer circumferential surface comprises a maximum of three axially spaced apart circumferential porting bands, the bands being at axially spaced locations along the piston, wherein respective bands are capable of forming a substantial seal with the arrangement of surfaces at respective different sealing regions.

In one embodiment the porting bands comprise an upstream porting band, an intermediate porting band and a downstream porting band wherein the upstream band has an upstream edge adjacent an upstream end of the piston and the downstream band has a downstream edge adjacent a downstream end of the piston.

In one embodiment the porting system comprises a stop on the outer circumferential surface and located between the intermediate band and the downstream band, wherein the downstream band has a plain outer circumferential surface with a substantially constant outer diameter for an entire axial length from the stop to the downstream end of the piston.

In one embodiment the arrangement of surfaces comprises an inner circumferential surface of a porting sleeve disposed in the hammer drill and located such that an upstream end of the piston is maintained within the porting sleeve during operation of the hammer drill.

In one embodiment the arrangement of surfaces comprises an inner circumferential surface of a porting sleeve disposed in the hammer drill and located such that an upstream end of the piston is maintained within the porting sleeve during operation of the hammer drill, the porting sleeve having a plurality of openings inboard of a downstream end of the porting sleeve and wherein the inner circumferential surface of a porting sleeve has a first portion at the downstream end thereof with a first inner diameter and second portion upstream of the downstream portion with a second diameter being smaller than the first diameter and wherein the openings span the first and second portions; the upstream band of the piston and the second portion relatively configured to create between them an upstream sealing region when the second portion at least partially overlies the upstream band, the upstream sealing region substantially preventing fluid from passing through the openings and into an upstream end of the piston.

In one embodiment the first portion is configured relative to the outer circumferential surface to maintain a flow path that always remains open for all possible operational locations of the piston within the outer case wherein fluid is able to flow through the openings into an intermediate chamber located between the upstream band and the intermediate band.

In one embodiment the arrangement of surfaces comprises an inner circumferential surface of the outer case configured to form a with the intermediate band a bottom chamber seal when inner circumferential surface of the outer case at least partially overlies the intermediate band.

In a thirteenth aspect there is disclosed a hammer drill comprising:

an outer case;

a fluid driven piston capable of reciprocating axially within the outer case and impacting a bit drill bit retained at an end of the outer case, the piston having an upstream end, a downstream end and an intermediate porting band between the upstream end and the downstream end;

a top chamber located between the outer case and the upstream end of the piston, the top chamber arranged to receive fluid for driving the piston in the downstream direction; and a bottom chamber located downstream of the intermediate porting band and between the piston and the outer case;

wherein the top and bottom chambers are arranged to be in direct fluid communication with each other when the hammer drill is operated in a blow down mode.

In one embodiment the piston is configured to have:

a downstream surface area being a total of the surface area of the piston looking in a downstream direction that is not parallel to a central axis of the piston and is within and between the top and bottom chambers; and an upstream surface area being a total of the surface area of the piston looking in an a downstream direction that is not parallel to the central axis and is within and between the top and bottom chambers;

wherein the downstream surface area is greater than the upstream surface area.

In a fourteenth aspect there is disclosed a piston for a hammer drill, the piston arranged to impact a drill bit of the hammer drill, the piston comprising:

a body having an axial passage and an outer surface, the outer surface of the body configured so that when the body is subjected to a substantially uniform fluid pressure field so that a net force acting on the piston by action of the fluid pressure is directed toward the drill bit.

BRIEF DESCRIPTION OF THE DRAWINGS

Notwithstanding any other forms which may fall within the scope of the apparatuses, systems and devices as set forth in the Summary, specific embodiments will now be described, by way of example only, with reference to the accompanying drawings in which.

DETAILED DESCRIPTION OF SPECIFIC EMBODIMENTS

Figure 1:
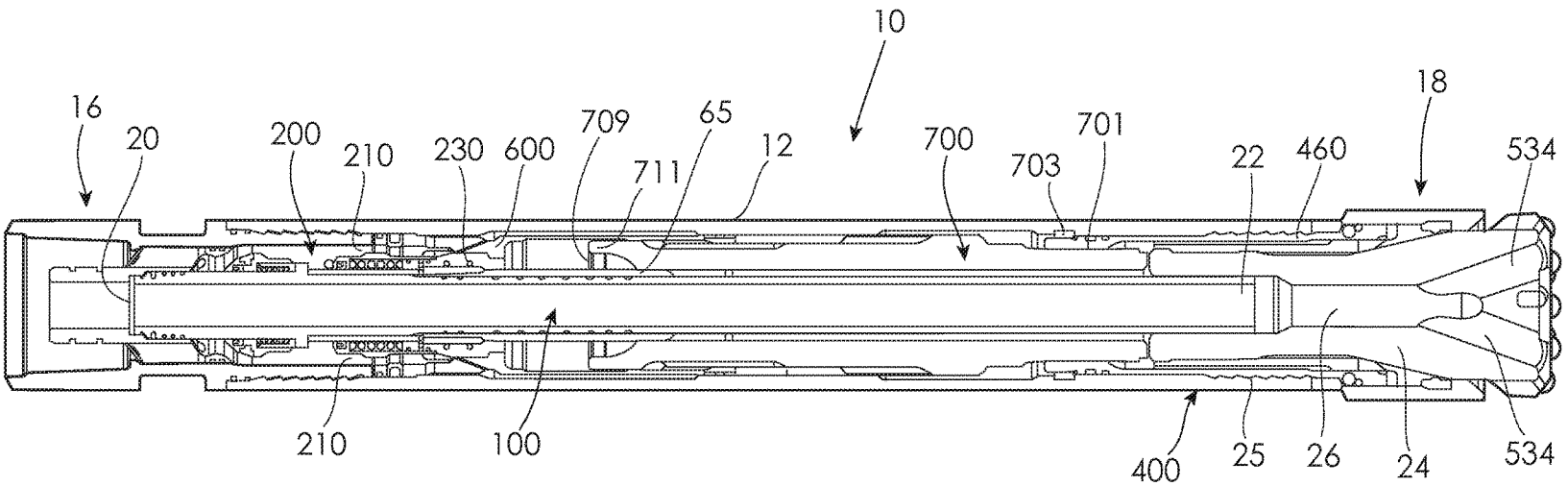
FIG. 1 is a schematic representation of one embodiment of the disclosed down the hole device in the form of a DTH hammer drill incorporating respective embodiments of the disclosed inner tube assembly, fluid flow control system, porting sleeve, bit retaining system lo and piston.

FIG. 1 shows in longitudinal section an embodiment of the disclosed DTH hammer 10. The specific embodiment of the DTH hammer is a reverse circulation (RC) hammer. However embodiments of the DTH device and the components and systems therefore are not limited to application in DTH RC hammers.

The hammer 10 incorporates embodiments of the disclosed: inner tube assembly 100; fluid flow control system 200; bit retaining system 400; porting sleeve 600; and piston 700. Each of the: inner tube assembly 100; fluid flow control system 200; bit retaining system 400; porting sleeve 600; and piston 700 in their own right provide benefit to the overall operation and/or reliability of the hammer 10. Also each of the inner tube assembly 100; fluid flow control system 200; bit retaining system 400; porting sleeve 600; and piston 700 may be incorporated individually (i.e. by themselves) in: a conventional DTH device/machine; or, fluid operated equipment to assist in the operation thereof. Greater operational and/or reliability benefits can be obtained by using two of more of these systems/devices, with the ultimate being having all of them as in the hammer 10 described hereinafter.

The hammer 10 has an outer case 12 with an up hole or upstream end 16 and a down hole or downstream end 18. The inner tube assembly 100 extends coaxially inside the outer case 12. The inner tube assembly 100 also has an up hole end 20 and an opposite down hole or downstream end 22. A hammer bit 24 is retained within the outer case 12 by the bit retaining system 400. The down hole end 22 of the inner tube assembly 100 extends into a central return passage 26 of the bit 24. The piston 700 is also housed within the outer case 12 and slides along the inner tube assembly 100.

Operating fluid such as air is delivered via a drill string (not shown) or other conduit which is coupled to the up hole end 16 of the outer case 12. This fluid passes through the fluid flow control system 200 to a porting arrangement which has the effect of reciprocating the piston 700 cyclically to the strike the drill bit 24. The impact force from the piston 700 is transferred via the drill bit 24 onto a toe of a hole being drilled. This fractures the toe of the hole. Hole cuttings/chips arising from this fracturing are carried up the return passage 26 and subsequently the inner tube assembly 100 via a return flow of the fluid (in this case air) which is used to drive the piston 700.

All of the fluid for driving the piston 700 and providing a vehicle for return of the chips and hole-cuttings through the inner tube assembly 100 must initially pass through the fluid flow control system 200. When the system 200 is used with the DTH hammer 10 this fluid is generally air and is supplied via compressors at the surface. Air is delivered at a pressure, (usually measured in pressure per square inch gauge "psig") and flow rate, (usually measured in cubic feet per minute "cfm") in accordance with the capacity of air compressors and/or boosters at the surface. (Commonly "flow rate" is simply referred to as "CFM". This convention will be used in the remainder of this specification.) Generally the compressors and/or boosters are operated at full capacity to provide maximum pressure and CFM to drive the DTH hammer 10. Pressure and energy losses will be experienced through the drill string prior to reaching the DTH hammer 10. These losses increase as the length of the drill string increases with increased depth of drilling. The pressure and CFM available to drive the DTH hammer 10 is controlled down the hole by the control system 200 which is immediately upstream of the piston 700.

Each of the main devices and systems incorporated in the hammer 10 will now be described.

Fluid Flow Control System 200

The fluid flow control system 200 (FIGS. 1-8) is arranged to facilitate control of fluid pressure available to the DTH hammer 10. As the control system 200 is part of the DTH hammer 10 it maintains a constant juxtaposition with the bit 24 irrespective of the length of the drill pipe. Thus the control system 200 enables the control of fluid pressure immediately adjacent to the upstream end of the piston 700 and associated work-chamber of the hammer 10.

The control system 200 is arranged to define or form a flow path annulus 210 through which air 202 supplied from an upstream end of an associated drill pipe flows in order to subsequently drive the DTH hammer 10. The flow path annulus 210 has an outer radius Ro and an inner radius Ri, (see FIG. 2). The width of the flow path annulus is hereafter referred to annulus width Aw=Ro−Ri.

In broad terms the control system 200 enables variation of the annulus width Aw by enabling a change of either one or both of the radius Ro and the radius Ri. In the particular embodiment to be described below the radius Ro is defined by an outer article in the form a ring 212. The ring 212 has an inner radius which forms the outer radius Ro of the flow path annulus 210. The ring 212 may be one of a plurality of interchangeable rings of different inner diameter which can be selected for a particular use and coupled to the DTH hammer 10 while at the surface. For example the ring 212 may be one of a set of rings each having the same outer radius but with their respective inner radius incrementing or changing by a predetermined amount for example, but not limited to: 0.25 mm: or 0.5 mm or 1.0 mm, from ring to ring.

The inner radius Ri of the flow path annulus is created by an outer circumferential surface 214 of an inner article in the form of a flow control body 216. Thus the flow control annulus 210 is defined by the ring 212 and the flow control body 216.

Figure 2:
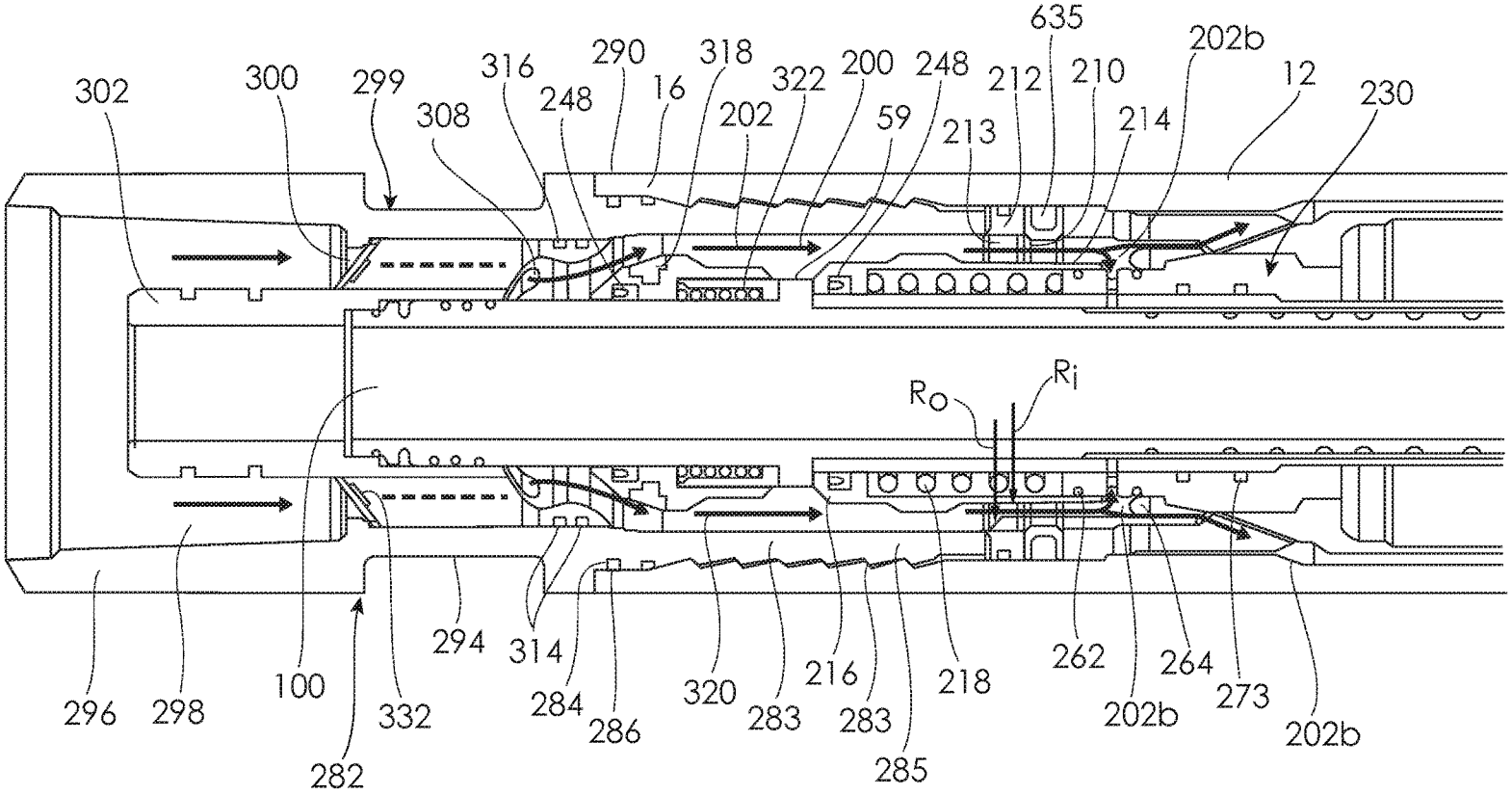
FIG. 2 is an enlarged view of the fluid flow control system shown in FIG. 1 and illustrating an associated flow control body in a first choke position.
Figure 3:
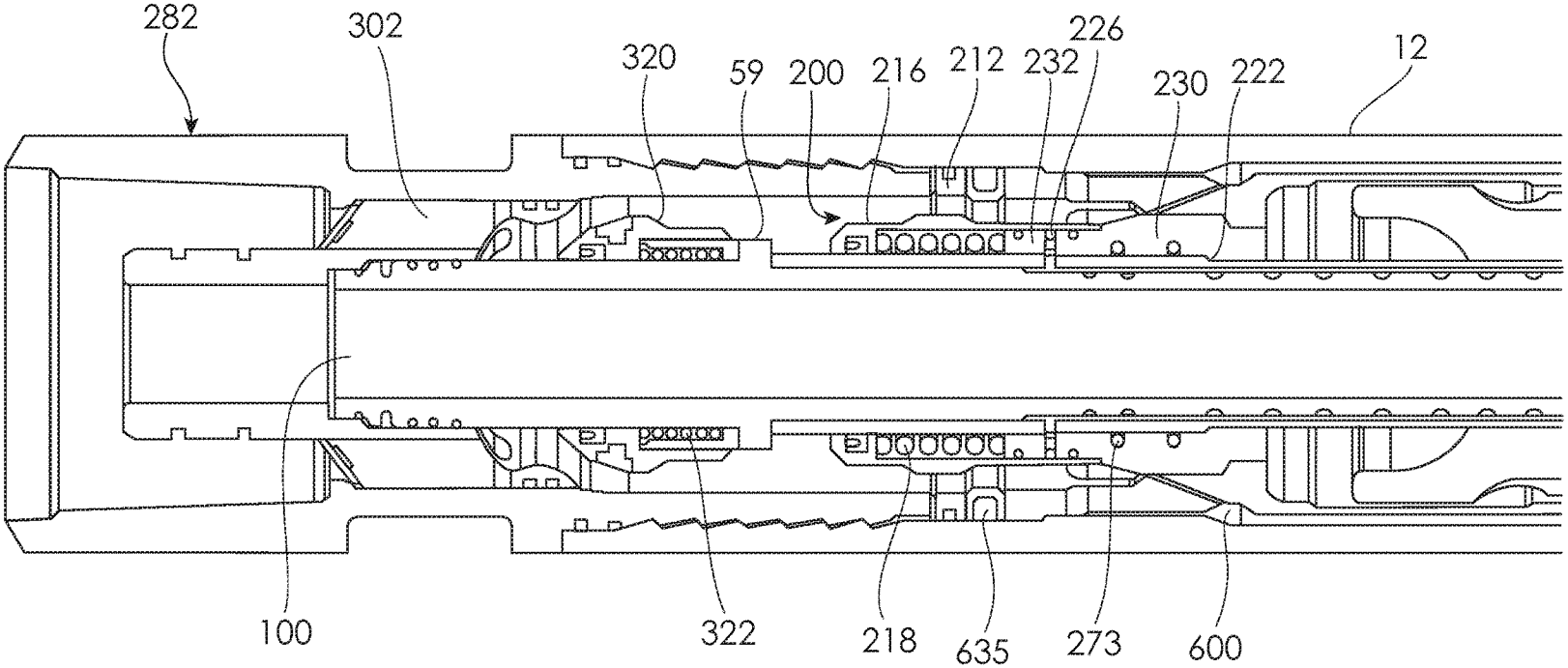
FIG. 3 is a view of the control system depicted in FIG. 2 but with the flow control body in a second choke position.

The flow control body 216 is movable between at least a first choke position shown in FIG. 2 and a second choke position shown in FIG. 3 to vary the inner radius Ri of the flow path annulus 210. As explained later this provides an automatic choke or airflow control feature of the control system 200.

Referring in particular to FIG. 2, it can be seen that the flow path annulus 210 is formed between an inner surface 213 of the outer article or ring 212; and the outer surface 214 of the inner article or flow control body 216. The flow path annulus 210 is formed in a diametric plane containing the ring 212.

In addition to the ring 212 and the flow control body 216, the fluid flow control system 200 also incorporates a bias mechanism in the form of a spring 218. The flow control body 216 is slidably mounted on the inner tube 10. The spring 218 encircles a portion of the inner tube assembly 100 and is retained within the flow control body 216. The spring 218 acts to bias the flow control body 216 in an upstream direction counter to the direction of flow of the air 202. However, the spring 218 also enables the flow control body 216 to move in a downstream direction in the event that the force supplied by the air 202 on the outer surface 214 of the flow control body 216 exceeds the force supplied by the spring 218 in the opposite direction.

When the force provided by the pressure of the air 202 acting on the outer surface 214 exceeds the force applied by the spring 218 on the flow control body 216 plus the force applied by air pressure downstream of the body 216, the flow control body 216 moves from the first choke position show in FIG. 2 to the second choke position shown in FIG. 3. Thus the flow control body 216 and the spring 218 form a pressure switch. Depending on the pressure differential across the flow control body 216, the flow control body will reside primarily in either the first or second choke positions. It is to be understood however that there will be transition period when the flow control body moves between the first and second choke positions in the event that a threshold pressure differential is crossed.

This position of the flow control body 216 is limited in the first choke position by the provision of a radial flange 59 on the inner tube assembly 100. When the differential pressure is exceeded then the flow control body 216 is forced to move or slide axially in a downstream direction compressing the spring 218 to the second choke position shown in FIG. 3. As is readily apparent from a comparison between FIGS. 2 and 3 in the second choke position the flow path annulus 210 has a reduced width Aw. This has the effect of choking or limiting the pressure of the fluid downstream of the flow path annulus 210.

The annulus width Aw and the threshold pressure differential can be varied by interchanging any one or more of: the ring 212; the flow control body 216; and, the spring 218 with like items of different physical characteristics. For example the flow path annulus 210 and more particularly the annulus radial width Aw can be varied by interchanging the ring 212 with another ring having a different inner radius Ro. Assuming that the flow control body 216 remains unchanged then changing the ring 212 with another ring having the same outer diameter but different inner diameter, will vary the annulus radial width Aw. Similarly changing the flow control body 216 with flow control bodies of different outer configuration will have a similar effect. Further, interchanging the spring 218 with springs of different spring constant will vary the differential pressure at which the flow control body 216 switches from the first choke position to the second choke position. This provides for great flexibility and tuning of the hammer 10 to operate at a desired efficiency and reliability level for a given set of ground conditions (e.g. hard ground soft ground, mixed ground) and compressor/booster availability and/or output.

FIGS. 2-5 also depict the provision of a bypass path 222. The existence of the bypass path 222 is dependent on what type of inner tube assembly 100 is used. FIGS. 2-5 depict a hammer 10 with a two piece inner tube assembly 100 which does facilitate the provision of a bypass path. (The two piece inner tube is described in greater detail later with reference to FIGS. 15-18.) However in an alternate embodiment the hammer 10 may be provided with a simple prior art one piece inner tube (not shown) which does not facilitate the provision of the bypass path 222.

A portion the air 202 can flow through the bypass path 222 downstream of the flow path annulus 210 in certain conditions. The portion that can flow through the bypass path 222 is denoted in FIG. 2 by arrow 202*b* and subsequent dots, with the remainder of the air for driving the piston 700 depicted by arrow 202*p*. In particular when the flow control body 216 is in the first choke position shown in FIG. 2 the bypass path 222 is open. Therefore the portion of air 202*b* can flow through the bypass path 222.

The bypass path 222 directs a portion of the driving fluid to exit the inner tube assembly 100 downstream to bypass a chamber in a head 711 of a piston 700. As a consequence only the remaining portion of the air 202*p* drives the piston 700. The air 202*b* exits the DTH hammer 10 between the outer surface of the bit 24 and the outer casing 8 and into the hole being drilled. The air 202*b* then re-joins the air 202*p* in the hole and flows back up the passage 26 and through the inner tube assembly 100 to carry cuttings and chips to the surface.

As shown in FIG. 3 the bypass entry ports 226 are closed by the flow control body 216 when in the second choke position. Consequently the bypass path 222 is also closed by the flow control body 216.

The entry ports 226 are formed as radial paths or holes in a housing 230 which is mounted on the inner tube assembly 100. The housing 230 has an upstream end 232 which forms a bearing surface for an inside surface of the body 216 to slide when moving between the first and second choke positions. It will be also noted that the spring 218 abuts the upstream end 232 and is retained between the end 232, the inner tube assembly 100 and the flow control body 216. Thus the spring 218 is by and large isolated from the flow of air 202. This provides benefits in terms of minimising or avoiding vibrations which can fatigue and/or otherwise damage the spring. The housing 230 is formed with a reduced outer diameter portion 233 (FIGS. 6 and 7) near the end 232. The reduced diameter portion 233 has an outer surface 235.

The flow control system 200 optionally includes a spacer 234. The spacer 234 is arranged to couple to the flow control body 216 to hold the flow control body 216 in the first choke position shown in FIG. 2 irrespective of the pressure of the fluid 202 or pressure differential across the body 216. As explained shortly the spacer 234 can be mounted in a first orientation or a second orientation. In the first orientation the spacer 234 is arranged to hold open the entry ports 226 and thus the bypass path 222 to divert a portion of the fluid 202. In a second orientation the spacer 234 covers and closes the entry ports 226 thereby closing the bypass path 222.

Figure 6:
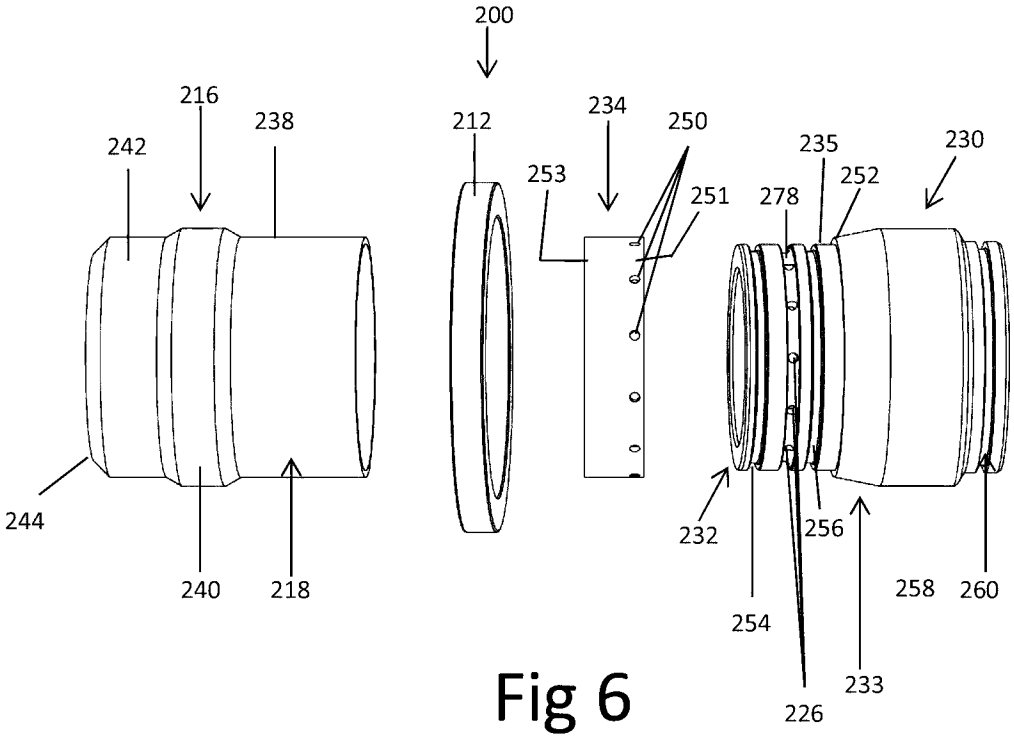
FIG. 6 is an enlarged side view of the flow control body and the spacer as well as a ring and housing incorporated in the fluid flow control system.
Figure 7:
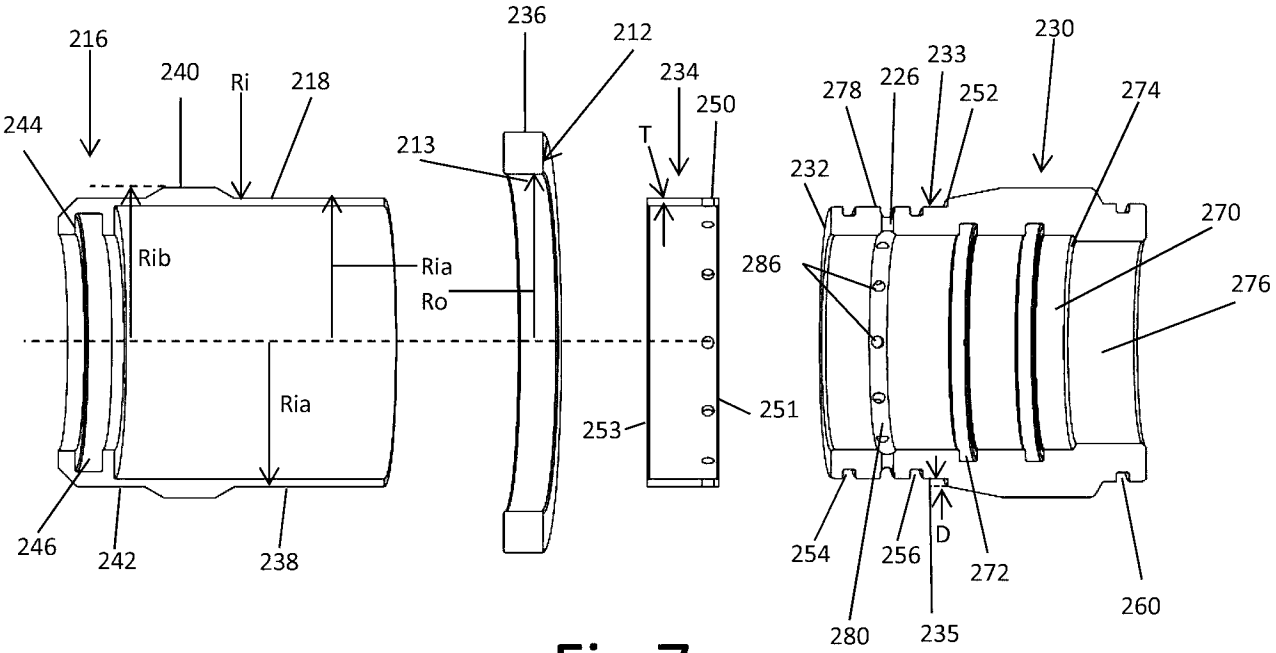
FIG. 7 is a longitudinal section view of the flow control body, ring, spacer and housing shown in FIG. 6.
Figure 8:
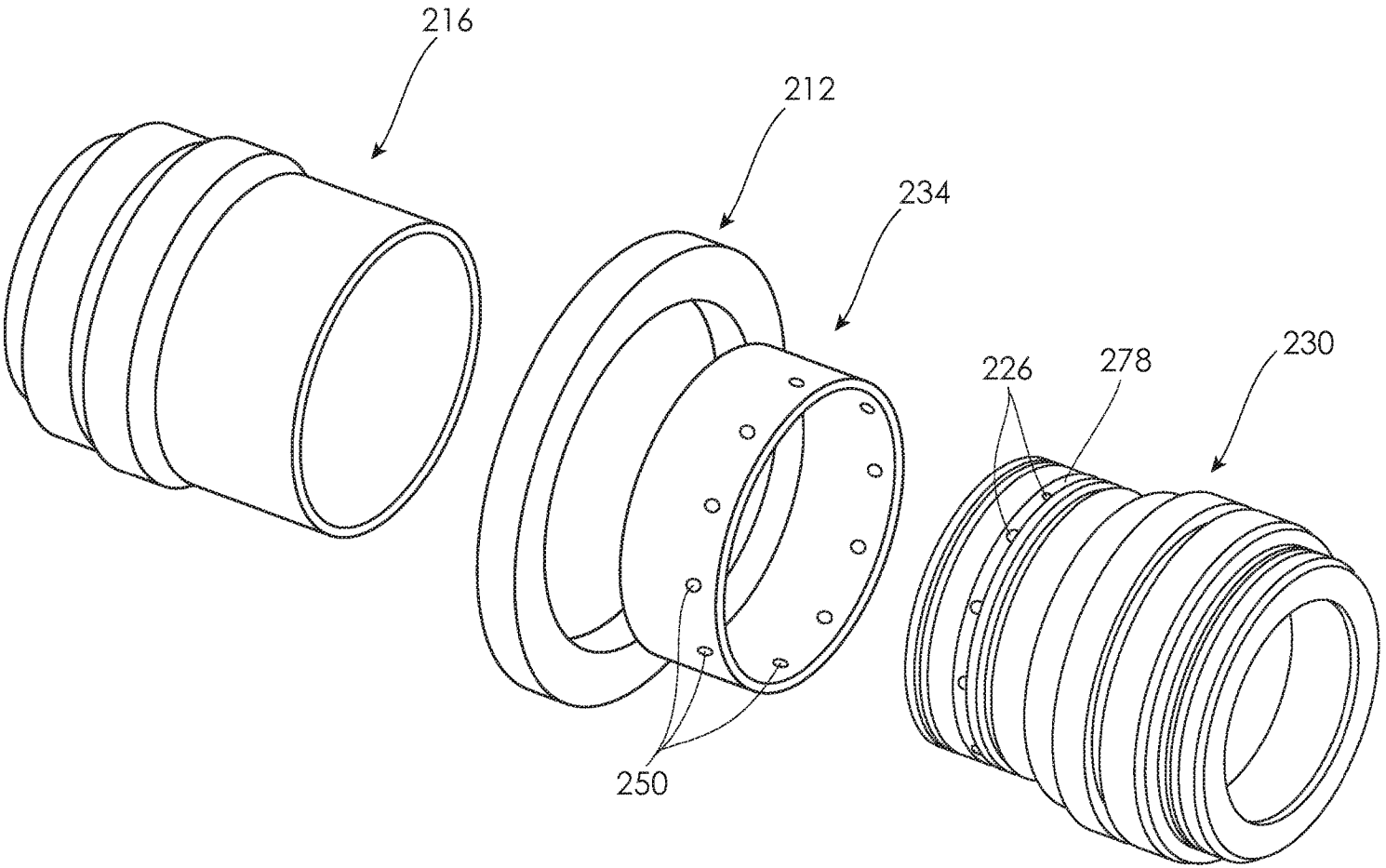
FIG. 8 is a perspective view of the flow control body ring, spacer and housing shown in FIGS. 6 and 7.

FIGS. 6-8 depict in greater detail various features of the control system 200 and the DTH hammer 10. From these Figures it can be seen that the ring 212 is a simple annular ring having inner surface 213 which forms the outer radius Ro of the flow path annulus 210. The ring 212 also has an outer circumferential surface 236 having a radius marginally less than the inner radius of the outer case 12. This enables the ring 212 to sit inside the outer case 12.

The flow control body 216 has a generally tubular form. The outer circumferential surface 218 of the body 216 forms the inner radius Ri of the flow path annulus 210. With particular reference to FIG. 8 the surface 218 is profiled so that the radius Ri varies at different axial locations along the body 216. For a downstream portion 238 the outer surface 218 has a constant radius shown as Ria. However intermediate of the axial length, the body 216 has a portion 240 of increased outer diameter. This results in an increase in the inner radius Rib of the flow path annulus 210 and consequently a reduced annulus width Aw. Moving further in the upstream direction the outer surface 218 has a portion 242 of constant outer diameter. The outer diameter of portion 242 may be the same as or different to that of the portion 238. There is a uniform and progressive transition in the outer diameter of the surface 218 from the portions 238 and 242 to the intermediate portion 240.

The body 216 is also provided with a tapered upstream end 244. On an inside surface of the end 244 the body 216 there is a circumferential groove 246 for seating an optional seal 248 (FIG. 2). The seal 248 when used provides a substantial fluid seal against the outer surface of the inner tube assembly 100.

The spacer 234 is in the form of a thin walled ring. The ring 234 is provided with a plurality of circumferentially spaced apart holes 250 which are closer to one end 251 and an opposite end 253. The spacer 234 has an inner radius arranged so as to seat on the portion 233 of the housing 230 with a minimal clearance or tolerance from the corresponding surface 235. Further, the spacer 234 has a material thickness T (FIG. 7) substantially equal to the depth D of a shoulder 252 which demarks the portion 233 from the remainder of the housing 230.

The housing 230 is formed with a plurality of outer circumferential grooves 254, 256, 258 and 260. The grooves 254-260 are arranged to retain respective O-ring seals 262, 264, 266 and 268 respectively. An inner circumferential surface 270 of the housing 230 is formed with an intermediate circumferential groove 272 for seating an O-ring seal 273. Downstream of the groove 272 the inner circumferential surface 270 is formed with a radial inward circumferential shoulder 274 leading to a band 276 of constant radius. On an upstream side of the groove 272 the housing 230 is formed with outer and inner circumferential grooves 278 and 280 respectively. The entry ports 226 extend in the radial direction and are located between the grooves 278 and 280.

Figure 5:
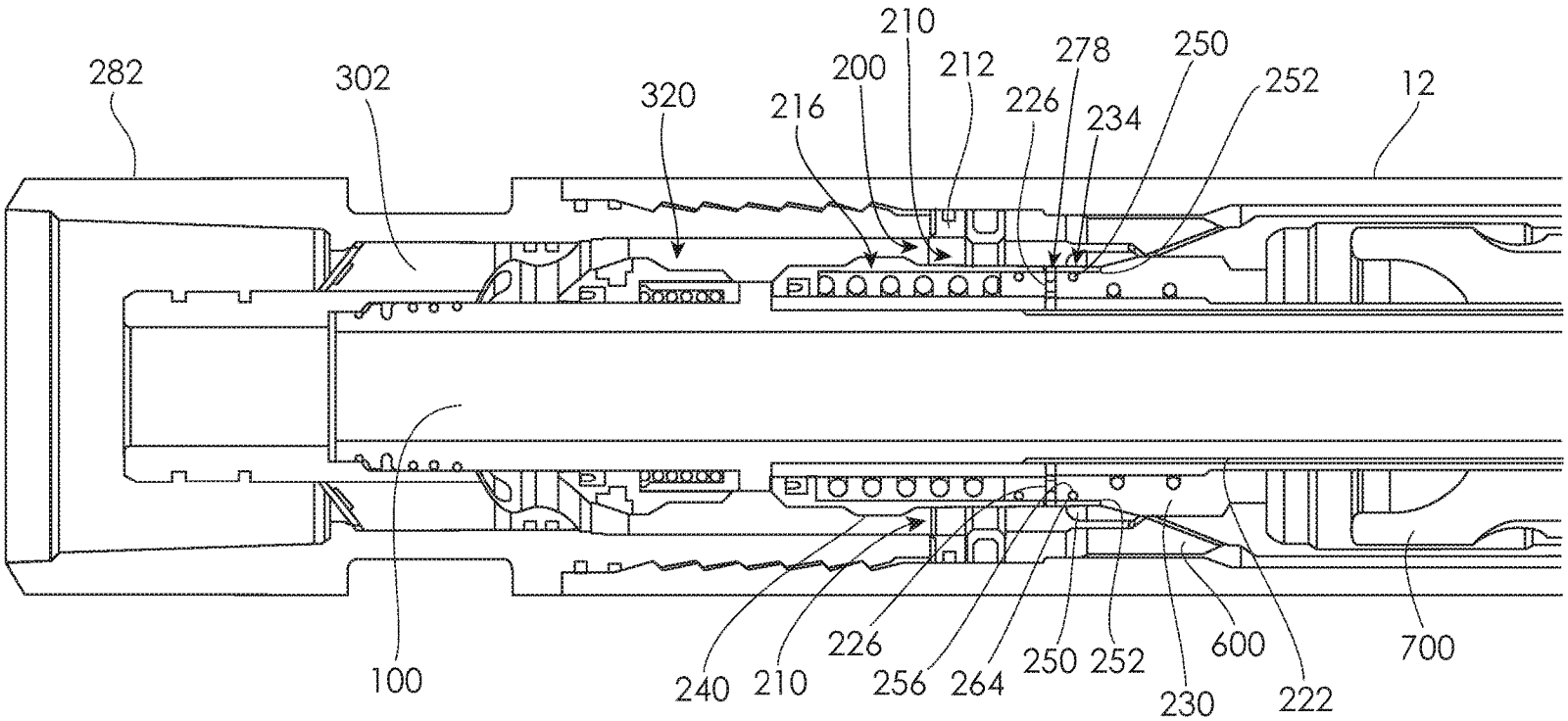
FIG. 5 is a representation of the fluid flow control system shown in FIG. 4 but with the associated spacer illustrated in a second orientation.

When the spacer 234 is used in the control system 200 in the orientation with end 251 closest to the shoulder 252, the holes 250 are offset from the groove 278. More particularly the holes 250 are located between the shoulder 252 and the groove 256 which contains the O-ring seal 264. Thus in this configuration the holes 250 are unable to provide fluid communication with the entry ports 226. This represents the second orientation described above of the spacer 234 in which the spacer 234 closes the bypass path 222. This configuration of the control system 200 is shown in FIG. 5.

Figure 4:
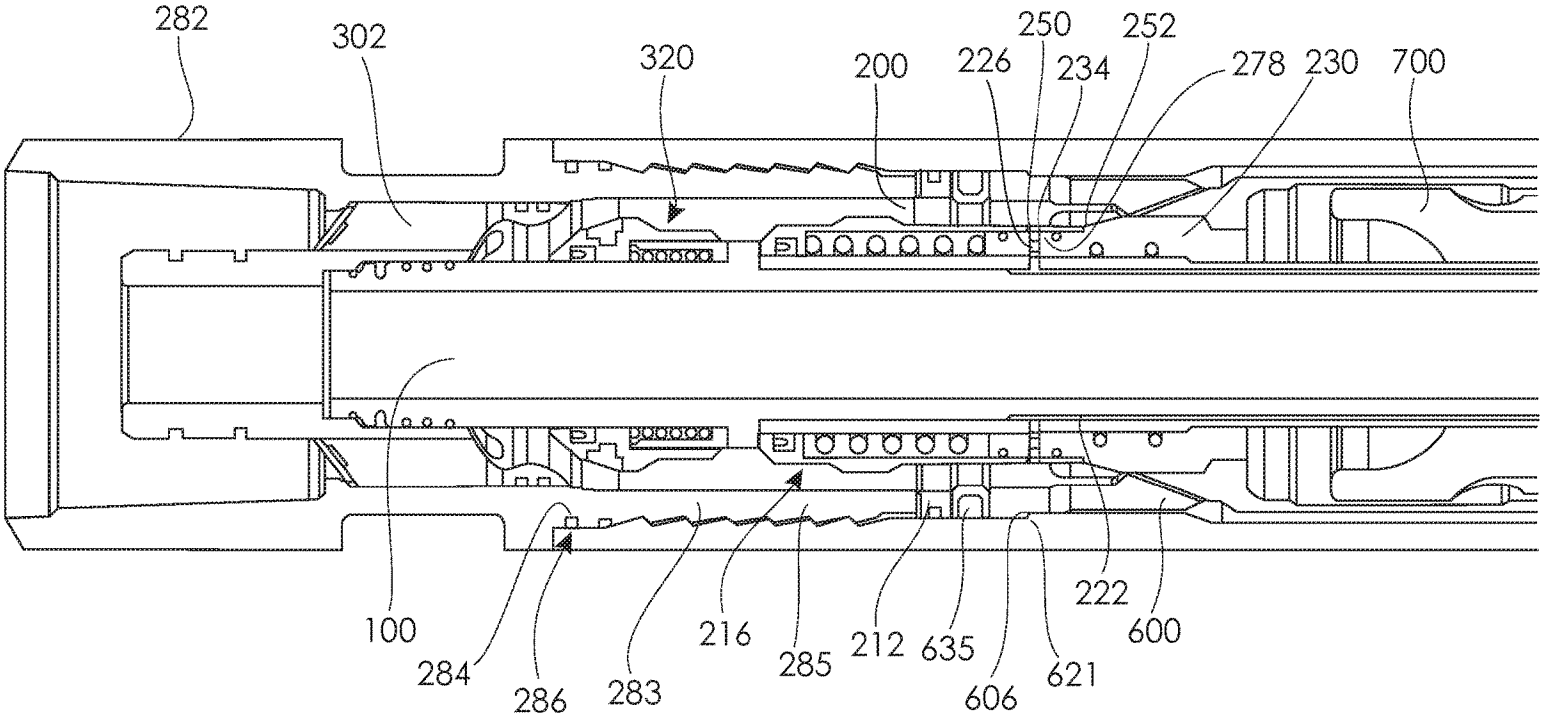
FIG. 4 is a representation of the fluid flow control system shown in FIGS. 1-3 but with the addition of an associated spacer and with the spacer in a first orientation.

However if the spacer 234 orientated so that end 253 is closest the shoulder 252 as shown in FIG. 4 the holes 250 will align with the groove 278. Accordingly air can pass through the holes 250 into the groove 278 and subsequently through the entry ports 226 to enter the bypass path 222. This represents the first orientation described above in which the spacer 234 opens the bypass path 222.

Figure 9:
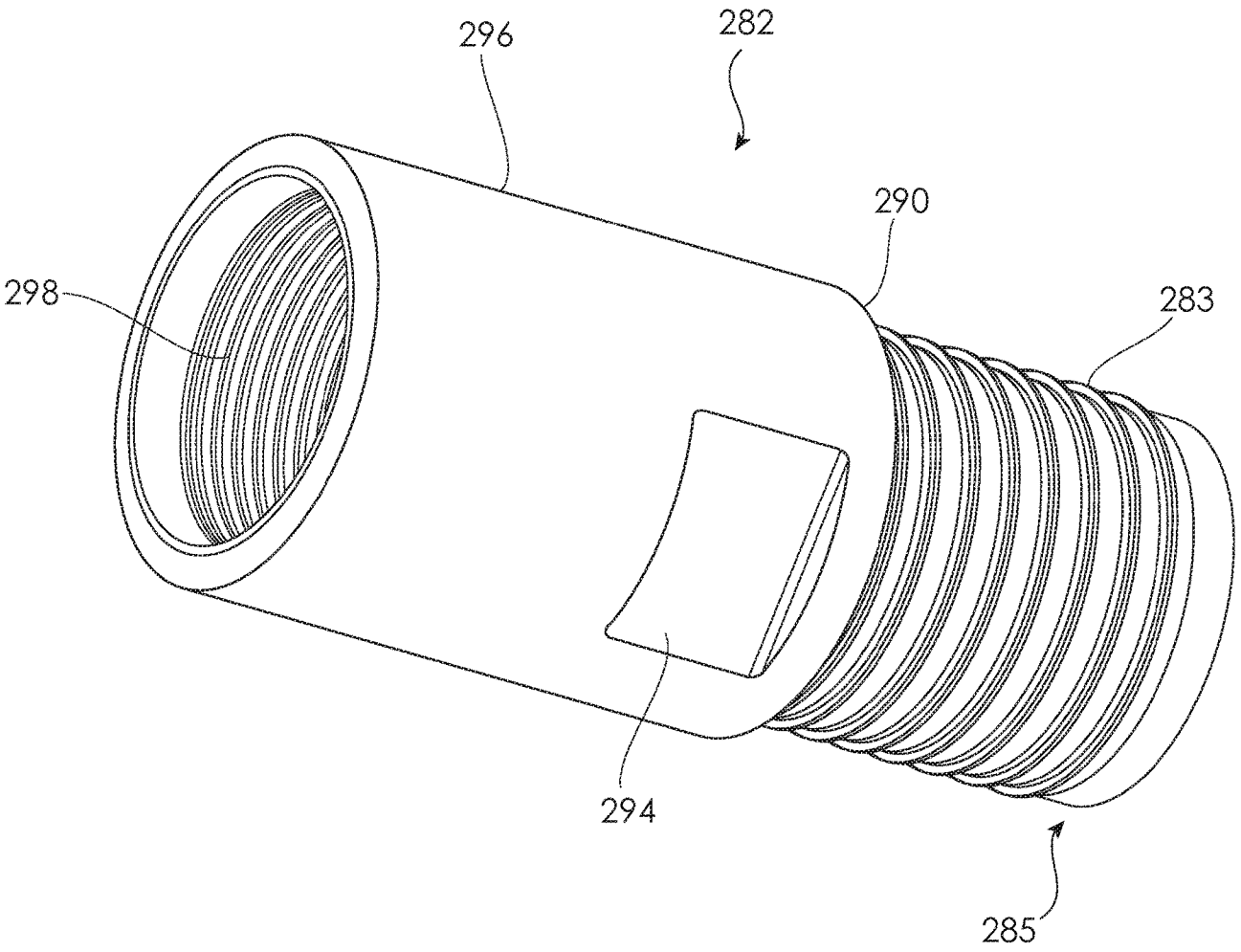
FIG. 9 is a perspective view of a sub incorporated in an embodiment of the control system and down the hole device.

The ring 212 is retained and held in place in the outer case 12 by a sub 282 (see in particular FIGS. 2 and 9). The sub 282 is of a generally tubular construction and has an external thread 283 at a downstream end 285. The thread 283 engages with a thread formed on an inner circumferential surface at the upstream end 16 of the outer case 12. As depicted in FIG. 2 an upstream end of the thread 283 is formed with a circumferential groove 284 which seats an O-ring seal 286. The seal 286 forms a substantial fluid seal between the sub 282 and the outer case 12.

Moving in an upstream direction the sub 282 is formed with a square shoulder 290 which forms an abutment surface for tightening of the sub 282 onto a radial end of the outer case 12. A pair of opposed flats 294 are machined or otherwise formed in the outer surface of the sub 282 upstream of the end shoulder 290. The flats 294 are provided to aid in gripping the sub 282 during tightening or breaking of the thread connection with the outer case 12. An upstream end 296 of the sub 282 is formed with an internal screw thread 298 for engaging with an end of an adjacent drill pipe (not shown). A circumferential shoulder 300 (FIG. 2) is formed on an inner circumferential surface of the sub 282 adjacent a downstream end of the thread 298 and extends in a radial inward direction.

Figure 10:
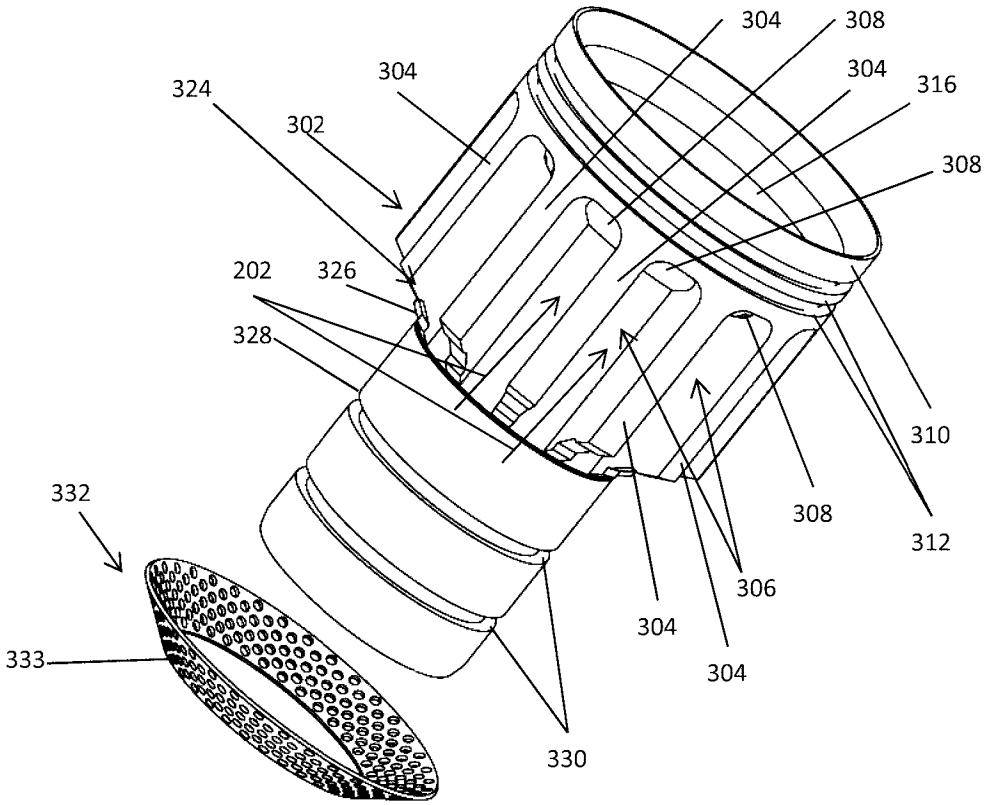
FIG. 10 is a perspective view of an adapter nozzle and filter screen associated with an embodiment of the down the hole device.
Figure 11:
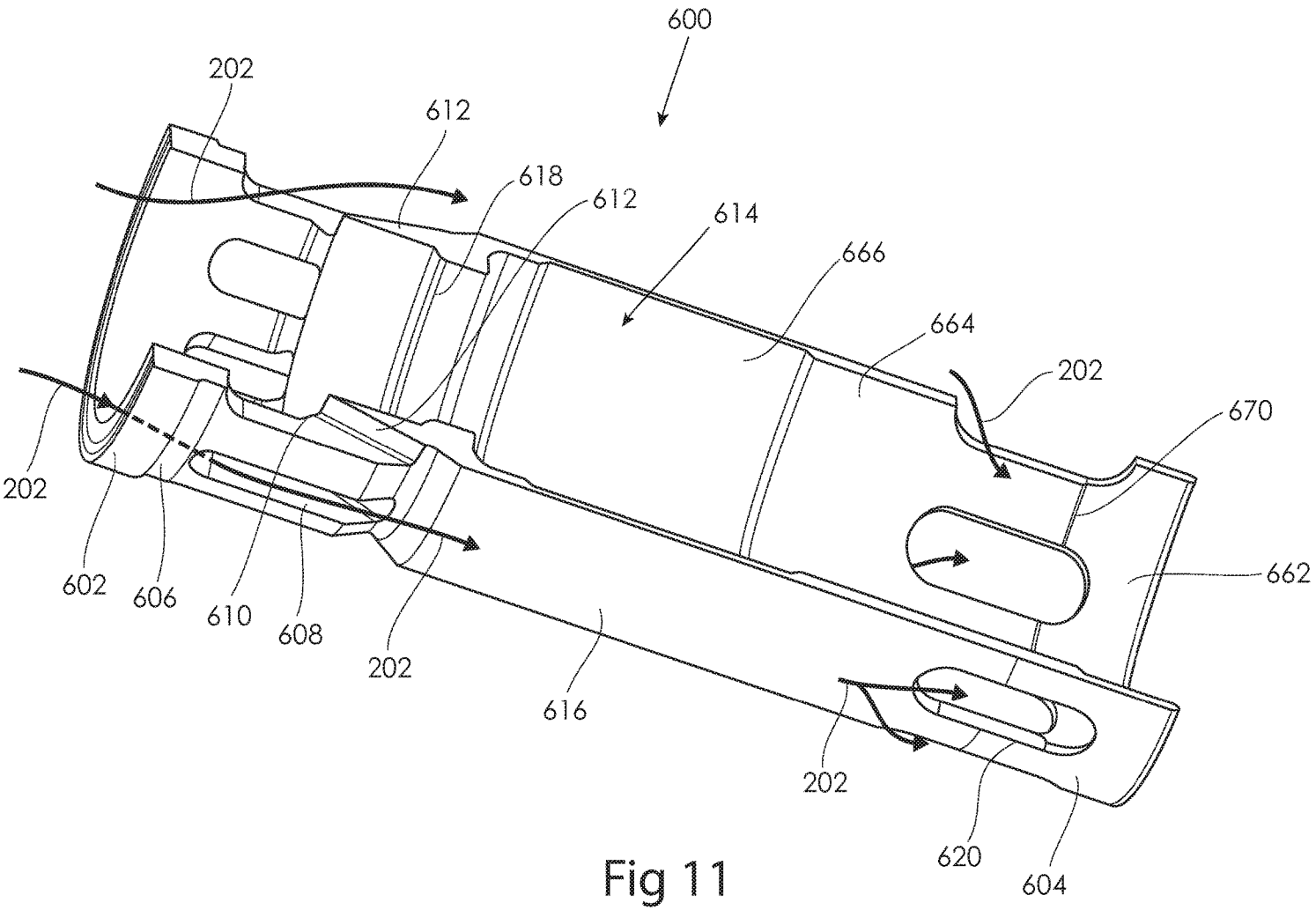
FIG. 11 is a section view of the porting sleeve shown in FIG. 1.
Figure 12:
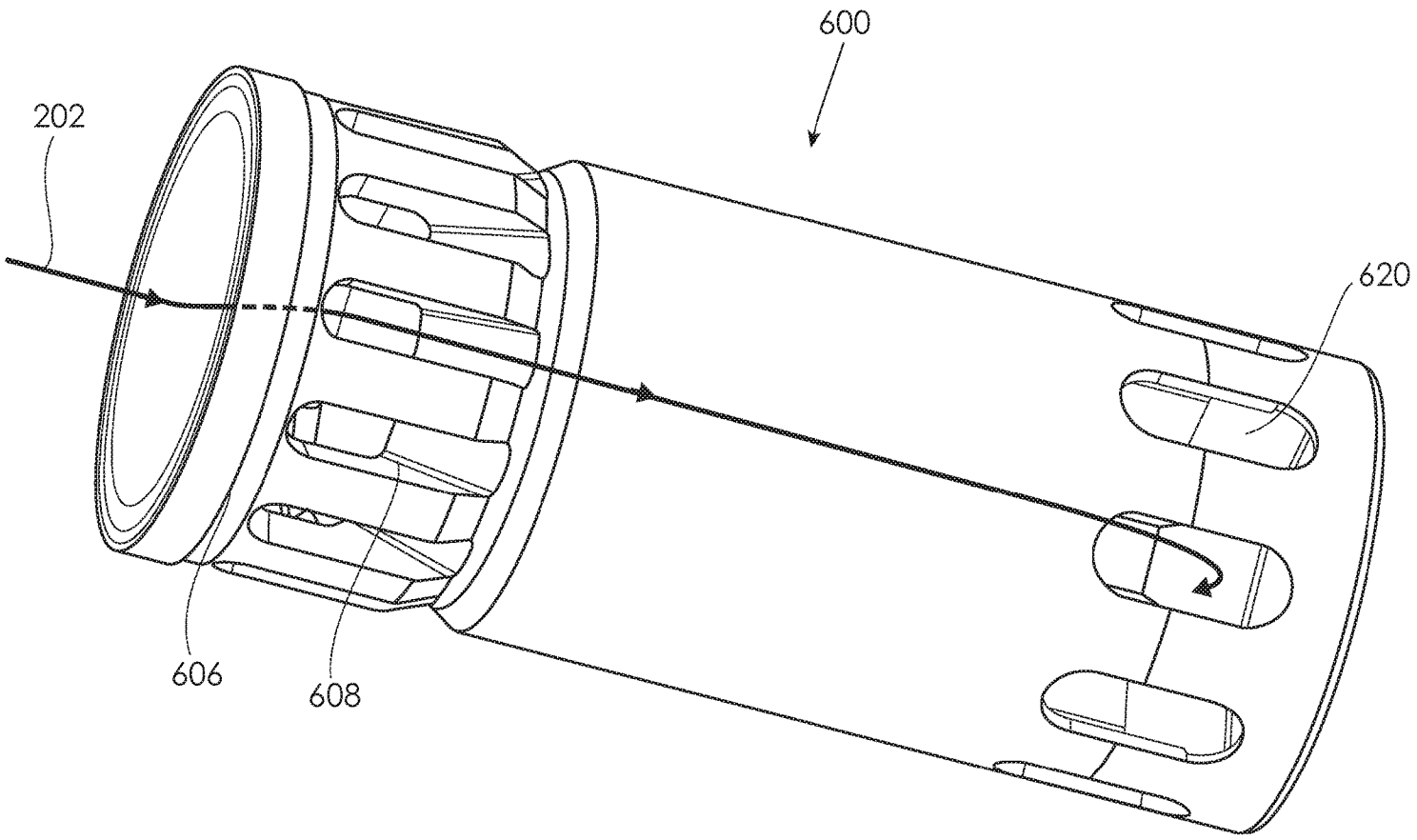
FIG. 12 is a perspective view of the porting sleeve shown in FIG. 1.

The sub 282 seats an adapter nozzle 302 (see in particular FIGS. 2 and 10). The adapter nozzle 302 abuts against the shoulder 300 and receives and itself seats the upstream end 16 of the inner tube assembly 100. A downstream portion of the adapter nozzle 302 is formed with a plurality of circumferentially spaced apart fins or walls 304. Mutually adjacent fins 304 define flow channels 306 for air delivered from compressors/boosters at a surface through the drill pipe connected to the sub 282. Each channel 306 leads to a hole 308. The holes 308 extend in the axial direction. Air 202 flows through the channels 306 between an outside of the adapter nozzle 302 and an inner circumferential surface of the sub 282 to the holes 308. The holes 308 are defined by or in a circumferential base 310 of the adapter nozzle 302. The base 310 is formed with a plurality of outer circumferential grooves 312 each of which seats a corresponding O-ring seal 314. The seals 314 form a substantial fluid seal between the base 310 and the inner circumferential surface of the sub 282. A portion 316 (FIG. 2) of the inner surface of the wall 310 is tapered to increase in radius in a downstream direction. The surface 316 forms an abutment surface for a complementary surface portion 318 of a check valve 320.

The check valve 320 operates to automatically close against the surface 316 to prevent a backflow of fluid in an upstream direction. The check valve 320 is slidably mounted on the inner tube assembly 100 upstream of the flow control body 216. The check valve 320 includes a relatively light spring 322 which is arranged to compress and allow the check valve 320 to slide in a downstream direction to abut the flange 59 with the smallest expected fluid pressure and CFM. In this regard the check valve 320 is designed to remain open whenever the DTH hammer 10 is in use.

Returning to FIG. 10, the free end 324 of each fin 304 is formed with an intermediate recess 326. Additionally, the surface of each free end 324 slopes toward the base 310 with increased radial distance away from a central axis of the adapter nozzle 302. An upstream end 328 of the nozzle 302 is of a generally tubular form and, in one possible configuration as per this embodiment, is provided with a pair of spaced apart circumferential grooves 330 for seating O-ring seals (not shown). However not all embodiments require the provision of such grooves and associated O-rings.

An air filter screen 332 fits over the end 328 and sits on the free ends 324 of the fins 304. The screen 332 is in the general shape of a frusto-conical shell and is formed with a plurality of holes 333. When the screen 332 sits on the free ends 324 the recesses 326 provide fluid flow paths for air flowing through the holes 333 that align with the recesses 326. This assists in minimising flow restrictions for the air used for driving the hammer 10.

Returning to FIGS. 2-4 the ability to control air pressure and in particular pressure drop and thus tune the DTH hammer 10 will be further explained. The ability to control the air pressure drop at the work chamber/piston 700 using the control system 200 resides in the ability to (a) interchange the ring 212 with other rings having a different inner radius therefore changing the outer radius Ro of the flow path annulus 210; (b) interchange the spring 218 with springs of different spring constant; (c) use or omit the spacer 234, and if used, install it in either the first or second orientations; and (d) interchange the flow control body with other flow bodies of different outer surface configuration, (although it is envisaged that in practise it will be simpler to interchange the ring 212 than the body 218 to vary the annulus width Aw.

The purpose here is to introduce a variable/tunable parasitic pressure drop at the point of the control system 200 to remove energy from the airflow and reduce the available pressure drop across the work chamber in the hammer drill. Embodiments of the control system enable a hammer drill to be designed with maximum efficiency and then detune by introducing controlled pressure drops/loss as required to suit the power input and ground conditions. The controlled pressure drop is effected at a down hole location immediately adjacent the work chamber/piston. This is in contrast with the prior art of building in fixed air flow inefficiencies and pressure losses in the hammer drill to provide protection for mechanical components then increase power input as required to meet an application at hand. Therefore in the prior art the solution is to increase drilling rate is to add more air mass flow by adding a second compressor. This doubles the mass flow and will provide a substantial increase in pressure across the work chamber/piston. This in turn, in some circumstances, can cause the hammer to fail.

With embodiments of the present control system 200 pressure drop across the work chamber can be determined prior to drilling and arranged for example by appropriate selection of the size (inner diameter) of the ring 212. But also an automatic down the hole pressure drop can be introduced by the control body 216 moving from the first choke position to the second choke positions if a predetermined excess pressure is introduced (for example by the adding of say a second compressor). The control system 200 also allows for the automatic pressure drop control to be disabled by the use of the spacer 234. Further when the control system is used with the inner tube 100 the spacer 234 orientation can be varied between one position with allows additional pressure drop by opening the bypass path 222.

Embodiments of the DTH hammer 10 also have superior air flow characteristics over prior art devices. In particular the hammer 10 has more streamlined air flow with changes or variations in air flow direction and larger air flow areas. For example in the hammer 10 there is no adapter sub between the outer case 12 and the sub 282. Therefore there is greater inner diameter in the vicinity of the check valve 320 and the control body 216 for air flow. Thus not only is the available air flow annulus larger but there are also less changes and smoother changes in air flow in the upstream end of the outer case 12.

Whilst the specific embodiment of the control system 200 have been in application within a reverse circulation hammer drill it can be applied to different types of down the hole devices such as a conventional hammer drill, or a fluid drive. The ring 212 which constitutes, at least in part, the flow path annulus 210 is illustrated and described as a separate component to the sub 282. However the sub 282 and the ring 212 may be formed as a single integral unit. This can be achieved by simply extending the length of the sub 282 and machining its down hole end to have a configuration similar to that of the ring 212 with the inner circumferential band thereof defining the radius Ro of the annulus width Aw.

Porting Sleeve 600

FIGS. 1 and 11-14 depict a porting sleeve 600. The porting sleeve 600 together with an inner circumferential surface of the outer casing 12 forms a porting arrangement directing the air 202 to the piston 700. The porting sleeve 600 is of a generally tubular form and has an upstream end 602 and a downstream end 604. Near but inboard of the upstream end 602 the porting sleeve 600 is provided with a shoulder 606 on its outer circumferential surface. Moving further in the downstream direction the sleeve 600 is provided with a plurality of openings 608. The openings 608 are equally spaced around the circumference of the sleeve 600. In this embodiment the openings 608 have a slot like shape and extend parallel to the axial direction. The slots 608 provide a passage for air 202 to flow from inside of the sleeve 600 to outside of the sleeve 600. A downstream end 610 of each opening 608 is configured to form a corresponding ramp 612 such that the thickness of the sleeve 600 increases in a downstream direction from an inner circumferential surface 614 to the outer circumferential surface 616. The ramps 612 assist in smoothing airflow and reducing turbulence as the air 202 flows from the inside to the outside of the sleeve 600 through the openings 608. A circumferential shoulder 618 is formed near the ramps 612 on the inner circumferential surface 614. The shoulder 618 projects in a radial inward direction and forms an abutment surface for the housing 230.

Moving further in the downstream direction the sleeve 600 is provided with a plurality of porting holes 620 which direct the air 202 to flow inside of the sleeve 600 from which it is able to drive the piston 700. A portion of the length of the sleeve 600 from a downstream end of the openings 608 to a downstream end of the ports 620 is in general radial alignment with a circumferential recess 622 (see FIG. 13) on the inner surface of the outer casing 12. This creates an annular gap 624 through which the air 202 can flow. Depending on the axial position of the piston 700 the air 202 flowing through the ports 620 can flow into longitudinal recesses 738 formed on an outer circumferential surface of the piston 700 to initially drive the piston 700 in a downstream direction. Alternately the air can flow into a well 709 formed in the head 711 of the piston 700. This is depicted by the phantom arrow 628. Thus, when the piston 700 is located so that the top of the head 711 is below an upstream end of the ports 620 the air 202 flows along the path 628 driving the piston 700 in the downhole direction to impact the bit 24.

Figure 44A:
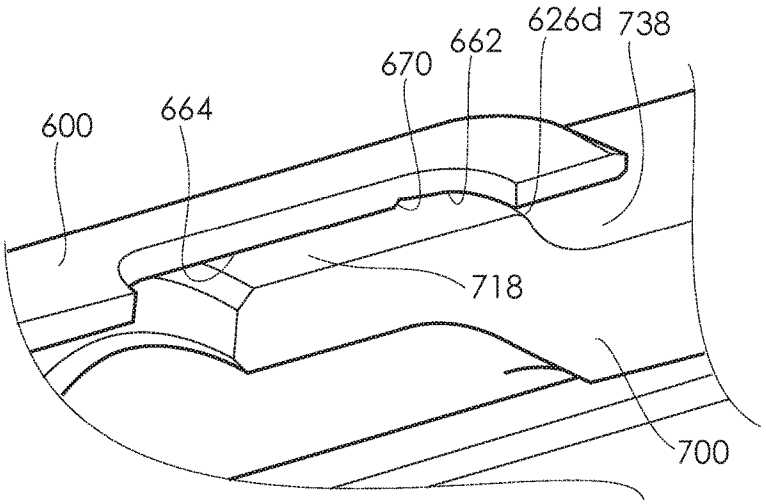
FIGS. 44*a* and 44*b* depict details of a porting arrangement incorporated in the disclosed DTH hammer drill.
Figure 44B:
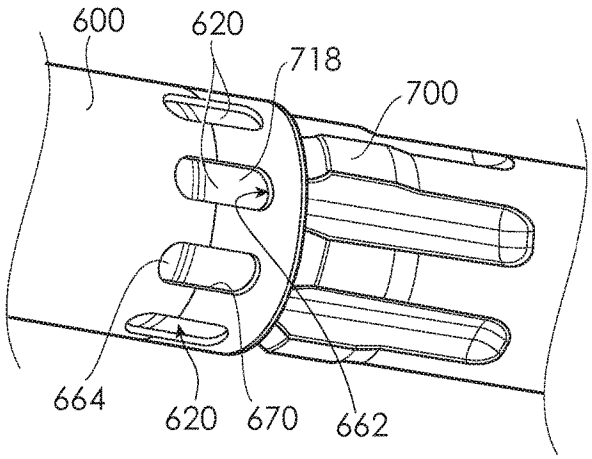

The inner circumferential surface 614 has a first portion 662 (FIGS. 11, 44*a* and 44*b*) at a downstream end with a first inner diameter and a contiguous upstream second portion 664 with a second smaller inner diameter. Upstream of the portion 664 the inner circumferential surface 614 has a third portion 666 with a third inner diameter. The third inner diameter is larger than the second inner diameter of the portion 664. The openings 620 extend from the second portion 664 into the first portion 662. An internal shoulder 670 is formed at the transition of diameters between the first portion 662 and the second portion 664.

Figure 13:
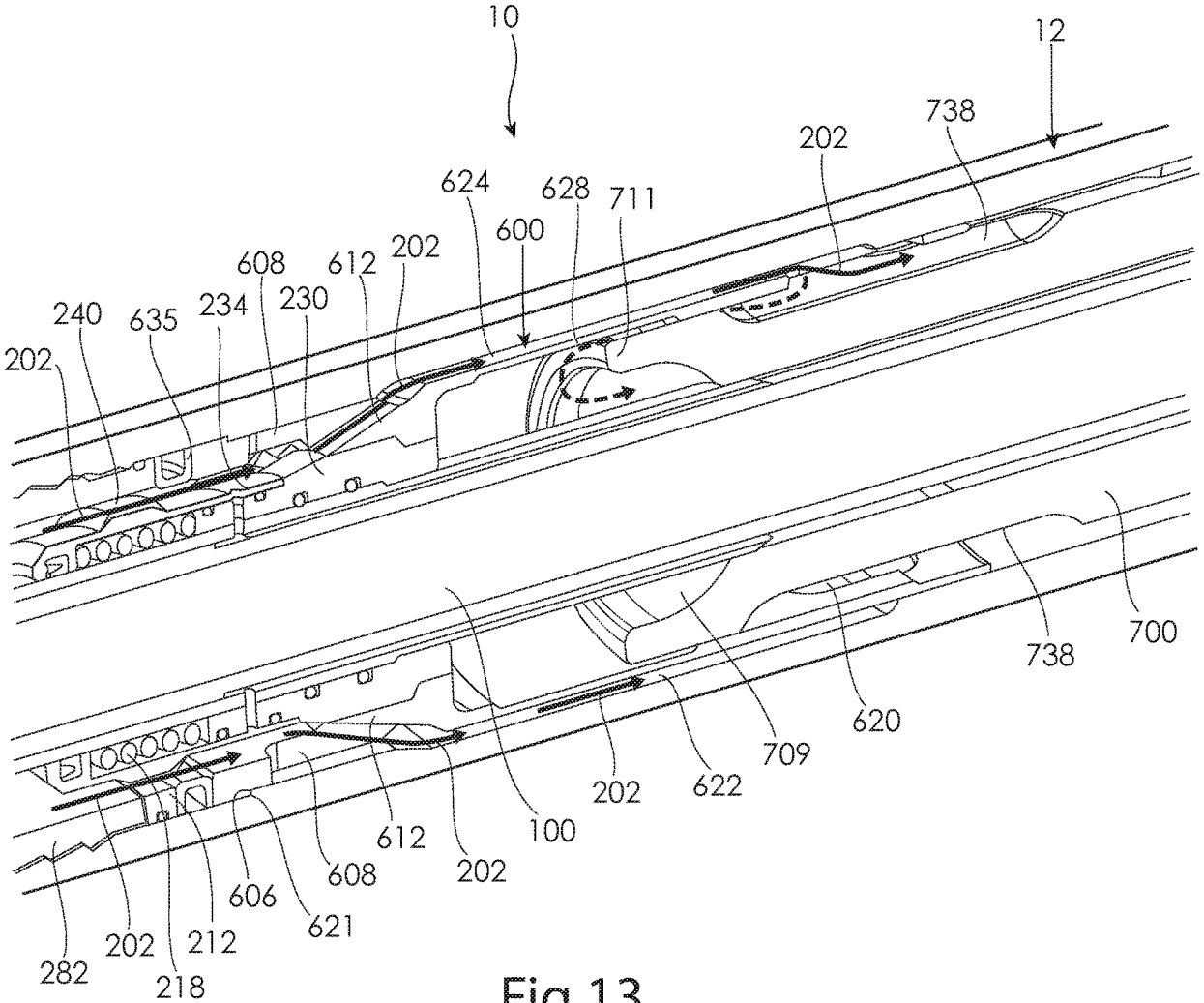
FIG. 13 is a cut away and enlarged view of a portion of the fluid flow control system, inner tube assembly, porting sleeve and piston in the DHT device illustrating air flow paths in one mode of operation.
Figure 14:
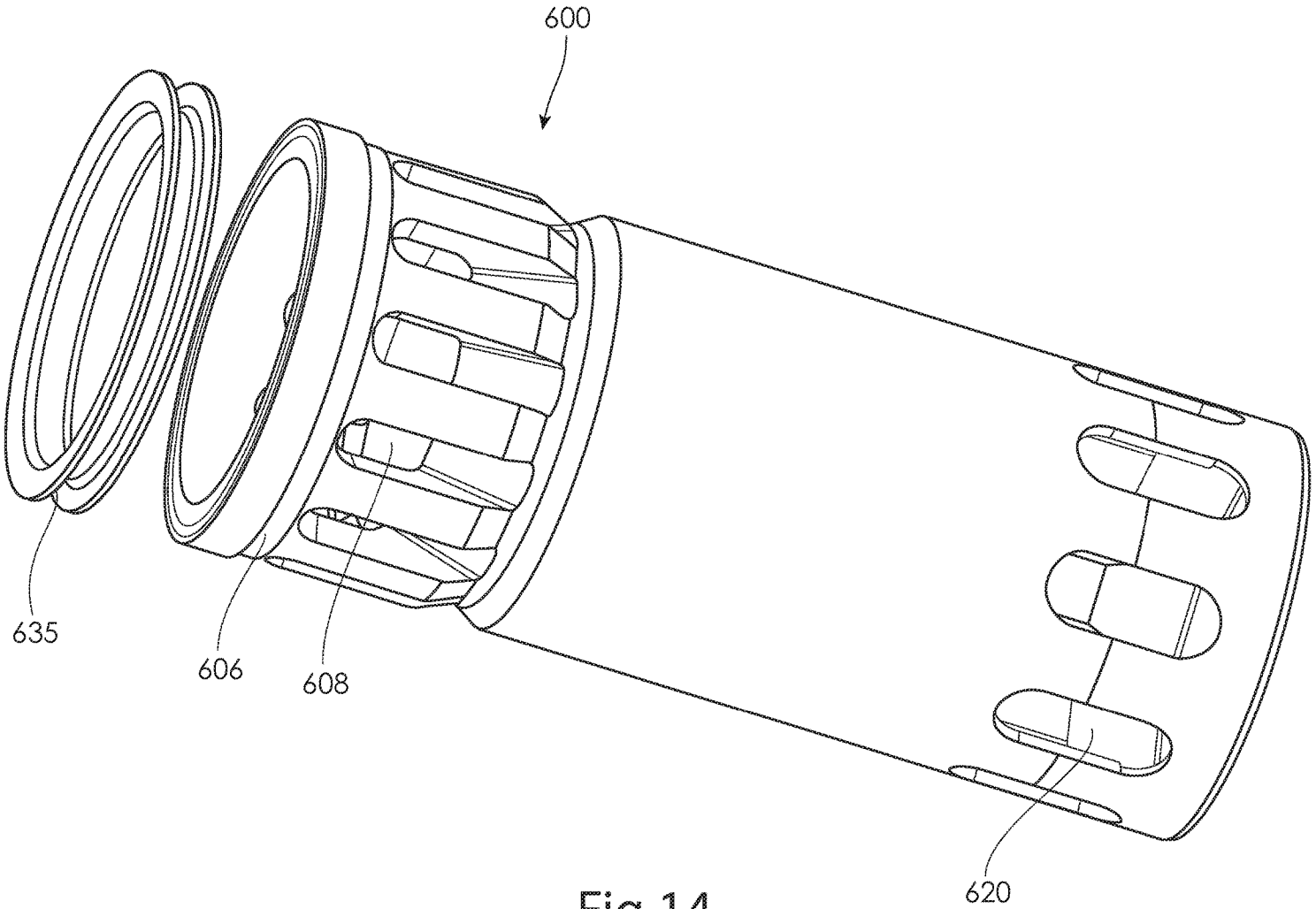
FIG. 14 is a perspective and partly exploded view of the porting sleeve, an associated retaining ring and sealing ring incorporated in the disclosed down the hole device.
Figure 15:
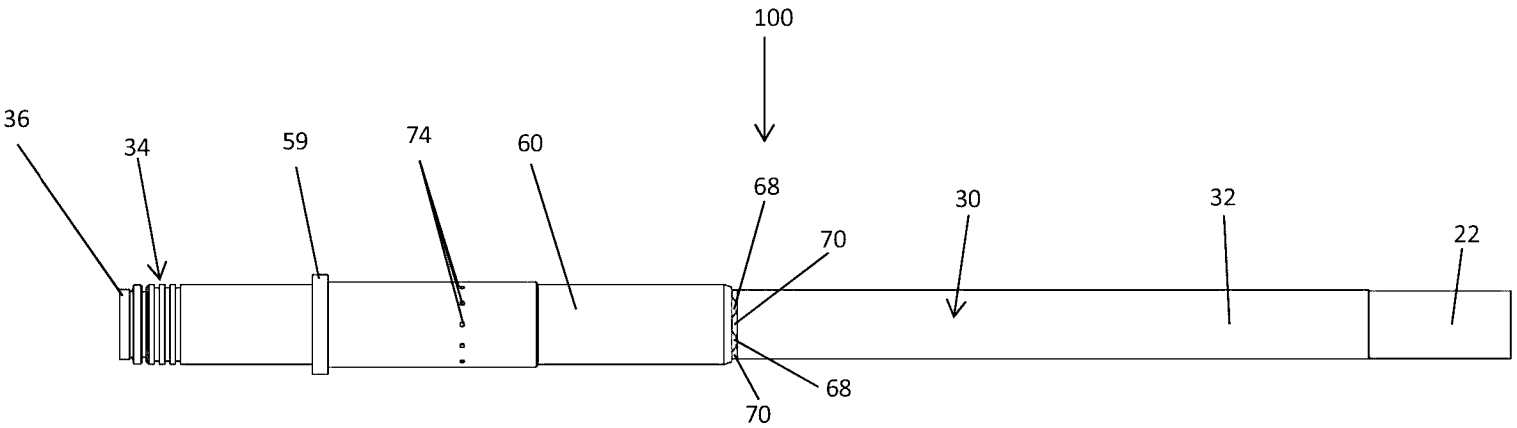
FIG. 15 is a side view of the inner tube assembly incorporated in an embodiment of the down the hole device shown in FIG. 1.
Figure 16:
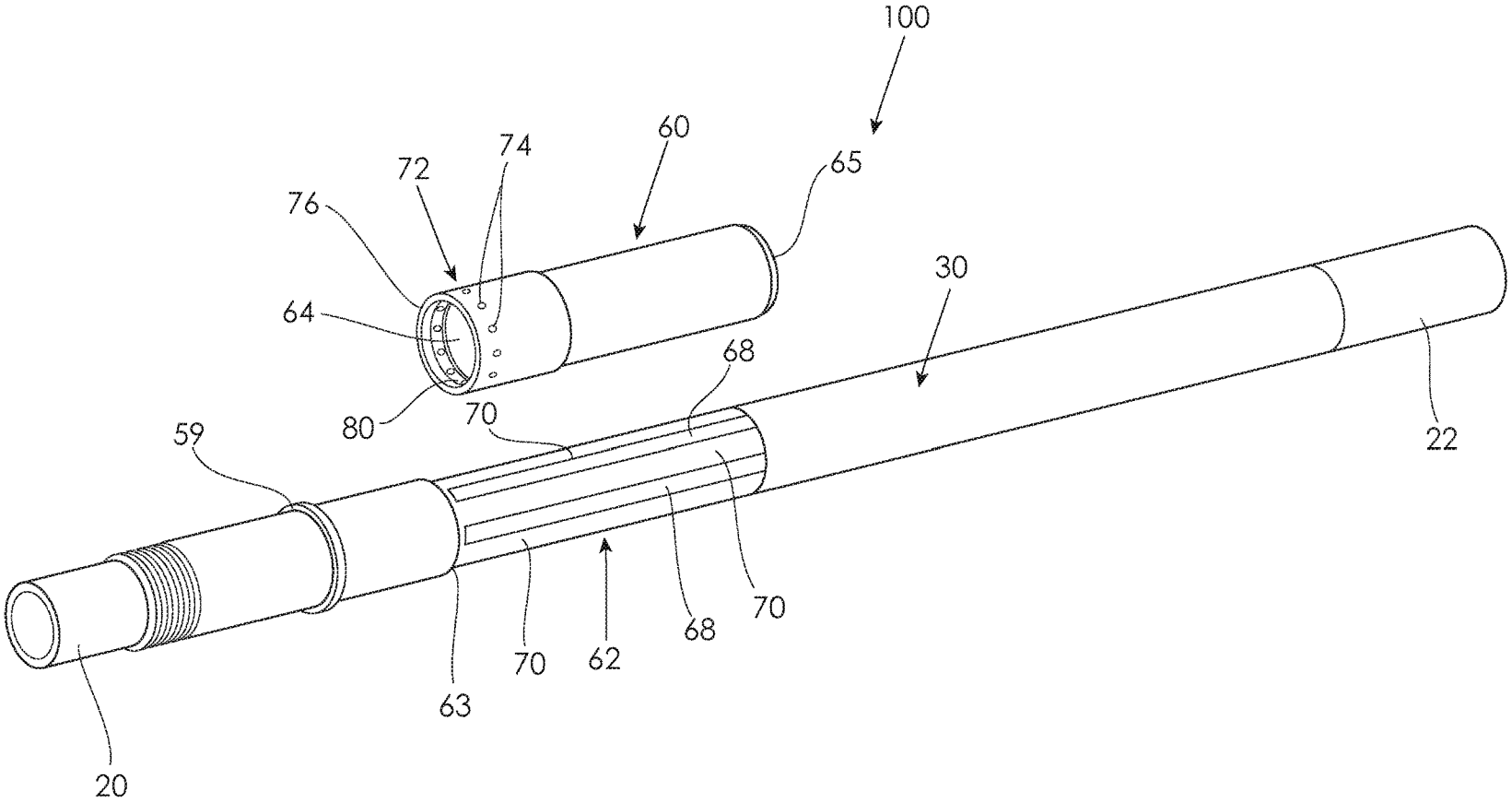
FIG. 16 is a perspective view of the inner tube assembly of FIG. 15 but illustrated in a disassembled state.
Figure 17:
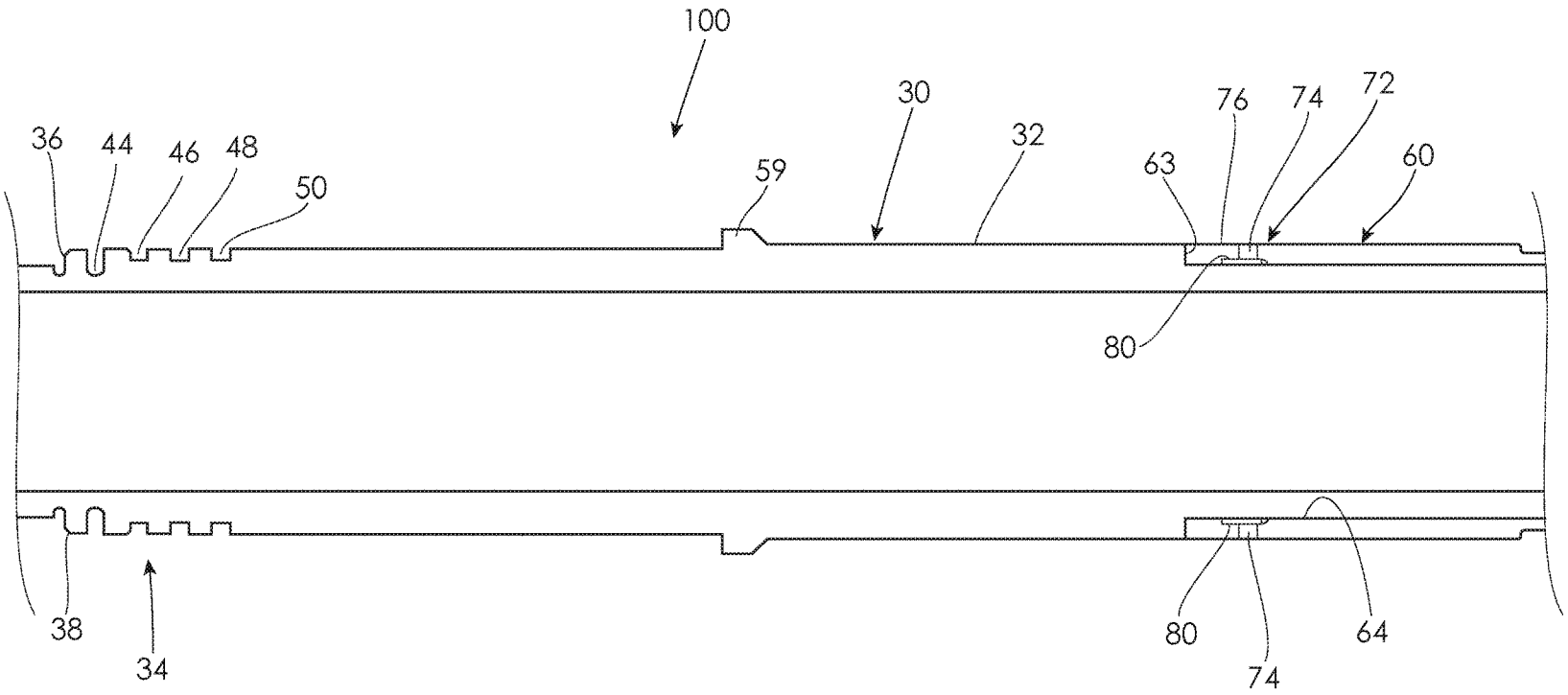
FIG. 17 is an enlarged section view of a portion of the inner tube assembly depicted in FIG. 15.
Figure 18:
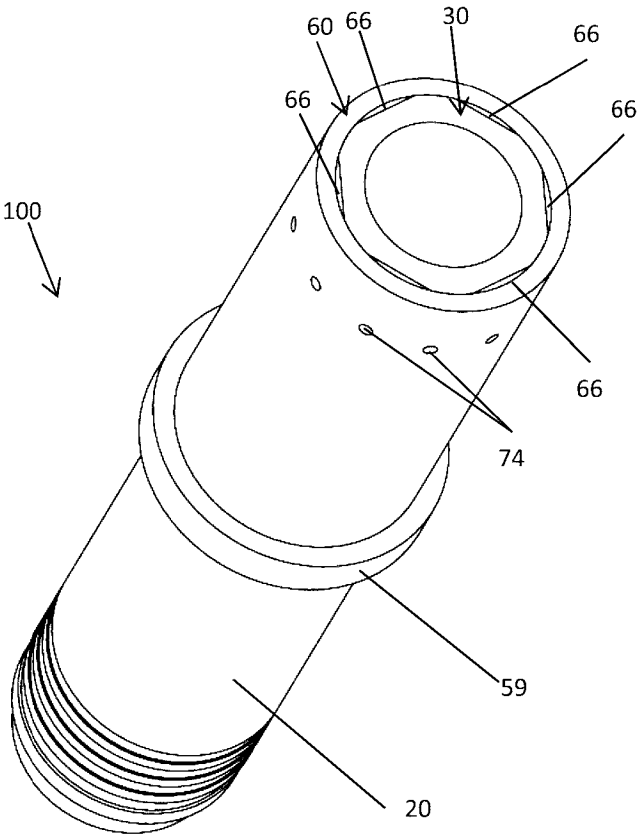
FIG. 18 is a transverse section view of the inner tube assembly shown in FIG. 15.

With reference with FIG. 13 the sleeve 600 is retained within the outer case 12 by: engagement of the shoulder 606 with a circumferential step 621 formed in the inner surface of the outer case 12; and the sub 282. A space between the sub 282 and the sleeve 600 is packed with the ring 212 and a spring steel ring 635.

The sleeve 600 provides enhanced air flow efficiency in comparison to conventional sleeves used in RC hammer drills. In this regard prior art sleeves are provided with a circumferential ring at their upstream end provided with a plurality of axially extending ports to direct air to flow from an internal surface at the upstream end of the sleeve to the outer circumferential surface of the sleeve. This row of ports in the prior art sleeves has been removed with the sleeve 600 and replaced the annular gap 624 between the sleeve 600 and outer case 12 to provide a larger and straighter flow path for the air. The sleeve 600 is relatively short in length (in comparison with a port sleeve with an integral top sub) and has only a relatively small annular area for its diameter. This results in the sleeve 600 being easy to make from hollow bar which can accommodate the piston 700. This avoids the need to machine the sleeve 600 from a solid bar. Further, the sleeve 600 is relatively cheap to manufacture and easy to replace. As a consequence it can be replaced with the piston if required or desired to restore hammer performance.

Inner Tube Assembly 100

The control system 200 and indeed the DTH hammer 10 may be used in conjunction with either a single piece inner tube or a multi piece inner tube assembly 100. When a single er 606 with a piece inner tube is used the bypass path 222 does not exist. In such an instance all of the air 202 which passes through the flow path annulus 210 passes through the gap circumferential step 624 and is available for driving the piston 700. Notwithstanding that the single piece inner tube has no bypass path 222; the spacer 234 can still be used with a one piece inner tube in the event that it is desirable to always hold the flow control body 216 in the first choke position. Thus in this instance the spacer 234 holds the flow control body 216 in the first choke position irrespective of pressure differential thereby maintaining a constant annulus width Aw. In such circumstances, it is not necessary for the spacer 234 to be provided with the holes 250.

The multi piece inner tube assembly 100 depicted in FIGS. 2-5 and 15-18 can also be used without any modification to the control system 200 and the DTH hammer 10. The inner tube assembly 100 has a first tube 30 having an outer circumferential surface 32. A seat 34 (see in particular FIG. 17) extends in a radial direction from the outer circumferential surface 32. The seat 34 is located intermediate of the opposite ends of the first tube 30. The seat 34 has a radial face 36 facing the upstream end 20. The radial face 36 has an inclined or bevelled surface 38 which slopes toward the downstream when looking in a radial outward direction.

The inclination of the surface 38 provides a self-centring function for the adapter nozzle 302. A circumferential groove or recess 44 is formed in the seat 34 near the radial face 36. The recess 44 enables the seat 34 to bend toward the downstream end 22 of the inner tube assembly 100 in response to the application of a force in the down-hole transferred by the nozzle 302 when the sub 282 is connected to the case 12 and fully tightened with all of the operating parts present a drill string and inner conduit.

A series of axially spaced apart circumferential grooves 46, 48 and 50 is formed in the tube 30 on a downstream side of the face 36. The grooves 46, 48 and 50 receive respective O-ring seals (not shown) which form a fluid seal against an inside surface of the adapter nozzle 302.

Inner tube assembly 100 also includes a second tube 60. The second tube 60 is shorter in length than the first tube 30. The second tube 60 is configured so that it is locatable co-axially with the first tube 30 and overlies a portion 62 of the outer circumferential surface 32. When the inner tube assembly 100 is installed within a DTH hammer 10 the second tube 60 abuts a circumferential shoulder 63 at an upstream end of the portion 62. An opposite end of the second tube 60 is tapered to form a circumferential shoulder 65 which transitions from the outer diameter of the second tube 60 to the outer diameter of the first tube 30. The flange 59 is located between the seat 34 and the shoulder 63.

An inner circumferential surface 64 of the second tube 60 and the portion 62 of the inner circumferential surface of the first tube 30 are relatively configured or arranged so as to create the bypass path 222 enabling operating fluid to flow in an axial direction between the first and second tubes 30 and 60. In particular the bypass path 222 is formed as a plurality of axial channels or gaps 66 between the tubes 30 and 60.

As previously described and shown in FIG. 2 incoming fluid 202 can be split to a stream 202*p* which flows to the top of the piston 700 providing impact force for the drill bit 24; and, stream 202*b* that flows through the bypass path 222 created by the channels 66. The air that flows through the bypass path 222/channels 66 does not contribute to the impact force of the piston 700. Therefor when air flows through the bypass path 222 the impact force provided by the piston 700 is reduced. This can assist when drilling in soft ground for example ground comprising a significant proportion of clay.

In this embodiment the channels 66 are formed by profiling or otherwise configuring the portion 62 of the outer surface 32 of the first tube 30. The profiling results in variation of the outer radius of the portion 62. A relatively simple way of achieving this is to machine or otherwise form a plurality of flats 68 (FIG. 16) in the axial direction of the portion 62. Thus the portion 62 comprises a plurality of arcuate portions 70 of constant radius and intervening flats 68. Depending on machining tolerances, the inner circumferential surface 64 of the second tube 60 may have a slight or marginal clearance from the arcuate portions 70 or alternately may be provided with a light interference fit. When the light interference fit is provided the flow paths 66 exist between the flats 68 and the inner circumferential surface 64. If there is a clearance then the bypass path also includes this clearance.

In order for fluid to flow through to the bypass path 222 an access path 72 is formed in the second tube 60. The access path 72 enables air to flow from outside of the inner tube 10 into the channels 66.

In the present embodiment the access path 72 is in the form of radially extending holes 74 formed inboard of an upstream end 76 of the second tube 60. The end 76 abuts the shoulder 63. The access path 72 also includes in this embodiment a circumferential recess or groove 80 formed on the inner circumferential surface 64 of the second tube 60 onto which an inner radial end of each of holes 74 open.

The disclosed multi piece inner tube assembly 100 of FIGS. 2-5 and 15-18 may be constructed in alternate forms. For example the channels 66 are described as being formed by the provision of flats 68 on the portion 62 of the outer circumferential surface of the first tube 30. However as an alternative to or in addition to the provision of the flats 68, one or more grooves may be formed axially along the portion 62. Alternately, flats or grooves may be formed in the inner circumferential surface 64 of the second tube 60. Further, the access paths 72 may be formed by the provision of openings such as slots that open onto the end 76 of the second tube 60 and feed to recess 80.

Bit Retaining System 400

Figure 19:
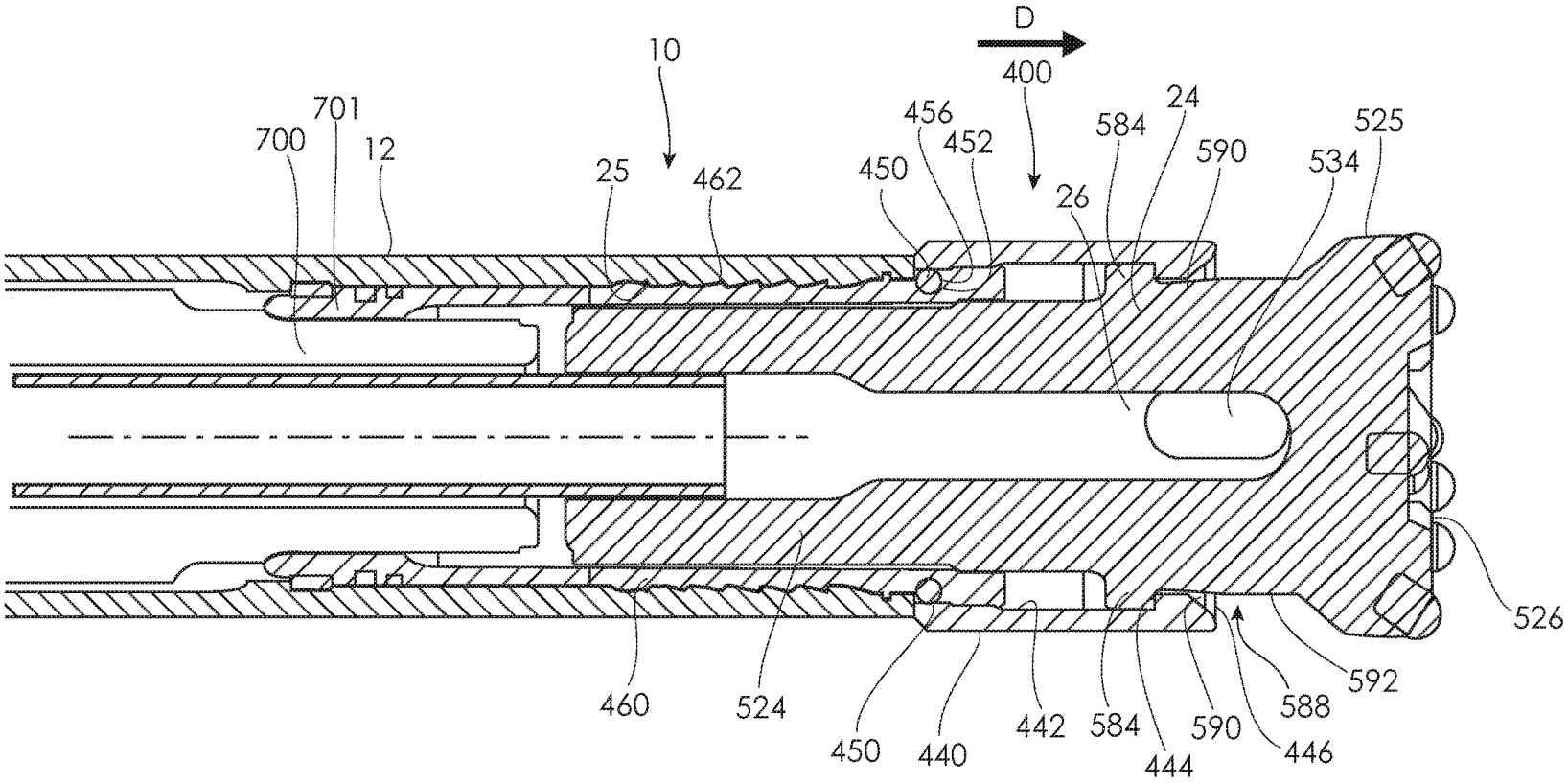
FIG. 19 is a cross section view of an embodiment of the disclosed bit retaining system shown in association with a downstream end of the DTH device.

FIG. 19 depicts an embodiment of the disclosed drill bit retaining system 400 for the retaining the bit 24 present embodiment of the DTH hammer 10. The bit retaining system 400 acts to retain a drill bit 24 within the outer case 12 and in particular acts to prevent the bit 24 from falling from the outer case 12. The drill bit 24 has a shank 524 and a thickened head 525 having a cutting face 526. The head 525 and cutting face 526 protrudes from the downstream end 18 of the outer case 12. The drill bit 24 is also formed with a plurality of splines 528. The splines 528 extend in an axial direction along an outside surface of the bit 24. The drill bit 24 has a stop mechanism 530 at the down hole (or downstream) end of the splines 528. The central passage 26 of the bit 24 is in fluid communication with the face 526 via a plurality of inclined feed passages 534. Further features of the drill bit 24 will be described later.

The bit retaining system 400 includes a shroud 440. The shroud 440 is capable of coupling to the downhole end 18 of the outer case 12. The shroud 440 when coupled to the outer case 12 locates over an intermediate portion of the drill bit 24. It will also be noted that the shroud 440 is on an outside, and at the downstream end, of the outer case 12. The shroud 440 has an internal circumferential surface 442 which is configured to form an abutment 444 to prevent the drill bit 24 from falling from the outer case 12. Further, the internal circumferential surface 442 is configured to facilitate substantially uniform fluid flow distribution in a down hole direction D between the shroud 440 and an outer surface of the drill bit 24.

The shroud 440 is of a generally cylindrical configuration. The abutment 444 is formed near a down hole or downstream end 446 of the sleeve 440. In this embodiment the abutment 444 is formed as a plurality of spaced apart protrusions 448 on the internal circumferential surface 442. The protrusions 448 extend in a radial inward direction from the internal circumferential surface. The protrusions 448 can be equally spaced circumferentially.

Figure 21:
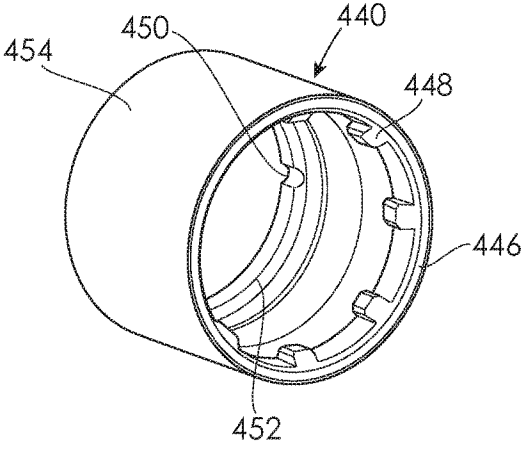
FIG. 21 is a perspective view of a shroud incorporated in the bit retaining system.

A plurality of recesses 450 (see for example FIGS. 19, 21 and 25) are also formed in the internal circumferential surface 442. The recesses 450 are circumferentially spaced apart from each other and axially spaced from the protrusions 448. The recesses 450 are evenly spaced in a circumferential direction from each other. Also the recesses 450 are in axial alignment with a respective protrusion 448. However in this embodiment there are more protrusions 448 than recesses 450.

The internal circumferential surface 442 comprises a circumferential band 452. The circumferential band 452 is near an up hole or upstream end 454 of the shroud 400. The recesses 450 are formed in the band 452. The band 452 creates an internal shoulder 456 about the surface 442. Each recess 450 extends in an axial direction and opens onto both the upstream end 454 of shroud 440 and the shoulder 456.

Figure 22:
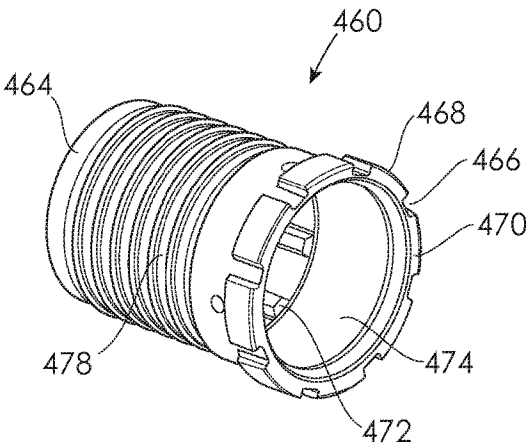
FIG. 22 is a perspective view of a drive sub incorporated in the bit retaining system.
Figure 20:
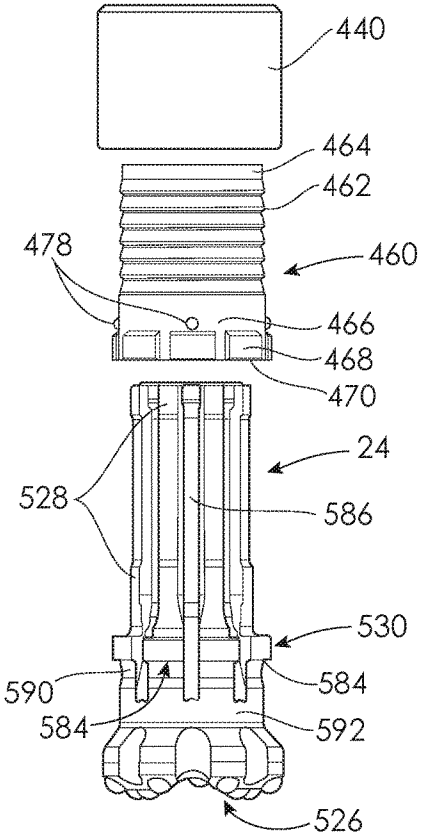
FIG. 20 is an exploded side view of an embodiment of the bit retaining system together with an associated DTH hammer drill bit.

The drill bit retaining system 400 also includes a drive sub 460. The drive sub 460 couples the sleeve 440 to the outer case 12. More particularly the drive sub 460 is able to clamp or otherwise retain the shroud 440 on or to the outer case 12. The drive sub 460 is also of a generally tubular configuration. A screw thread 462 is formed on an outer circumferential surface 464 of the drive sub 460. The thread 462 screws onto a thread 25 formed on the inner surface of the outer case 12. This couples the bit retaining system (and the bit 24) to the outer case 12. As shown in FIGS. 20 and 22 the outer circumferential surface 464 is formed with a plurality of gaps 466. The gaps 466 are evenly spaced apart and at locations that enable the protrusions 448 to pass there through. The gaps 466 are formed in an outer band 468 located at a downstream end 470 of the drive sub 460. The outer band 468 extends in a radial outward direction and as such forms a thickened portion of the drive sub 460.

A plurality of drive splines 472 are formed on an internal circumferential surface 474 of the drive sub 460. The drive splines 472 extend in an axial direction and are evenly spaced apart.

The bit retaining system 400 also includes a detent system 476 that is capable of holding the protrusions 448 in a fixed first rotational position relative to the bit 24. In the first fixed rotational position the protrusions 448 are capable of abutting the stop mechanism 530 on the bit 24 to prevent the bit 24 from passing out of the shroud 440. The detent system 476 is a distributed system having components on both the shroud 440 and the drive sub 460. The components of the detent system 476 on the drive sub 440 are the recesses 450. The components of the detent system 476 on the drive sub 460 are in the form of members 478 on its outer circumferential surface 464. The members 478 are evenly spaced apart and are able to register with the recesses 450.

Figure 24:
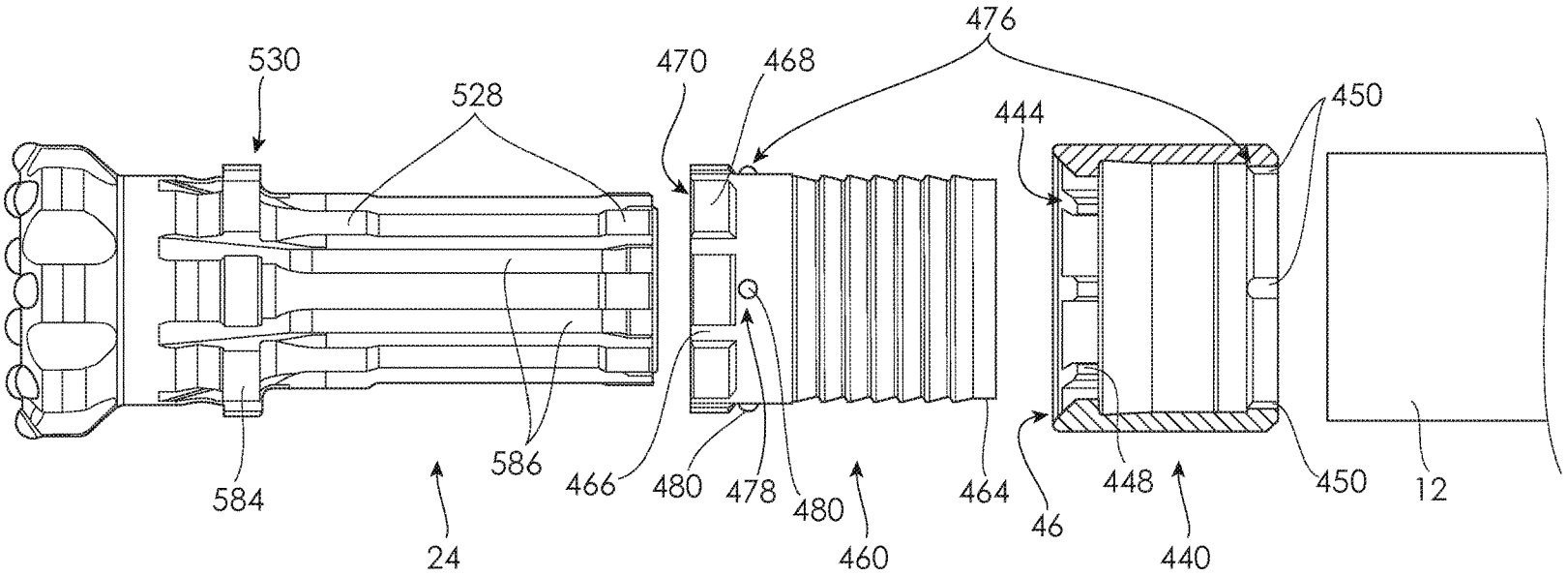
FIG. 24 is a schematic representation of one possible arrangement of components of the bit retaining system in an initial stage of coupling to the DTH device.
Figure 25:
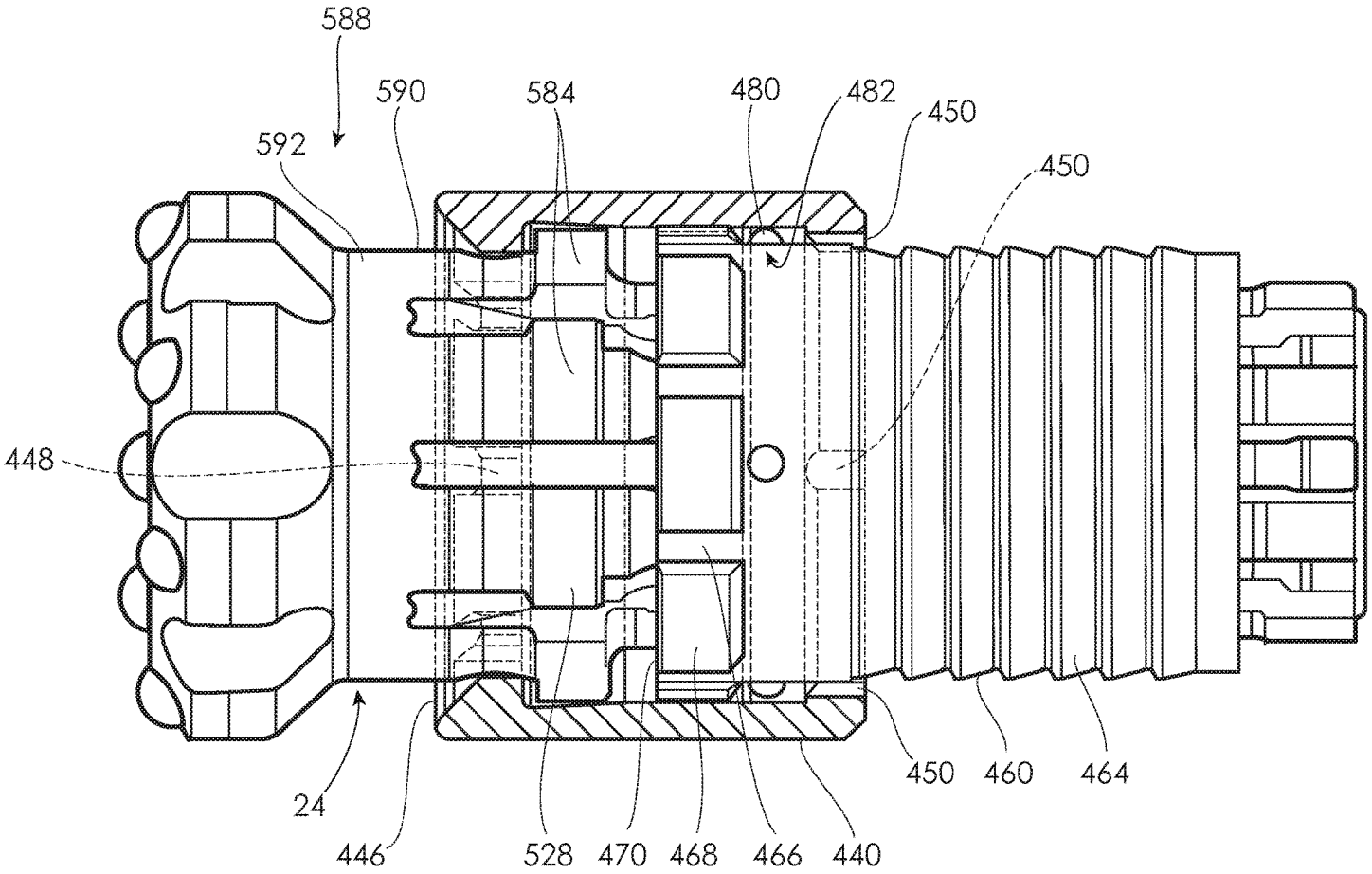
FIG. 25 illustrates an arrangement of the components of the bit retaining system in a subsequent stage of coupling to the DTH device where the shroud is in a bit release position and an associated detent system disengaged.

As shown in FIGS. 24 and 25 in the present embodiment the members 478 are in the form of balls 480 which seat in hemispherical recesses formed on the outer circumferential surface 464. The hemispherical recesses are disposed adjacent the outer band 468. The hemispherical recesses are of a depth approximately equal to the radius of the balls 480. Thus when the balls 480 are in the hemispherical recesses a substantially hemispherical portion of the balls 480 protrude from the outer circumferential surface 464.

Figure 23:
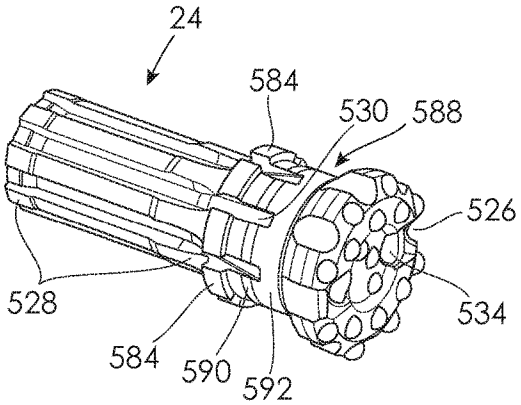
FIG. 23 is a perspective view of a hammer drill bit that may be used in conjunction with the bit retaining system.

With particular reference to FIGS. 19, 20 and 23 the stop mechanism 530 is in the form of a plurality of lugs 584 which are provided at a downstream end of each of the splines 528. Indeed the lugs 584 can be considered as and are structurally formed as part of the splines 528. The splines 528 are separated by axially extending grooves 586. These grooves 586 form channels or passages for fluid to flow along the outside of the bit 24. This fluid subsequently returns through the feed passages 534 and central passage 26 back up the DTH hammer 10.

The lugs 584 are formed about a portion of the bit 24 that has an increased radius and material thickness in comparison to the shank 524. A region 588 of the drill bit 24 between the lugs 584 and the bit face 526 is formed with a portion 590 in which the grooves 586 progressively reduce in depth to zero reaching a contiguous constant diameter portion 592.

FIGS. 24-29 illustrate a manner of coupling the bit retaining system 400 to the DTH hammer 10. FIG. 24 illustrates the general juxtaposition of the components of the bit retaining system 400 and parts of the DHT hammer 10. It should be understood however that when physically coupling the bit retaining system 400 to the hammer 10 it is not necessary to physically align each of the outer case 12, shroud 440, drive sub 460 and bit 24 at any one time in the juxtaposition shown in FIG. 24.

The first stage in assembly of the hammer 10 with the bit retaining system 400 is to slide the shroud 440 over the drive sub 460. It is necessary for the end 446 of the shroud 440 to extend beyond the end 470 of the drive sub 460. This requires that shroud 440 and drive sub 460 are rotated relative to each other so that the protrusions 448 align with and subsequently can pass through the gaps 466. This arrangement is shown in FIG. 25 passed there through. FIG. 25 also depicts the bit 24 being partially inserted into the bit retaining system 400. The bit 24 is pushed into the shroud 440 with the grooves 586 aligned with the protrusions 448. The pins 478 and recesses 450 are spaced from each other and thus the detent system 476 is disengaged.

Figure 26:
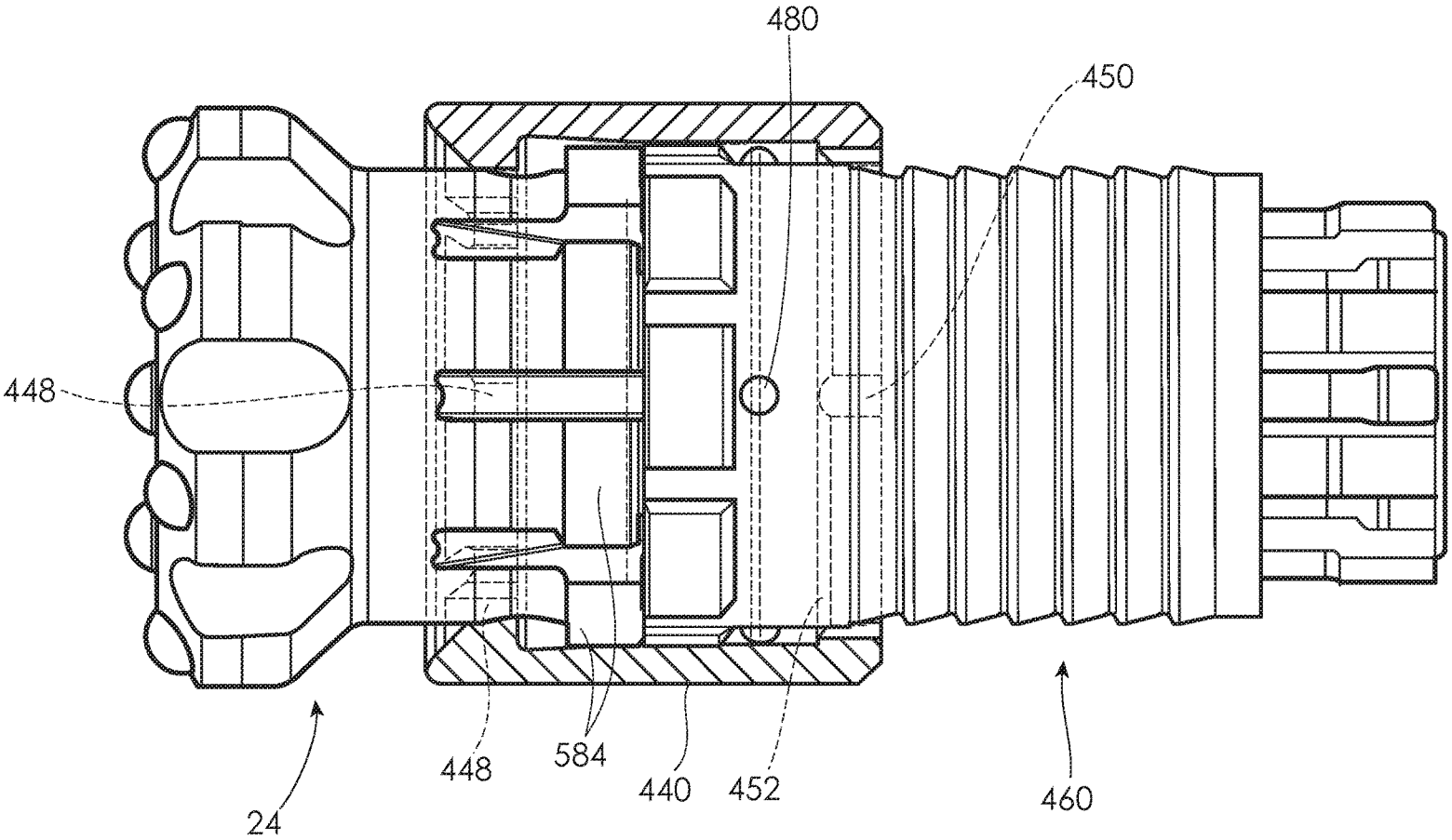
FIG. 26 illustrates an arrangement of the components of the bit retaining system in a subsequent stage of coupling to the DTH device where the shroud is in a bit retention position and detent system disengaged.

FIG. 26 illustrates a progression in the coupling process in which, starting from the arrangement in FIG. 25, firstly the bit 24 is pushed further in an up hole direction into the shroud 440 and drive sub 460, and secondly the shroud 440 is rotated relative to the drive sub 460 and the bit 24 so that (a) the recesses 450 align with the members 478/balls 480 and simultaneously (b) the protrusions 448 axially align with the stop mechanism 530/lugs 584. Although the members 478 and recesses 450 are aligned they are still spaced from each other and thus the detent system 476 remains disengaged.

Figure 27:
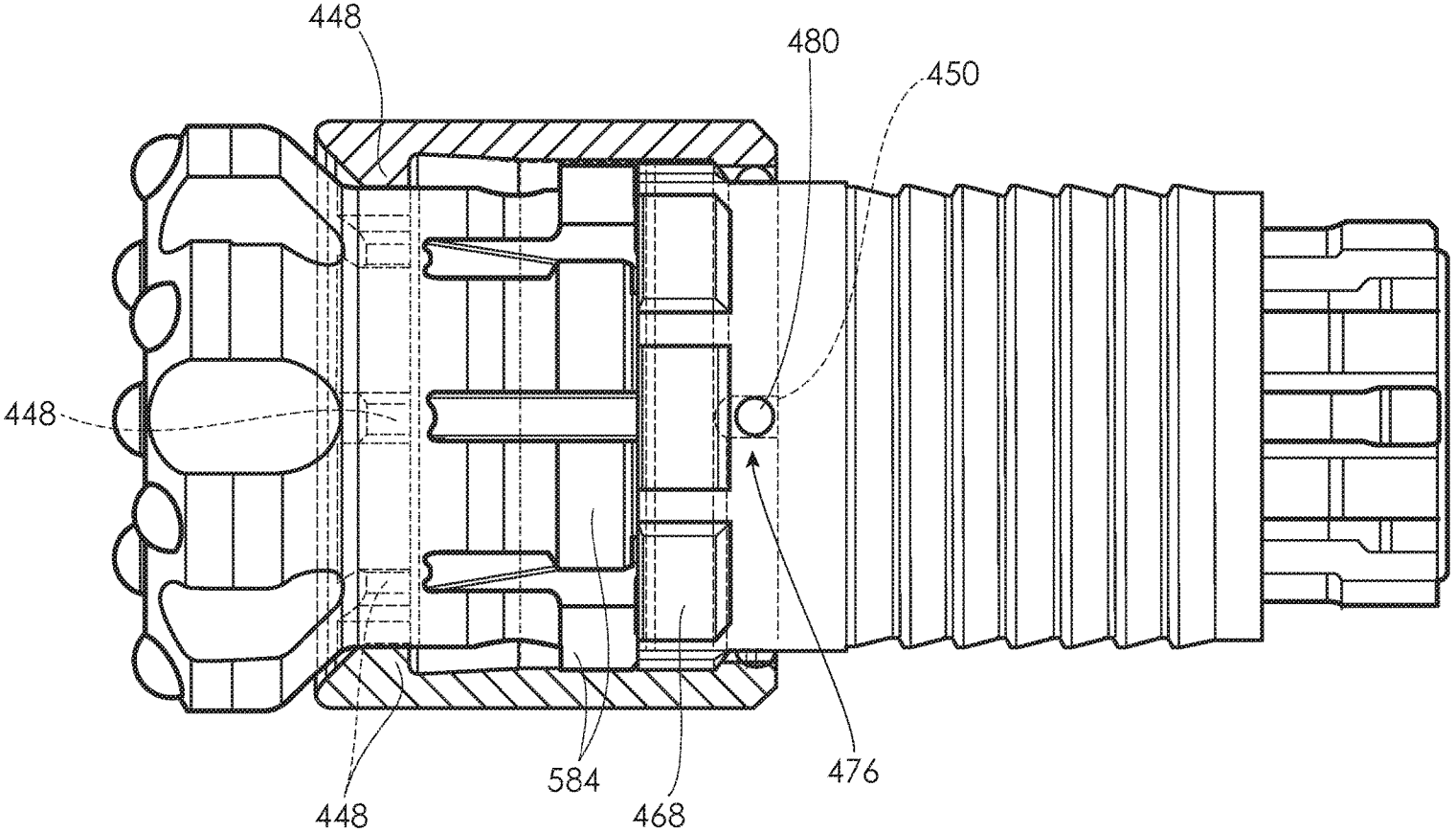
FIG. 27 illustrates an arrangement of the components of the bit retaining system in a subsequent stage of coupling to the DTH device where the shroud is in a bit retention position and detent system engaged but unlocked.

Next, as shown in FIG. 27, the shroud 440 and drive sub 460 are moved in an axial direction relative to each other so that the members 478/balls 480 are received within the recesses 450. When this occurs the detent system 476 is engaged and the shroud 440 is in the first fixed rotational position relative to the drive sub 460. The shroud 440 cannot fall from the drive sub 460 because the inner circumferential band 452 of the shroud 440 abuts against the thickened band 468 of the drive sub 460. When in this first fixed rotational position the protrusions 448 are in axial alignment with the stop mechanism 530/lugs 584. While the detent system 476 is engaged, it is unlocked as it is possible to push the shroud 440 toward the outer case 12 and thus disengage the detent system 476.

Figure 28:
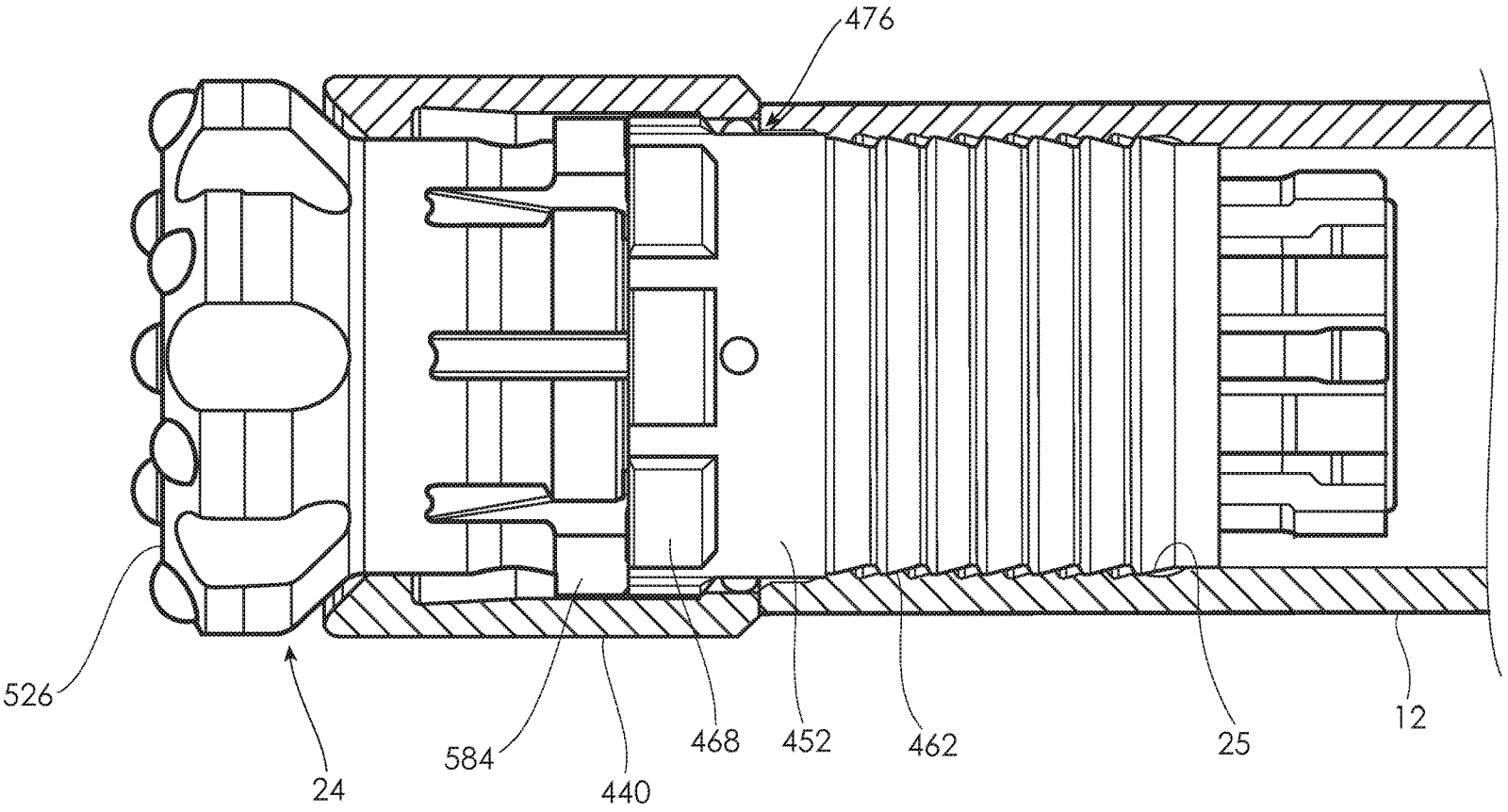
FIG. 28 illustrates an arrangement of the components of the bit retaining system in a subsequent stage of coupling to the DTH device where the shroud is in a bit retention position, the detent system is engaged but unlocked and the drive sub partially screwed into an outer tube of the DTH device.
Figure 29:
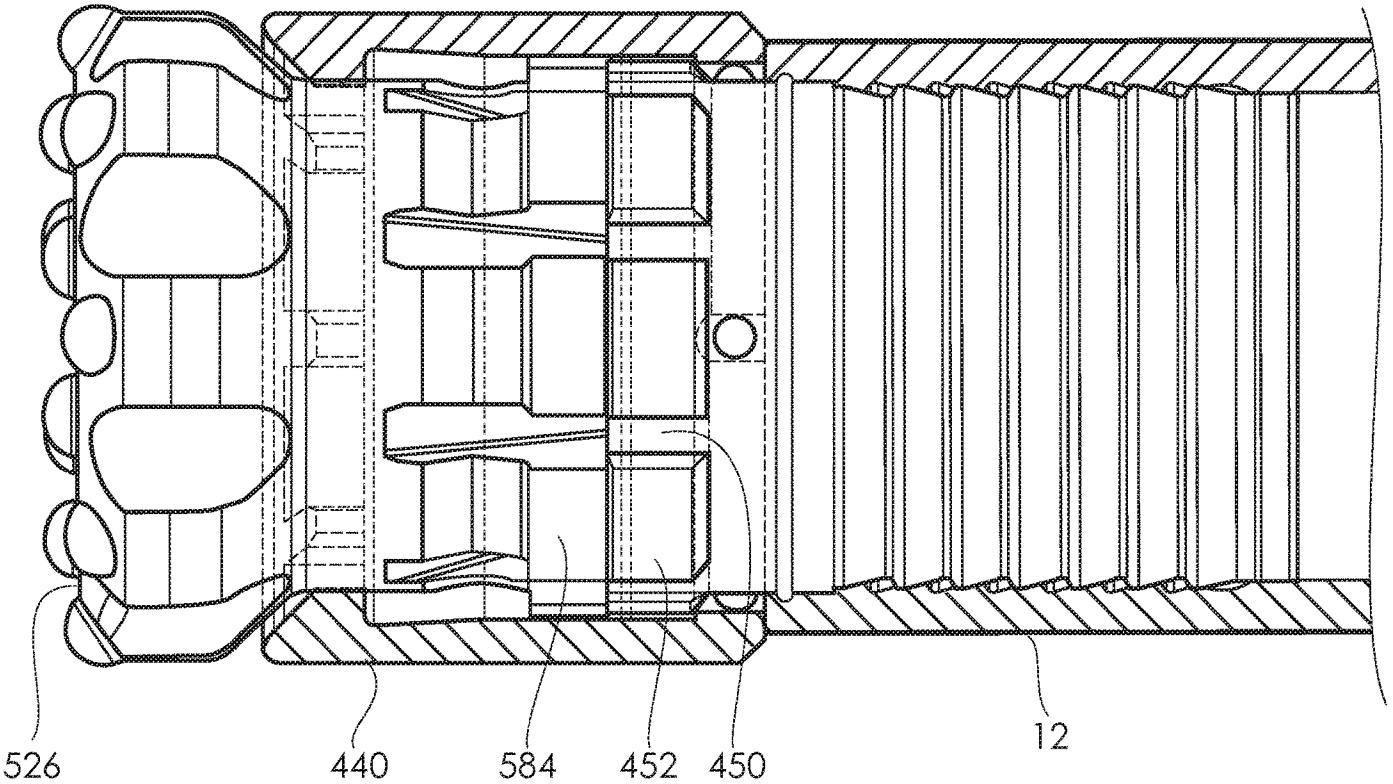
FIG. 29 is a schematic representation of the bit retaining system fully installed in the DTH device where the shroud is in a bit retention position, the detent system is engaged and locked and the drive sub fully screwed into outer tube.

During the assembly steps shown in FIGS. 25, 26 and 27 the drive sub 460 may have been partially screwed into the outer case 12. Whether or not that had been the case, in order to assemble the hammer drill 10 the drive sub 460 is now fully screwed into the outer case 12 by way of engaging the respective screw threads 25 and 462. FIG. 28 depicts the drive sub 460 partially screwed into the outer case 12. FIG. 29 depicts a final use configuration where the drive sub 460 is fully screwed into the outer case 12. In this configuration the shroud 440 is clamped between the case 12 and the drive sub 460 and the detent system 476 becomes locked because the shroud 440 cannot now be lifted away from the pins 478. The shroud 440 retains the bit 24 in the outer case 12 and indeed in the drive sub 460. This is also shown in FIG. 19.

When the DTH hammer drill 10 is in use the bit 24 is able to reciprocate in an axial direction in response to impacts from a fluid (most usually air) driven piston 700. Further, in the event that a drill string to which the DTH hammer drill 10 is coupled is rotated, torque can be transferred to the bit 24 via the drive splines 472 in the drive sub 460 which reside within the grooves 586 and can subsequently push against the splines 528.

Figure 30:
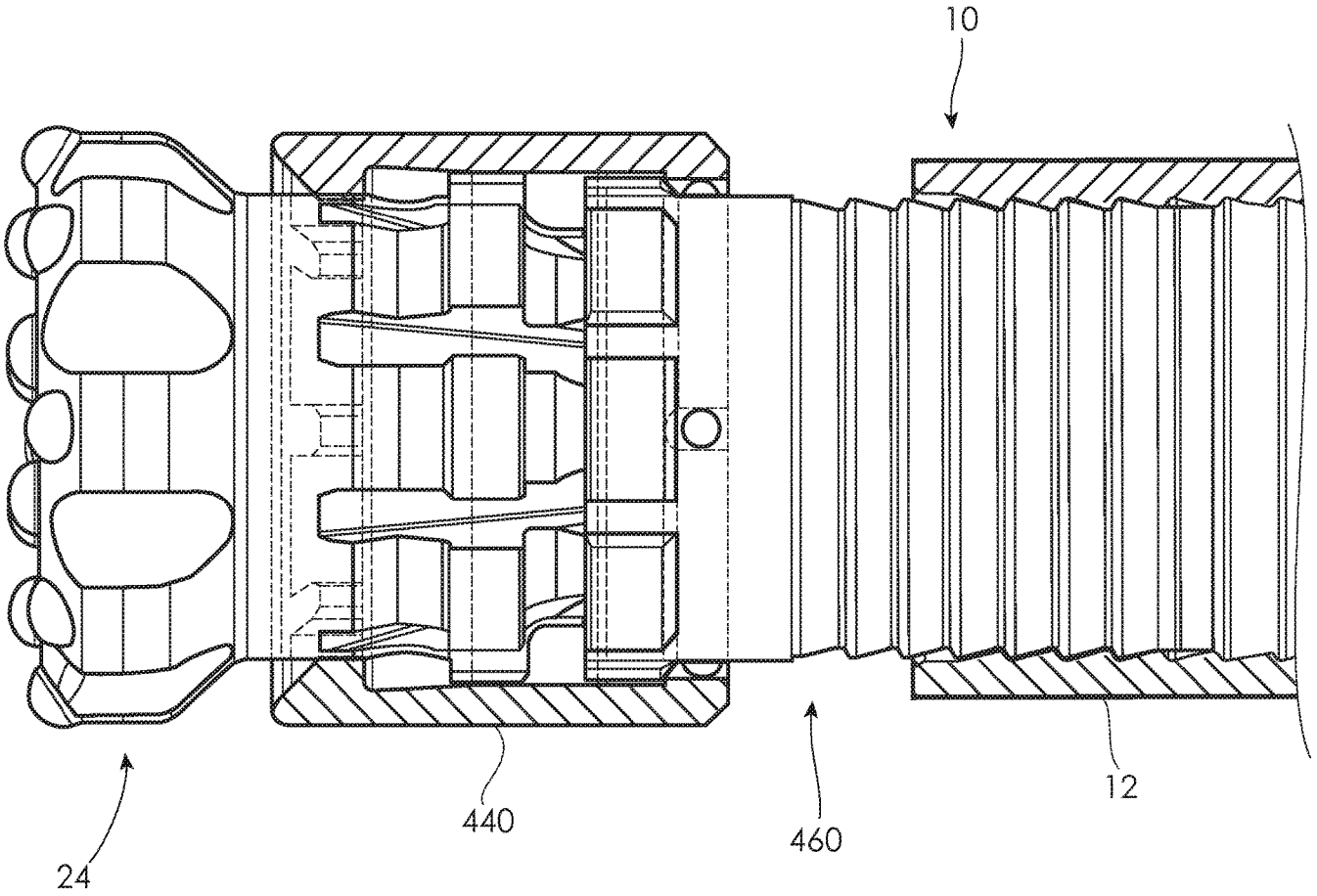
FIG. 30 is a schematic representation of a stage of decoupling of the bit retaining system to enable replacement of a drill bit where the shroud is in a bit retention position, the detent system is engaged but unlocked and the drive sub partially screwed into an outer tube of the DTH device.
Figure 31:
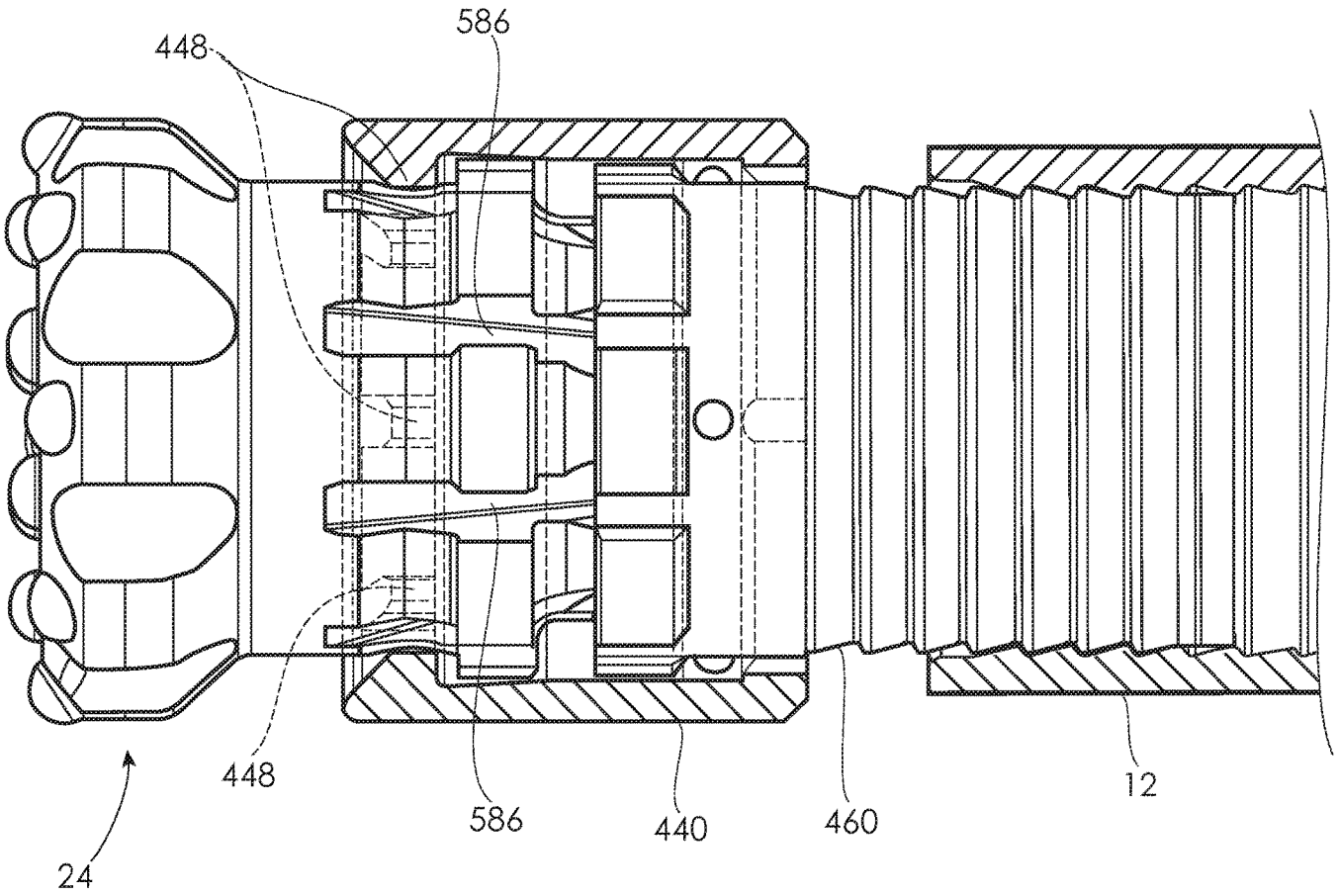
FIG. 31 is a schematic representation of the juxtaposition of the shroud and the drive sub in a more advanced stage of the bit changing process where the shroud is in a bit release position and the detent system is disengaged.

FIGS. 30-33 depict the sequence of events for changing a bit 24 using the bit retaining system 400. Initially as shown in FIG. 30 the drive sub 460 is partially unscrewed from the case 12. The drive sub 460 needs to be unscrewed only to the extent required to enable the shroud 440 to be slid toward a case 12 by distance sufficient to disengage the balls 480 from the recesses 450. Subsequently, the shroud 440 can be rotated relative to the drive sub 460 to a second rotational position where the lugs 448 are aligned with the grooves 586 on the bit 24. This configuration is shown in FIG. 31.

Figure 32:
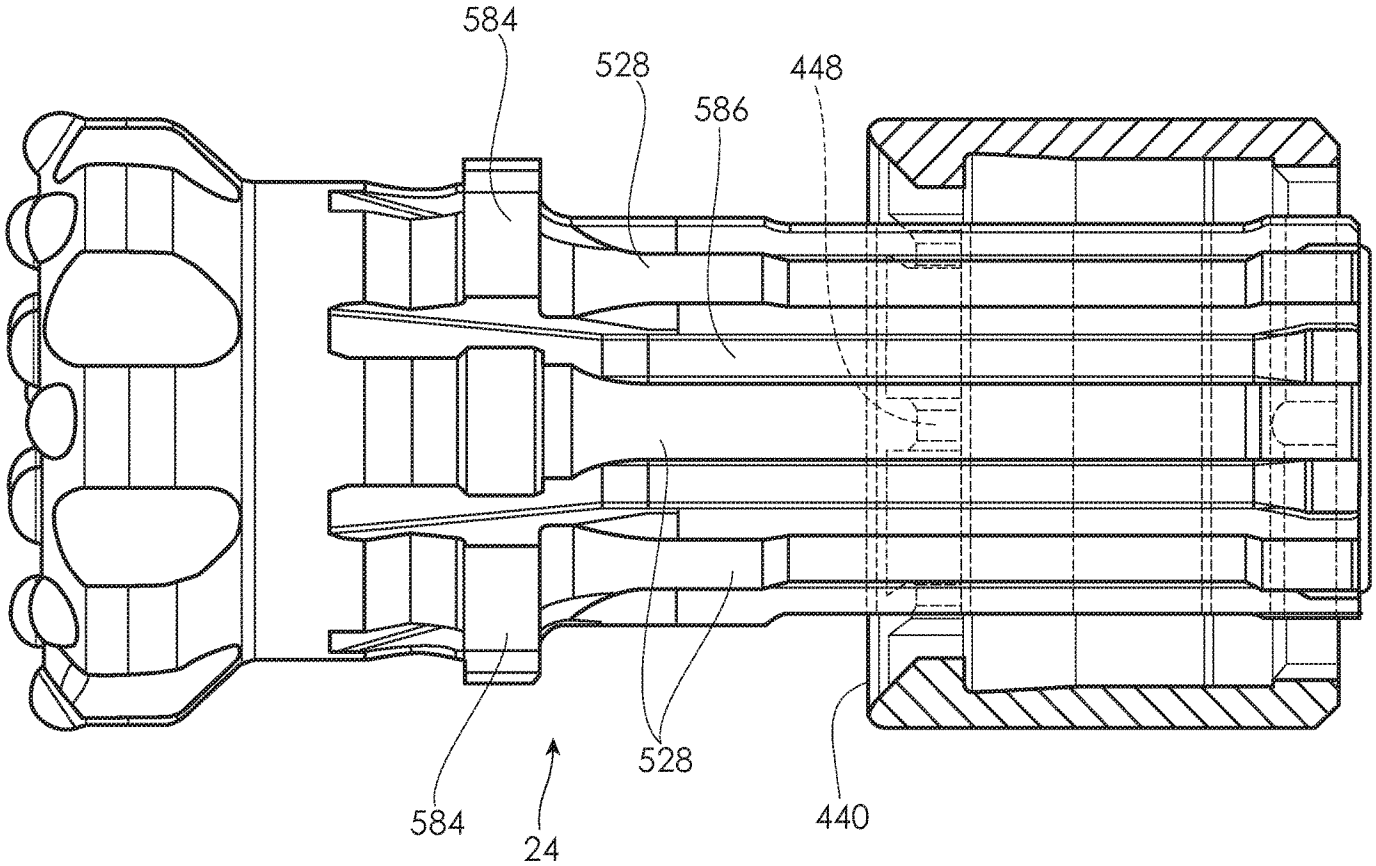
FIG. 32 is a schematic representation of a drill bit being decoupled from the bit retaining system to enable replacement.

The bit 24 can now slide out of the outer case 12, drive sub 460 and the shroud 440 as shown in FIG. 32.

A new bit can be coupled to the DTH hammer 10 by exactly the same sequence as explained above with the reference to FIGS. 25-29.

It will be appreciated by those skilled in the art that the above sequence enables very easy and fast replacement of bits 24 as it is not necessary to completely remove the entire drive-sub 460 from DTH hammer 10. All that is required is the undoing of one thread and rotation of the sleeve 440 relative to the drive sub 460.

Embodiments of the bit retaining system 400 confer numerous and substantial benefits and advantages over traditional methods of maintaining hammer bits. These are summarised as follows:

(a) The bit retaining system 400 enables the hammer 10 to be made with or use bits 24 of a shorter length and with greater shank diameter than is ordinarily the case. By way of comparison reference is made between FIG. 33 which depicts a prior art hammer bit 24' and side by side with an embodiment of the bit 24 for use with the same DTH hammer drill 10. The bit 24 utilised with the hammer 10 may have an overall length L1 of 305 mm compared with 359 mm for the prior art hammer bit 24'. The difference in length results in the bit 24 having the weight of about 15 kg compared to 18 kg for the prior art hammer bit 24'.

This is significant in terms of transfer of impact forces from the piston 700. In many prior art DTH hammers the piston is lighter than the bit. This difference is also often in the order of about 3 kg. Therefore use of embodiments of the bit retaining system 400 enables the use of a bit 24 of approximately the same mass as the piston resulting in better energy transfer.

(b) As described previously the bit retention system 400 retains the bit 24 at the stop mechanism 530 at relatively large diameter location on the bit 24. In comparison to the prior art bit 24' the stop mechanism shown at item 530' is at or near a free end of the shank 524'. As a result the forces generated in the shank 524 during deceleration are compression forces for bit 24 rather than tensile forces as in the prior art bit 24'. This reduces the likelihood of fracturing of the shank for bit 24.

Figure 33:
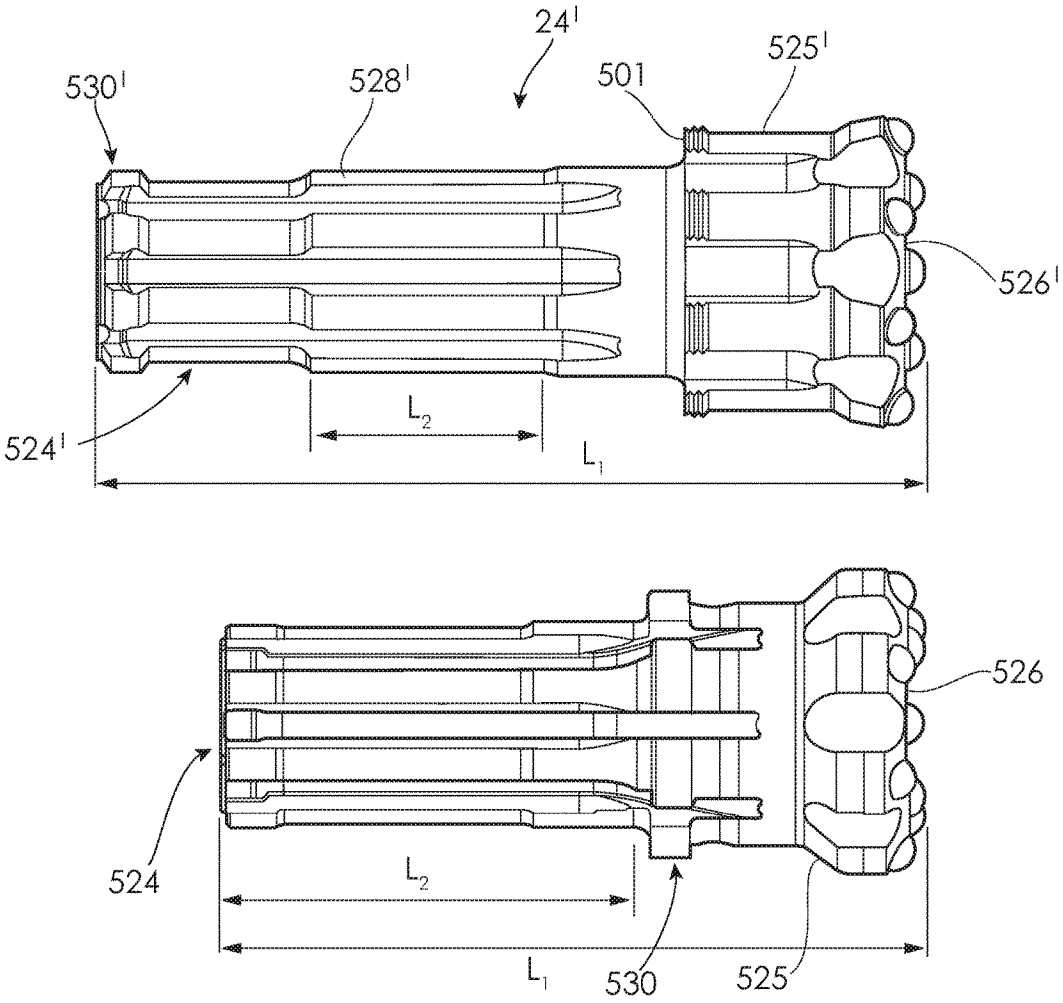
FIG. 33 is a side view providing a comparison between a hammer bit that can be used with embodiments of the present drill bit retaining system and a prior art hammer bit.

(c) Use of embodiments of the bit retaining system 400 further enable greater contact area between the drive splines 472 in the drive sub 460 and the splines 528 of the bit 24. This arises because the bit 24 is able to be formed with splines 528 that have a greater active length (being the length along which they are contacted by the splines of the drive sub 460) in comparison to prior art comparable drill bit 24'. This is shown in FIG. 33 by comparison of the active lengths L2 of the splines 528 of bit 24 and splines 528' of prior art bit 24'.

Figure 34:
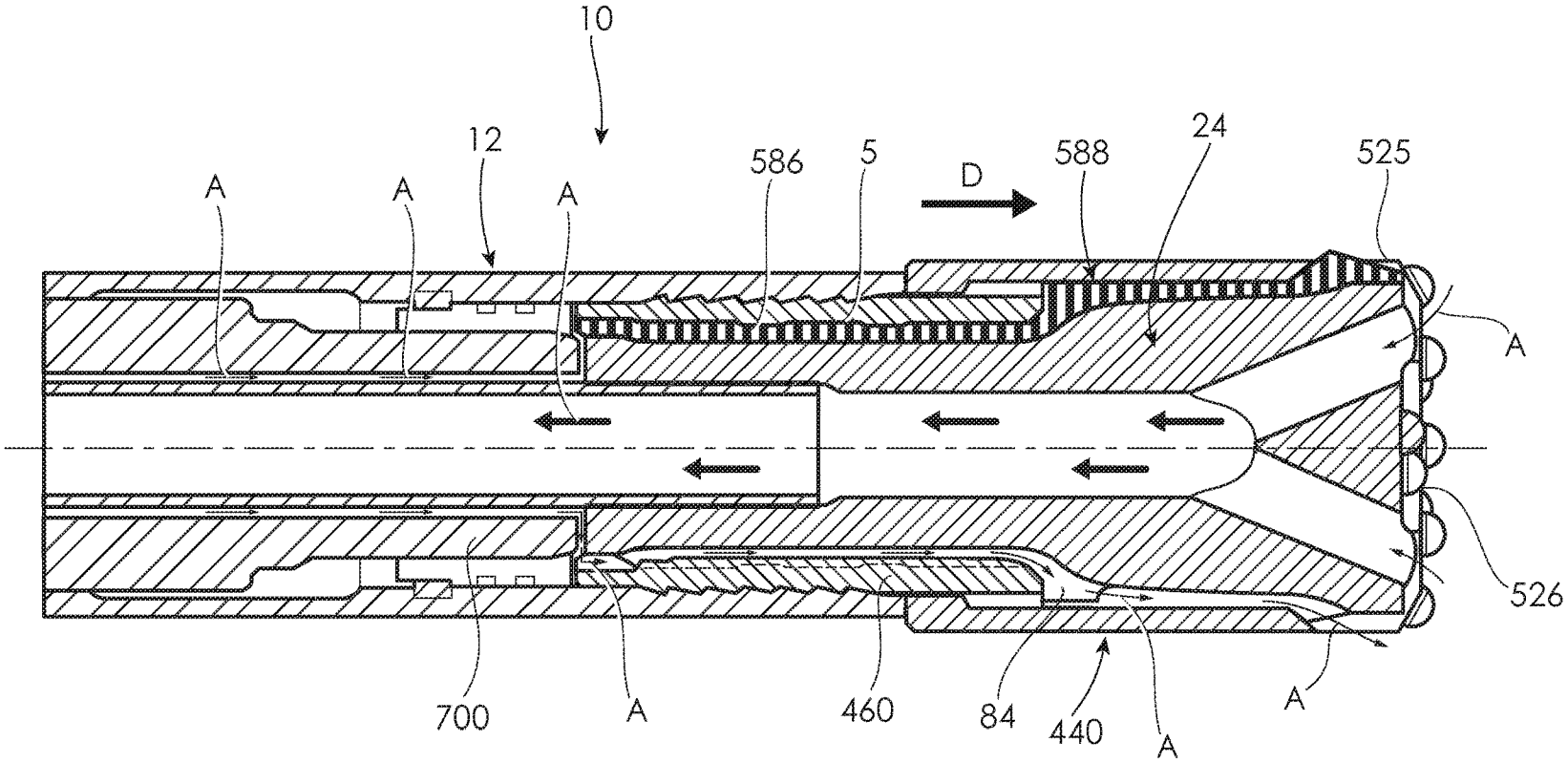
FIG. 34 is a cross section view of the bit retaining system installed on an end of the DTH device in the form of a reverse circulation hammer drill but in a different axial plane to that shown in FIG. 19.

(d) The grooves 586 and surface portion 588 of the bit 24 provide a substantially continuous smooth surface for airflow from the upstream end of the shank 524 to the cutting face 526. The smooth continuous nature of the airflow path provided by the grooves 586 and surface portion 588 are shown most clearly in FIG. 34. The arrows A in FIG. 34 depict air flow while the shaded area S depicts the volume available for air flow between the shroud 440 and bit 24. The air which previously powered the piston 700 exits from between the drill bit 24 and the shroud 440. This air flows initially through each of the grooves 586 and subsequently across the smooth continuous surface portion 588. When the bit 24 is at the top of its stroke substantially the entire surface portion 588 is encircled by the shroud 440 with only the head 525 and cutting face 526 outside of the shroud 440. This is shown in FIG. 34. When the bit 24 is at the bottom of its stroke the flared surface portion 590 is covered by the shroud 440 but the contiguous surface portion 592 is exposed. This is shown in FIG. 19. In either case airflow is substantially smoother than can be achieved with the prior art bit 24' (see FIG. 33) which has square shoulders 501 between the shank 528' and head 525'. Further the smooth nature of the surface portion 588 and the tapering of the surface portion 590 provide greater volume annulus for air flow between the bit 24 and the shroud 440. This in turn reduces pressure loss and assists in reducing input energy required to lift cuttings to the surface.

It will be understood by those skilled in the art that the disclosed bit retention system 400 may be embodied in other forms. For example the bit retaining system 400 is described as having a detent system 476 comprising balls 480 that seat within hemispherical recesses. However the balls 480 can be replaced by cylindrical pins; or integrated ridges or keys formed on the outer circumferential surface 464 of the drive sub 460. Further while the detent system is shown as comprising four recesses 450 and four members 478 alternate embodiments may have a different number of recesses and members. For example: only one of each; or only two of each. Alternately there may be more such as six or eight of each.

Piston 700

Figure 35B:
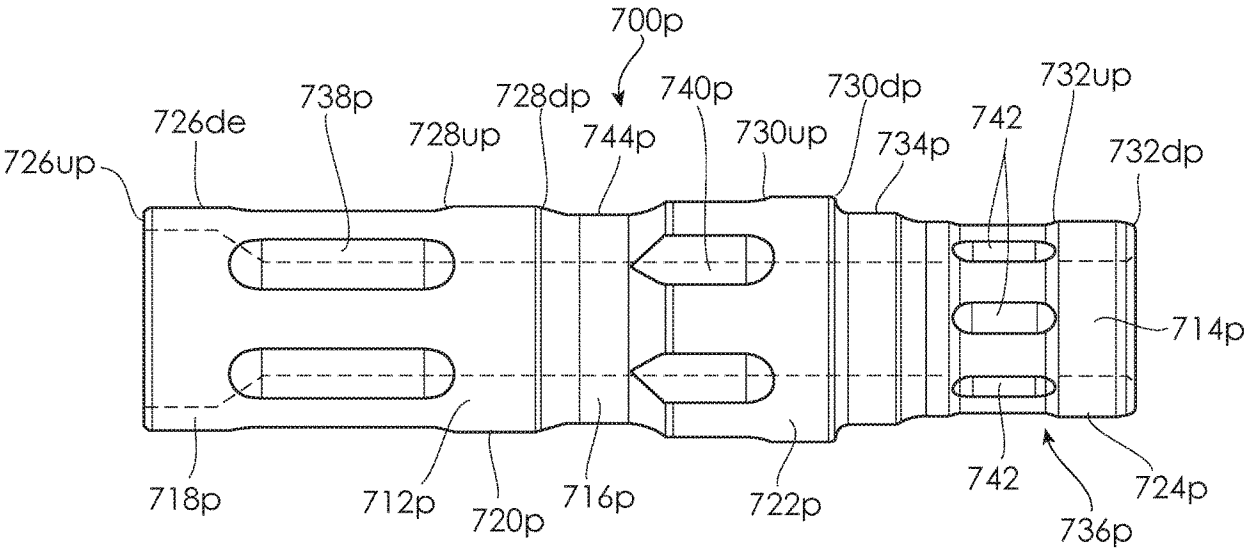
FIG. 35*b* is a schematic representation of a prior art piston for a reverse circulation hammer drill.
Figure 35A:
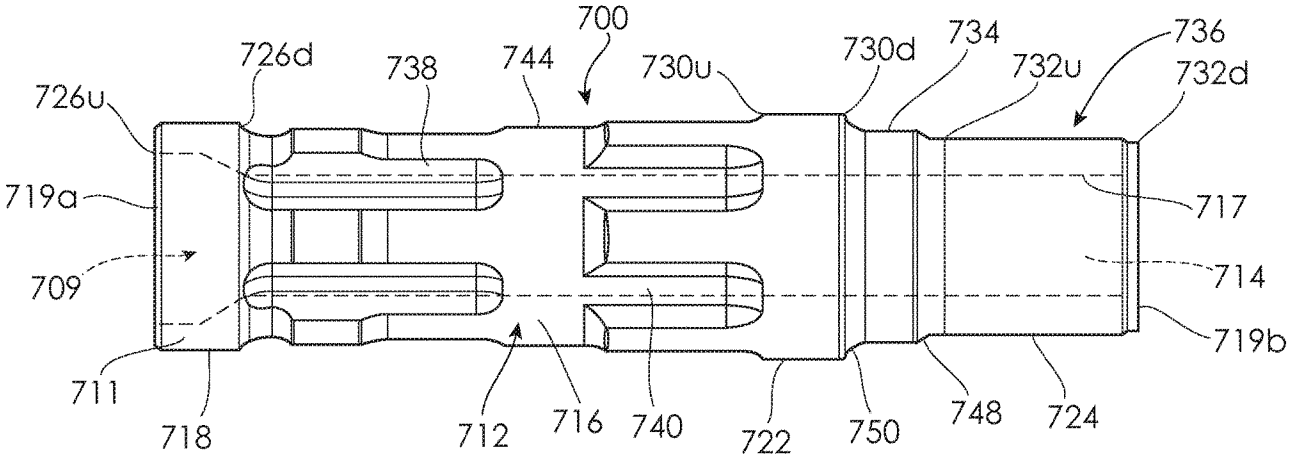
FIG. 35*a* is a schematic representation of embodiment of the disclosed piston shown in FIG. 1.

FIG. 35*a* illustrates an embodiment of the piston 700. The piston 700 has a body 712 formed with a central axial passage 714 and an outer surface comprising an circumferential surface 716; an inner circumferential surface 717, and opposite axial surfaces 719*a* and 719*b*. The end 719*a* is in the head 711 of the piston 700 and incorporates the well 709. The outer circumferential surface 716 is provided with a maximum of three axially spaced apart porting bands namely: an upstream porting band 718; an intermediate porting band 722 and a downstream porting band 724. The upstream porting band 718 is defined between respective upstream and downstream porting edges 726*u*, and 726*d* respectively. The intermediate porting band 722 is defined between respective upstream and downstream porting edges 730*u* and 730*d* respectively. The downstream porting band 724 is defined between an upstream porting edge and a downstream porting edge 732*u* and 732*d* respectively. A stop 734 is formed between the intermediate porting band 722 and the downstream porting band 724.

The piston 700 has a nose 736 which in this instance comprises in combination the stop 734 and the downstream porting band 724.

A plurality of axially extending and circumferentially spaced apart recesses or scallops 738 are formed in an upstream portion of the piston 700 extending from the upstream porting band 718 toward a central reduced diameter portion 744 of the piston 700. A further set of recesses or scallops 740 is circumferentially spaced about the body 712. The recesses 740 are located between the reduced diameter portion 744 and the intermediate porting band 722. The upstream ends of the recesses 740 open onto the reduced diameter portion 744.

The stop 734 has an outer diameter that is larger than the outer diameter of the downstream porting band 724. A tapered shoulder 748 provides a smooth transition between the stop 734 and the downstream porting band 724. A steeper shoulder 750 provides a sharper or quicker transition in outer diameter between the stop 734 and the intermediate band 722.

By way of comparison FIG. 35*b* illustrates a prior art piston 700*p*. The prior art piston 700*p* comprises a body 712*p* with an axial passage 714*p* and an outer circumferential surface 716*p*. The outer circumferential surface 716*p* is provided with four axially spaced apart circumferential porting bands 718*p*, 720*p*, 722*p* and 724*p*. The porting band 718*p* is the upstream porting band and is defined between a corresponding upstream porting edge 726*up* and a downstream porting edge 726*dp*. The porting band 720*p* is a first intermediate porting band defined between an upstream porting edge 728*up* and a downstream porting edge 728*dp*. The porting band 722*p* is a second intermediate porting band which is downstream of the first intermediate porting band 720*p*. The porting band 722*p* is defined between an upstream porting edge 730*up* and a downstream porting edge 730*dp*. Porting band 724*p* is a downstream porting band and is defined between an upstream porting edge 732*up* and a downstream porting edge 732*dp*. A stop 734*p* is also formed between the second intermediate porting band 722*p* and the downstream porting band 724*p*. The section of the piston from and including the stop 734*p* to the downstream porting band 724*p* forms a nose 736*p* of the piston 700*p*. A plurality of axially extending and circumferentially spaced apart recesses or scallops 738*p*, 740*p* and 742*p* are formed in the outer circumferential surface 716*p*.

As shown in FIGS. 1 and 36-43 in the section of the outer case 12 in which the piston 700 reciprocates the hammer 10 is fitted with a spacer sleeve 701. The spacer sleeve 701 is held between a locking ring 703 which sits in a groove formed in the inner surface of the outer case 12 and the drive sub 460. The spacer sleeve 701 is formed with an inner circumferential surface 705. The surface 705 is of constant diameter for a majority of its length except for its extreme axial ends both of which are tapered so as to gradually increase in inner diameter away from a midpoint of the axis of the sleeve 701.

Notwithstanding the reciprocation of the piston 700 a portion of the nose 736 of the piston 700 is always within the spacer sleeve 701. An up hole end, i.e. the head 711 of the piston 700 is also always within a downhole section of the porting sleeve 600.

The outer case 12 has an inner circumferential surface 826 which in the section housing the piston 700 is profiled so that various regions have different inner diameter. Starting from an upstream end of the thread 25 the surface 826 has a constant diameter portion 830. The constant diameter portion 830 is formed with a circumferential groove 831 for seating the locking ring 703. Upstream of the portion 830, the inner surface 826 has an increased inner diameter portion 832. The portion 830 transitions via a shoulder 834 to the portion 832. The portion 832 subsequently transitions with via a shoulder 836 to a reduced inner diameter portion 838. Moving in the upstream direction the portion 838 transitions via a shoulder 840 to an increased inner diameter portion 842. Upstream of the portion 842 is yet a further portion 844 of reduced inner diameter. A shoulder 846 transitions between the portions 842 and 844.

The region of the outer case 12 coincident with the increased inner diameter portion 832 to may be notionally described as a bottom chamber 848. The upstream contiguous portion of the outer case 12 coincident with the reduced inner diameter portion 838 may be notionally termed as an intermediate chamber 850. A region within the outer case 12 on an inside of the porting sleeve 600 in which the piston 700 slides may be notionally described as a top chamber 852.

The piston 700, irrespective of its axial position within the outer case 12, always has its upstream porting band 718 at least partially within the porting sleeve 600.

A combination of surface portions of outer circumferential surface 716 of the piston 700, the inner surface 614 of the porting sleeve 600 and surface portions of the inner circumferential surface of the outer case 12 form a porting system. The porting system acts to distribute the driving fluid in a manner so as to cause reciprocation of the piston 700. The porting system is also arranged to hold the piston 700 in a fixed axial position when the hammer 10 is in the blow down mode.

Figure 36:
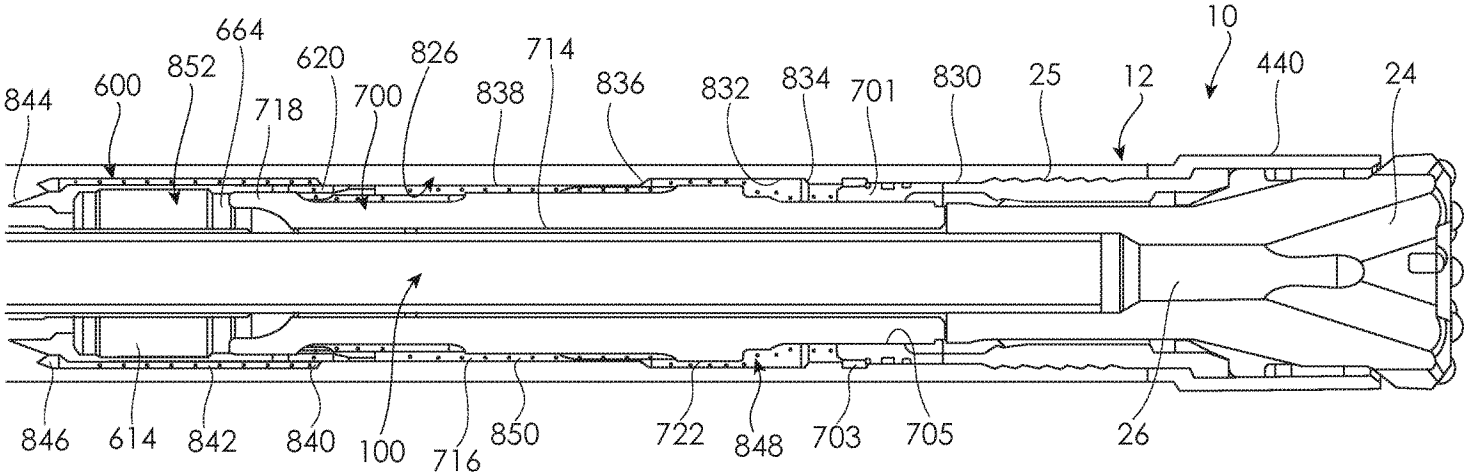
FIGS. 36, 37, 37, 38, 39, 40, 41 and 42 depict an operational cycle of an embodiment of the disclosed the DTH device utilising the disclosed piston.

FIG. 36 depicts the hammer 10 in an operational position and with the piston 700 having struck the bit 24. The flow path for fluid used for driving the piston 700 is depicted by a series of dots in FIG. 36. It will be seen that at the time of the piston 700 striking the bit 24 fluid flows between the porting sleeve 600 and the outer case 12; through the openings 620; through the intermediate chamber 850 over the intermediate porting band 722 and into the bottom chamber 848. The air is in substance prevented from escaping from the bottom chamber 848 because the inner surface 705 of the sleeve 701 overlies the downstream porting band 724 forming a substantial seal between these two surfaces. Further, an exhaust path that passes through the passage 714 of the piston 700 on an outer circumferential surface of the inner tube 100 is open.

Fluid pressure within the intermediate chamber 850 and bottom chamber 848 is substantially the same. However the surface area in the axial direction of the piston 700 upon which the fluid pressure in the bottom chamber 848 acts is greater than the surface area in the axial direction by which the fluid pressure in the intermediate chamber 850 acts. Accordingly the fluid produces a net force in the upstream direction on the piston 700. Further, fluid is unable to enter the top chamber 852 because the upstream porting band 718 and the inner surface of the second portion 664 of the porting sleeve 600 are dimensioned to form a substantial seal there between. Therefore fluid passing through the opening 620 cannot pass through this seal into the top chamber 852 and can only flow into the intermediate chamber 850 and bottom chamber 848. The net effect of this is that the piston 700 now commences to move in an upstream direction.

Figure 37:
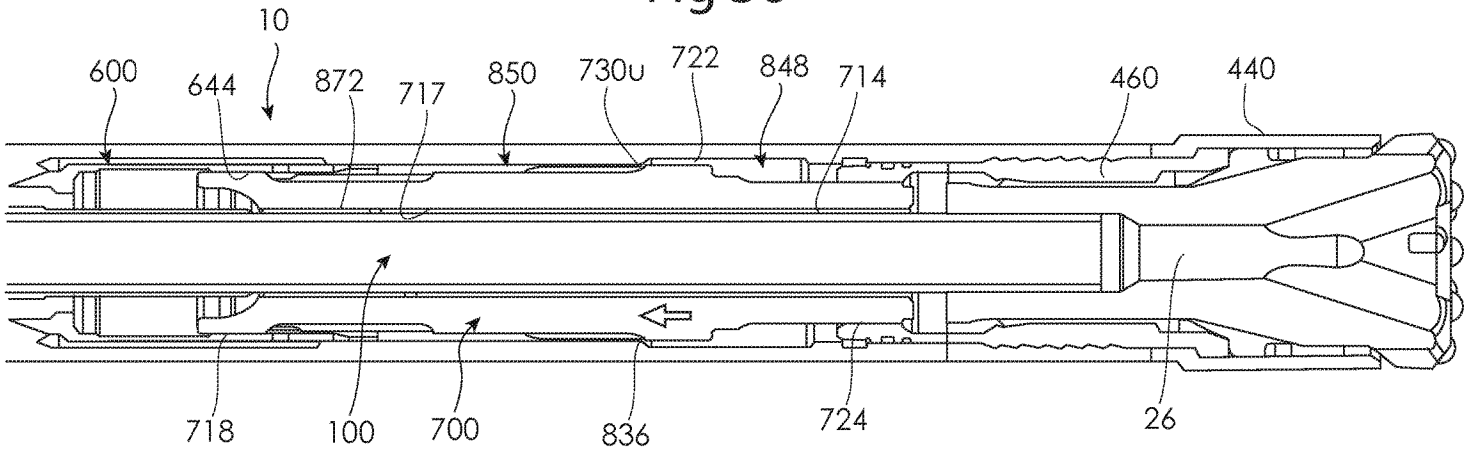

FIG. 37 depicts the hammer 10 at a point in the cycle subsequent to the point shown in FIG. 36. Here the piston 700 is moving in the upstream direction. At this point in time the upstream porting edge 730*u* of the intermediate porting band 722 has just passed the shoulder 836 and thus closes the fluid flow path entrance into the bottom chamber 848. In effect the shoulder 836 can be considered as the inlet of the bottom chamber 848. Fluid however is still able to flow from between the porting sleeve 600 and the case 12 through the openings 620 into the intermediate chamber 850. Fluid is unable to pass into the top chamber 852 due to the substantial seal formed by the overlapping upstream porting band 718 and the inner surface of the second portion 664 of the porting sleeve 600. An exhaust path 872 between the inner tube 100 and the surface 717 of the passage 714 remains open and therefore prevents build-up of fluid pressure within the top chamber 852. Accordingly the piston 700 continues to move on this upward stroke.

Figure 38:
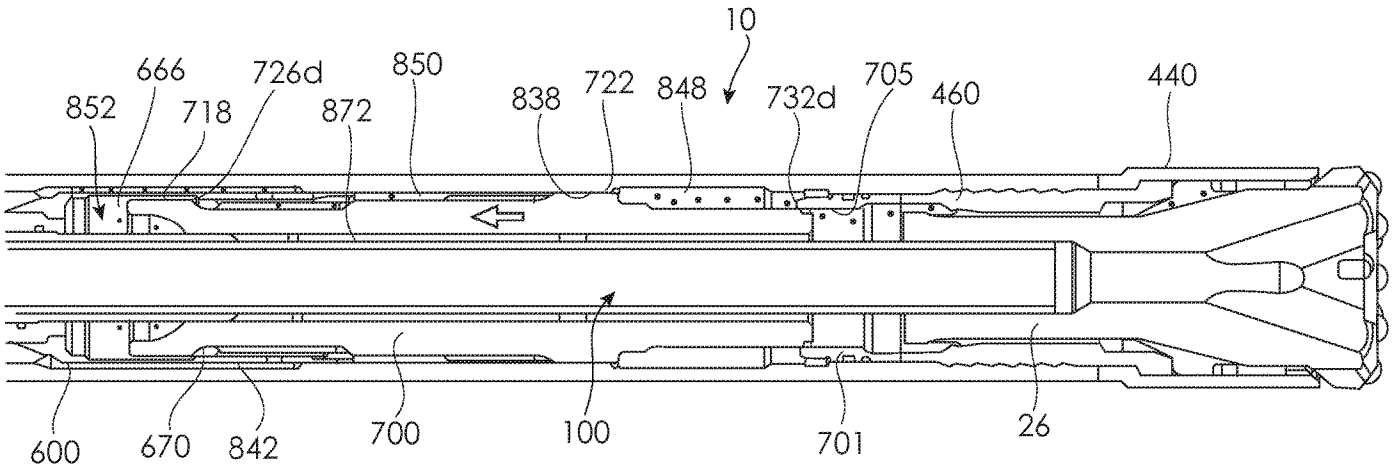

With continued upstream movement of the piston 700 the piston reaches a position in its cycle depicted in FIG. 38. In this position it will be noted that the bottom chamber 848 is now open at its downstream end due to the downstream porting edge 732*d* being axially displaced from and no longer in radial alignment with the surface 705. Thus fluid previously within the bottom chamber 848 is now free to exhaust to the hole between the drive sub 460 and the bit 24. The overlapping of the surface 838 and intermediate porting band 722 maintain an upstream end of the bottom chamber 848 sealed or closed.

The driving fluid flows from between the outside of the porting sleeve 600 and the portion 842 of the case 12. This fluid passes through the openings 620 and is now able to flow into both the intermediate chamber 850 and the top chamber 852. Flow into the top chamber 852 is possible because the downstream porting edge 726*d* of the porting band 718 has passed the shoulder 670. Accordingly the porting band 718 now resides within the third portion 666 of the porting sleeve 600. A gap now exists between the surface of the portion 666 and the porting band 718 enabling fluid to flow into the top chamber 852. Also, the exhaust path 872 is closed due to the shoulder 65 of the inner tube 100 now forming a seal with an inside surface of the passage 714. Thus now fluid pressure commences to build in the top chamber 852.

Figure 39:
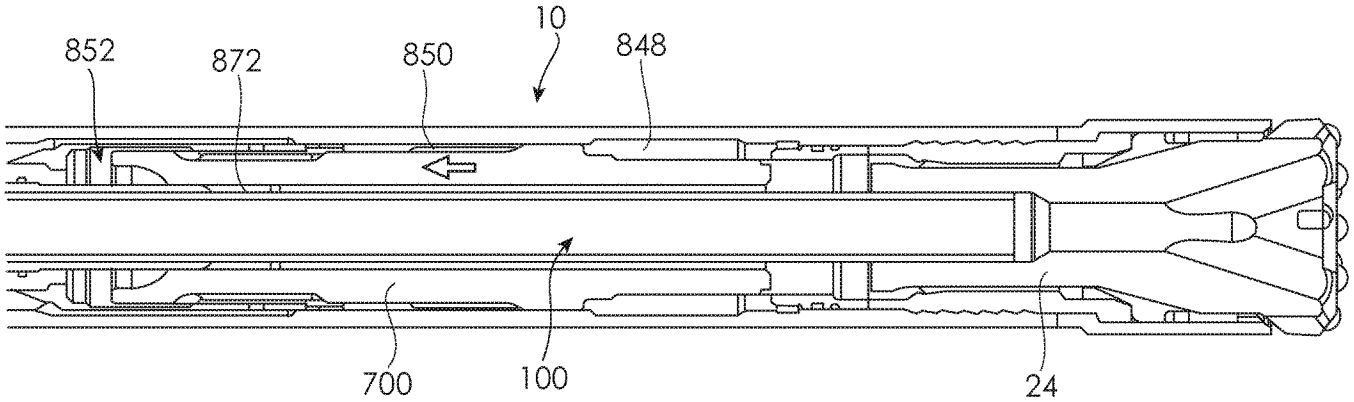

FIG. 39 depicts the piston 700 at the top of its stroke in the hammer drill 10. A downstream end of the bottom chamber 848 is open while its upstream end is closed. A downstream end of the intermediate chamber 850 is closed but the intermediate chamber 850 and the top chamber 852 are subjected to the same fluid pressure as both are open and operating fluid is able to flow into both these chamber. As the exhaust path 872 is closed the fluid pressure within the top chamber 852 builds to the extent that it arrests the upstream motion of the piston 700 and commences the downstream motion or impact stroke of the piston 700. The commencement of this is depicted in FIG. 40.

Figure 40:
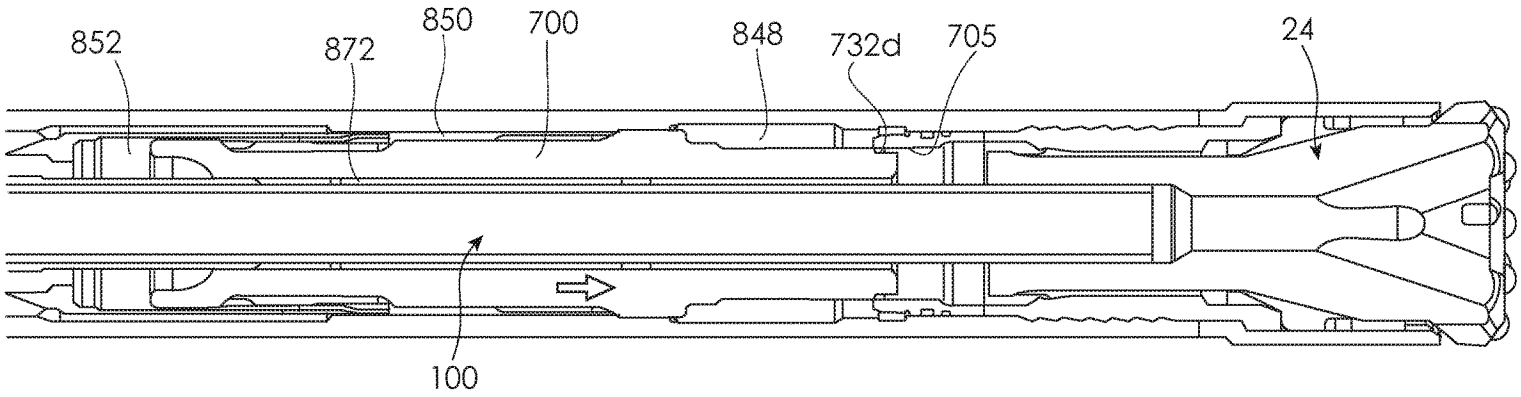

FIG. 40 depicts the piston 700 in the hammer drill 10 moving in its downstream or impact stroke. The top chamber 852 remains open and therefore continues to receive pressurised fluid. The intermediate chamber 850 is also open. An upstream end of the bottom chamber 848 is closed and the downstream end of the top chamber 848 has just closed due to the downstream porting edge 732*d* being in radial alignment or otherwise lapped by the surface 705. The exhaust path 872 remains closed. While fluid within the closed bottom chamber 848 will become pressurised as the piston 700 moves further in its impact stroke the force supplied by this pressure is not sufficient to overcome the force applied by the fluid pressure in a top chamber 852 driving the piston 700 in the downstream direction.

Figure 41:
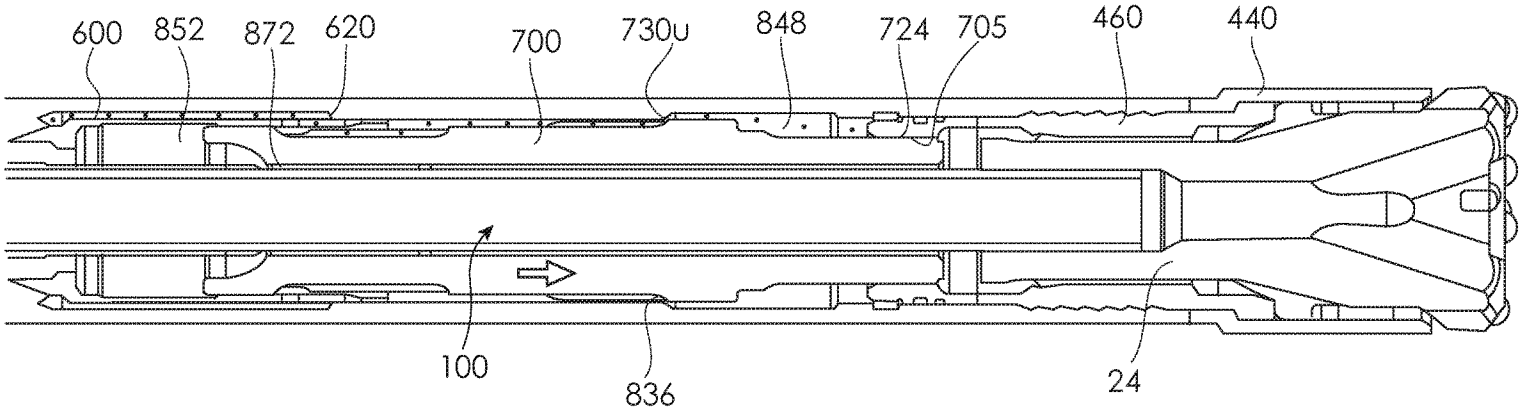

FIG. 41 depicts the piston 700 in the hammer 10 in a subsequent stage of operation to that of FIG. 40. The piston 700 has now moved in a downstream direction to a position where the upstream porting edge 730*u* has just passed the shoulder 836 so as to open the upstream end of the bottom chamber 848. A downstream end of the bottom chamber 848 remains closed due to the downstream porting band 724 forming a substantial seal with the surface 705. Also, the exhaust path 872 is open allowing fluid pressure within the top chamber 852 to be exhausted through the central passage 714. Thus prior to the piston 700 striking the bit 24 the pressure applied at the top chamber 852 is relieved. Also, the flow path of fluid into the top chamber 852 is shut due to the substantial seal formed between the upstream porting band 718 and the surface of the second portion 664 of the porting sleeve 600. Accordingly there is an equalisation of pressure within the intermediate chamber 850 and the bottom chamber 848.

Figure 42:
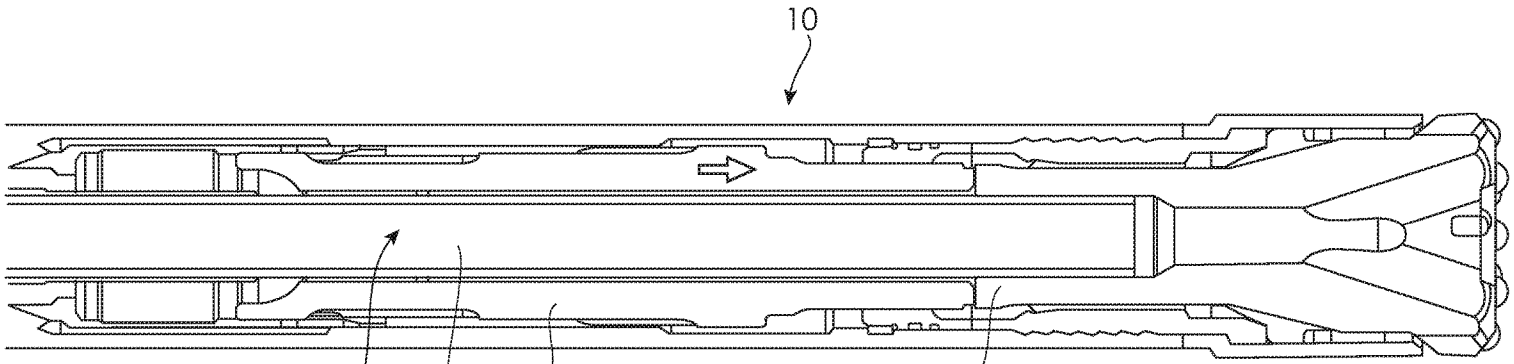

FIG. 42 depicts a subsequent point in the operating cycle of the piston 700 in which the piston strikes the bit 24. In effect this now returns to the operational state shown in Figure 36. Thus the complete operating cycle of the piston 700 and hammer 10 has been described.

The operation of the present hammer drill 10 described above is for when the hammer 10 is in drilling mode with the drill bit 24 in contact with or cyclically impacting a toe of a hole. However at times the hammer drill 10 is operated in a blow down mode depicted in FIG. 43. In the blow down mode the hammer drill is lifted from the toe of the hole by a relatively short distance. The distance is sufficient to allow the drill bit 24 to slide in an axial direction until stopped by a retaining mechanism which comprises the combination of the lugs 584 of the bit 24 contacting the abutment 444 of the shroud 440. In the blow down mode the fluid which would otherwise be used to drive the piston is passed directly to the hole being drilled to clear the hole. Cuttings and other debris at the bottom of the hole pass through the central passage 26 and the inner tube 100 to the surface.

Figure 43:
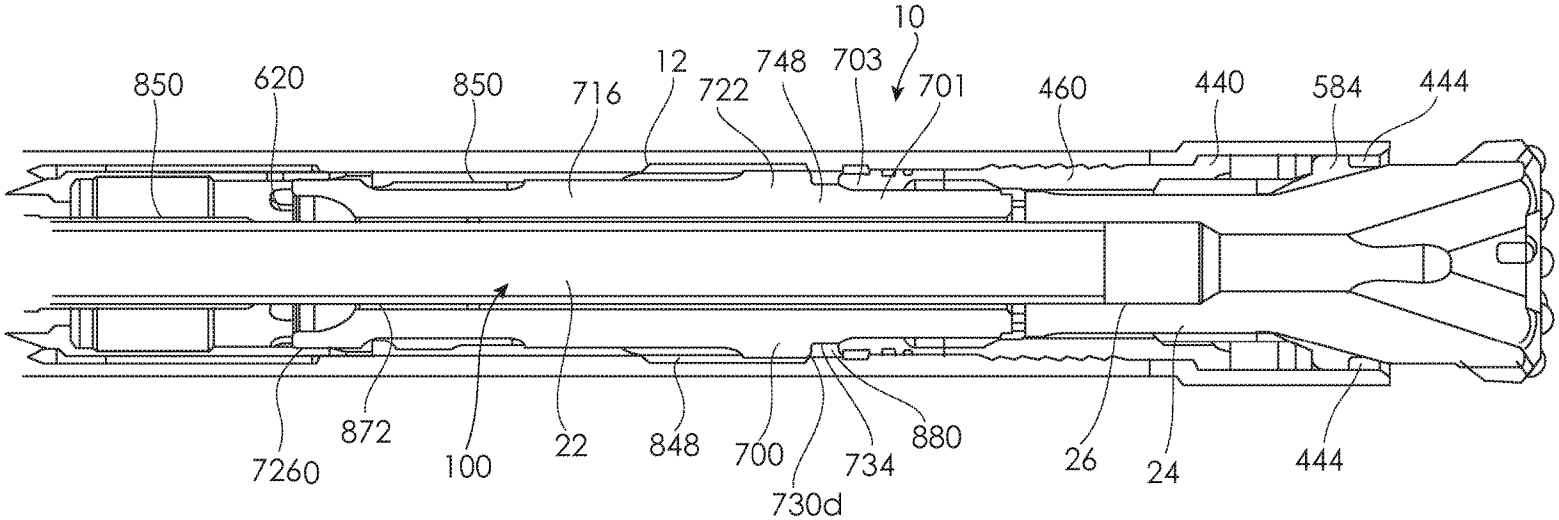
FIG. 43 illustrates an embodiment of the disclosed DTH hammer drill in blow down mode.

Ideally in the blow down mode the piston 700 does not reciprocate. Indeed reciprocation when in the blow down mode is destructive of the hammer drill. From FIG. 43 it can be seen that when in the blow down mode the piston 700 is seated against the sleeve 701 and the upper end of the bit 24 is spaced from the nose 736 of the piston 700. Thus, if the piston 700 were to commence reciprocating when in the blow down mode the impact force of the piston 700 will be imparted to the sleeve 701. Ordinarily this will cause damage to the sleeve 701 and the retaining ring 703 and render the hammer drill 10 inoperable. However embodiments of the piston 700 and piston porting system act to substantially prevent reciprocation of the piston 700 during the blow down mode and indeed hold the piston 700 in a fixed axial position relative to the outer case 12. This fixed position is as shown in FIG. 43 where the shoulder 748 of the stop 734 bears against an upstream end of the sleeve 701.

When the hammer drill 10 is in the blow down mode with the piston 700 bearing against the spacer sleeve 701, the downstream end of the bottom chamber 848 is open and provides fluid communication around the intermediate porting band 712 to a region 880 between the porting edge 730*d* and the sleeve 701. Also at this time the intermediate chamber 850 is open at its upstream end and the top chamber 852 is open. The exhaust path 872 is also open. Thus fluid is able to flow into the top chamber 852 through the openings 620 into the exhaust path 872, and subsequently between the drive sub 460 and the outside of the bit 24 and into the hole. The fluid is then returned through the central passage 22 and inner tube 100.

Also, the fluid pressure acting on the outer circumferential surface 716 and more particularly the entirety of the outer surface of the piston 700 is substantially the same from the upstream porting edge 726*u* to the shoulder 748. The region 880 is open at its upstream end and in fluid communication with the top chamber 852. Thus the pressure in region 880 and the top chamber 852 is about the same. In other words the piston 700 is surrounded by fluid at substantially uniform pressure. There is no significant pressure differential between opposite ends of the piston 700. Given the equalisation of fluid pressure the piston 700 is now held by the fluid pressure against the sleeve 701 in a fixed axial position. This arises because the surface of the piston is arranged so that when acted upon by a substantially uniform fluid pressure the net force applied by the fluid (being pressure× area) is directed in a downstream direction. Thus the piston is held against the sleeve 701. The uniform pressure field exists due to the above described relationship between the piston and the porting arrangement.

More particularly in relation to surface areas the piston 700 has: (a) a downstream surface area being a total of the surface area of the piston 700 looking in a downstream direction that is not parallel to a central axis of the piston and is within and between the top and bottom chambers 852 and 848; and (b) an upstream surface area being a total of the surface area of the piston looking in an a downstream direction that is not parallel to the central axis and is within and between the top and bottom chambers. The downstream surface area is greater than the upstream surface area. Thus given pressure equalization within and between the top chamber 852 and the bottom chamber 848, the force applied by fluid pressure in the downstream direction on the piston 700 is greater than that in the upstream direction, thus holding the piston 700 down and preventing back hammer.

It will be noted that with the current piston 700 and porting system in the hammer drill 200 there is no need for the present piston 700 to have recesses equivalent to recesses 742 in the prior art piston 700*p*. This is because in the current embodiment the region 880 always remains open. Since the nose 736 of the piston 700 can be made without recesses or indeed any functionally equivalent converging shapes, and planes, all of which provide stress raisers, it can be mechanically stronger and have a greater mass than the prior art piston 700*p*.

In summary some of the substantive differences between embodiments of the present piston 700 and porting system and prior art are as follows:

- the bottom chamber 848 is turned ON (i.e. open at its upstream end) along with the top chamber 852 when hammer 10 is in the blowdown mode.
- when in blow down mode, because greater force (pressure×area) exist in the top camber 852 than the bottom chamber 848; then a greater force holds the piston 700 down than is trying to push it up, thus holding the piston 700 down, the drill hole pressure can change without changing the ratio of the top cylinder force to comparatively less bottom chamber force for comparable chamber pressures; as the force ratio is then only caused by the difference in chamber areas of the top and bottom chambers, any hole pressure changes will only change the force magnitudes not the force ratios that are only determined by the top and bottom chamber pressure areas, the present embodiment operates by surrounding the piston 700 in an equal pressure field and relying on the difference in the size of the areas the pressure can act on to push the piston 700 to the downstream end of its stroke and hold it there (i.e. by the unequal application of force arising from the designed geometry of the piston 700), in prior art hammer drills instead of turning both the top and bottom ON, the hammer is designed to turn the bottom cylinder OFF and bleed the pressure out, to stop the hammer from continuing to operate. This causes a problem in the event that the bottom cylinder doesn't bleed down fast enough or the hole pressure remains high. The problem being that the piston 700*p* can bounce and the hammer continues operating without the piston 700*p* being able to strike the bit, thus resulting in back-hammering.

In the claims which follow, and the preceding description, except where the context requires otherwise due to express language or necessary implication, the word "comprise" and variations such as "comprises" or "comprising" are used in an inclusive sense, i.e. to specify the presence of the stated features but not to preclude the presence or addition of further features in various embodiments of the apparatus and method as disclosed herein.

The claims defining the invention are as follows:

1. A DTH hammer comprising:

a hammer bit and a fluid drivable piston capable of cyclically impacting the hammer bit; and a fluid flow control system arranged to facilitate control of fluid available to drive the piston; the fluid flow control system comprising:

a ring having an inner diameter which forms an outer radius Ro of a flow path annulus through which a fluid from an upstream fluid supply flows to drive the piston; and an inner article locatable with respect to the ring to form an inner radius Ri of the flow path annulus wherein the ring and the inner article together define the flow path annulus through which fluid from the upstream supply flows to drive the DHT hammer.

2. The DTH hammer according to claim 1 wherein the ring is one of a plurality of user selectable rings of different inner diameter.

3. The DTH hammer according to claim 1 wherein the inner article is movable between at least a first choke position and a second choke position to vary the inner radius Ri of the flow path annulus.

4. The DTH hammer according to claim 1 wherein the inner article is biased to move in an upstream direction with reference to a direction of flow of the fluid to the piston from the supply.

5. The DTH hammer according to claim 1 comprising an inner tube which passes through the inner article and wherein the piston has an axial passage into which the inner tube extends and along which the piston can reciprocate when impacting the hammer bit.

6. The DTH hammer according 5 wherein the inner tube comprises a first tube having an outer circumferential surface; and a second tube locatable coaxial with and around a portion of the outer circumferential surface of the first tube, wherein the portion of the outer circumferential surface of the first tube and an inner circumferential surface of the second tube are relatively configured to create a bypass path there between enabling a portion of the fluid to flow in an axial direction between the first and second tubes and through the axial passage.

7. The DTH hammer according to claim 3 wherein the inner article is configured so that: when in the first choke position the inner article allows the bypass path to be open which enables diversion of a portion of the fluid downstream of the flow path annulus from being able to drive the piston; and when in the second choke position the inner article closes the bypass path so that substantially all of the fluid downstream of the flow path annulus is available to drive the piston.

8. The DTH hammer according to claim 3 comprising a spacer which can be selectively coupled in either (a) a first orientation with the inner article to hold the inner article in the first choke position and close the bypass path and (b) a second orientation with the inner article to hold the inner article in the first choke position and open the bypass path.

9. The DTH hammer according to claim 1 wherein the DHT hammer has an outer tube, the hammer bit has a shank and a cutting face that extends from a first end of the outer tube and a plurality of splines that extend axially along the shank; and further including a hammer bit retaining system having: a shroud capable of coupling to the first end of the outer tube, the shroud being locatable over an intermediate portion of the hammer bit, the shroud having an internal circumferential surface configured to provide an abutment surface for the hammer bit to prevent the hammer bit from falling from the outer tube, and facilitate substantially uniform fluid flow distribution in a down hole direction between the internal circumferential surface and an outer surface of the hammer bit.

10. The DTH hammer according to claim 9 wherein the internal circumferential surface of the shroud comprises a plurality of circumferentially spaced apart and radial inwardly extending protrusions, the protrusions forming the abutment surface.

11. The DTH hammer according to claim 9 comprising a detent system capable of holding the shroud in a first fixed rotational position relative to the bit in which the abutment surface is capable of abutting a stop on the bit to prevent the bit from passing out of the shroud.

12. The DTH hammer according to claim 11 wherein the detent system comprises a plurality of circumferentially spaced apart recesses formed in the internal circumferential surface of the shroud, the recesses axially spaced from the protrusions.

13. The DTH hammer according to claim 9 comprising a drive sub arranged to couple to the first end of the outer tube, the shroud being locatable over the drive sub and wherein the drive sub and the shroud are configured to enable clamping of the shroud between the first end of the outer tube and the drive sub.

14. The DTH hammer according to claim 1 comprising:

a first tube having an outer circumferential surface; and second tube locatable coaxial with and around a portion of the outer circumferential surface of the first tube, wherein the portion of the outer circumferential surface of the first tube and an inner circumferential surface of the second tube are relatively configured to create one or more fluid flow paths enabling the fluid to flow in an axial direction between the first and second tubes.

15. The DTH hammer according to claim 14 wherein the fluid flow paths are at least in part formed by profiling or configuring one or both (a) the portion of the outer circumferential surface of the first tube so that a radius of the portion of the outer circumferential surface is not constant, or (b) the inner circumferential surface of the second tube so that a radius of the inner circumferential surface is not constant.

16. The DTH hammer according to claim 14 comprising one or more access paths formed in the second tube enabling fluid from outside of the second tube to flow into the fluid flow paths.

17. The DTH hammer according to claim 14 comprising a seat extending in a radial direction from the outer circumferential surface of the first tube, the seat having a radial face at one end distant the second tube, the radial face being inclined to form an obtuse exterior angle with a longitudinal axis of the first tube.

18. The DTH hammer according to claim 1 wherein the piston comprises:

a body having an axial passage and an outer circumferential surface provided with a maximum of three axially spaced apart circumferential porting bands.

19. The DTH hammer according to claim 18 wherein the piston comprises a stop, wherein the porting bands comprise an upstream porting band, an intermediate porting band and a downstream porting band, and the stop is located between the intermediate porting band and the downstream porting band, and wherein the downstream porting band has a constant outer circumferential surface for an entire axial length from the stop to a downstream end of the piston.

20. The DTH hammer accord to claim 1 comprising an outer casing and a porting system wherein the hammer bit is supported by the outer case and the piston is capable of reciprocating axially within the outer case to cyclically impact the hammer bit, the porting system comprising:

an outer surface of the piston; and an arrangement of surfaces configured to interact with the outer surface to provide a substantially uniform fluid pressure distribution on the outer surface such that the fluid pressure is able to hold the piston in a fixed axial position relative to the outer case when the hammer drill is in a blow down mode.

21. The DTH hammer accord to claim 20 wherein the fixed axial position coincides with a downhole most position of the piston in the hammer drill.

22. The DTH hammer according to claim 20 wherein the outer surface comprises a maximum of three axially spaced apart circumferential porting bands, the bands being at axially spaced locations along the piston, wherein respective bands are capable of forming a substantial seal with the arrangement of surfaces at respective different sealing regions.

23. The DTH hammer according to claim 22 wherein the porting bands comprise an upstream porting band, an intermediate porting band and a downstream porting band wherein the upstream band has an upstream edge adjacent an upstream end of the piston and the downstream band has a downstream edge adjacent a downstream end of the piston.

24. The DTH hammer according to claim 23 comprising a stop on the outer circumferential surface and located between the intermediate band and the downstream band, wherein the downstream band has a plain outer circumferential surface with a substantially constant outer diameter for an entire axial length from the stop to the downstream end of the piston.

25. The DTH hammer according to claim 20 wherein the arrangement of surfaces comprises an inner circumferential surface of a porting sleeve disposed in the hammer drill and located such that an upstream end of the piston is maintained within the porting sleeve during operation of the hammer drill.

26. The DTH hammer according to claim 23 wherein the arrangement of surfaces comprises an inner circumferential surface of a porting sleeve disposed in the hammer drill and located such that an upstream end of the piston is maintained within the porting sleeve during operation of the hammer drill, the porting sleeve having a plurality of openings inboard of a downstream end of the porting sleeve and wherein the inner circumferential surface of the porting sleeve has a first portion at the downstream end thereof with a first inner diameter and second portion upstream of the downstream portion with a second diameter being smaller than the first diameter and wherein the openings span the first and second portions; the upstream band of the piston and the second portion relatively configured to create between them an upstream sealing region when the second portion at least partially overlies the upstream band, the upstream sealing region substantially preventing fluid from passing through the openings and into an upstream end of the piston.

27. The DTH hammer according to claim 26 wherein the first portion is configured relative to the outer circumferential surface to maintain a flow path that always remains open for all possible operational locations of the piston within the outer case wherein fluid is able to flow through the openings into an intermediate chamber located between the upstream band and the intermediate band.

28. The DTH hammer according to claim 23 wherein the arrangement of surfaces comprises an inner circumferential surface of the outer case configured to form with the intermediate band a bottom chamber seal when inner circumferential surface of the outer case at least partially overlies the intermediate band.

29. The DTH hammer according to claim 1 comprising:

an outer case in which the hammer bit is retained;

the piston being capable of reciprocating axially within the outer case to impact the hammer bit, the piston having an upstream end, a downstream end and an intermediate porting band between the upstream end and the downstream end;

a top chamber located between the outer case and the upstream end of the piston, the top chamber arranged to receive fluid for driving the piston in the downstream direction; and a bottom chamber located downstream of the intermediate porting band and between the piston and the outer case;

wherein the top and bottom chambers are arranged to be in direct fluid communication with each other when the hammer drill is operated in a blow down mode.

30. The DTH hammer according to claim 29 wherein the piston is configured to have:

a downstream surface area being a total of the surface area of the piston looking in a downstream direction that is not parallel to a central axis of the piston and is within and between the top and bottom chambers; and an upstream surface area being a total of the surface area of the piston looking in a downstream direction that is not parallel to the central axis and is within and between the top and bottom chambers;

wherein the downstream surface area is greater than the upstream surface area.

31. The DTH hammer according to claim 30 comprising a porting system having an arrangement of surfaces configured to interact with the outer surface of the piston to provide a substantially uniform fluid pressure distribution on the outer surface such that the fluid pressure is able to hold the piston in a fixed axial position relative to the outer case when the hammer drill is in the blow down mode.

32. The DTH hammer according to claim 31 wherein the arrangement of surfaces comprises an inner circumferential surface of a porting sleeve disposed in the hammer drill and located such that an upstream end of the piston is maintained within the porting sleeve during operation of the hammer drill.

33. The DTH hammer according to claim 32 wherein the porting sleeve has a plurality of openings inboard of a downstream end of the porting sleeve and wherein the inner circumferential surface of the porting sleeve has a first portion at the downstream end thereof with a first inner diameter and second portion upstream of the downstream portion with a second diameter being smaller than the first diameter and wherein the openings span the first and second portions; the upstream end of the piston and the second portion relatively configured to create between them an upstream sealing region when the second portion at least partially overlies the upstream end, the upstream sealing region substantially preventing fluid from passing through the openings and into an upstream end of the piston.

34. The DTH hammer according to claim 33 further comprising an inner tube that passes through the porting sleeve and the piston and an exhaust path is formed between the inner tube and inner surface of the piston, the exhaust port providing a flow path through the piston.

35. The DTH hammer according to claim 34 wherein the piston and the arrangement of surfaces are arranged so that when the piston is at the bottom of its stroke striking the hammer bit, fluid flows between the porting sleeve and the outer case; through the openings of the porting sleeve; through an intermediate chamber between the top chamber and the bottom chamber, over the intermediate porting band and into the bottom chamber.

36. The DTH hammer according to claim 35 further comprising a spacer sleeve inside of the outer case wherein notwithstanding reciprocation of the piston within the outer case, a portion of a nose of the piston is always within the spacer sleeve, and wherein a region is formed between a porting edge of the piston and the spacer sleeve when the hammer is in the blowdown mode the region being in fluid communication with the bottom chamber.

37. The DTH hammer according to claim 36 wherein when the hammer drill is in the blowdown mode, the exhaust path is open, the piston sides axially in a downhole direction to a position to uncover a portion of the openings in the porting sleeve wherein the fluid in the top chamber is able to flow (a) through to intermediate and bottom chambers to the region, and (b) through the openings in the porting sleeve and along the exhaust path into the hole, wherein the piston is surrounded by fluid at substantially uniform pressure.

* * * * *